US007604576B2

(12) United States Patent
Drechsler

(10) Patent No.: US 7,604,576 B2
(45) Date of Patent: Oct. 20, 2009

(54) UNIQUELY MULTI-FUNCTIONAL EXERCISE DEVICE

(76) Inventor: Arthur J. Drechsler, 33-30 150th St., Flushing, NY (US) 11354

( * ) Notice: Subject to any disclaimer, the term of this patent is extended or adjusted under 35 U.S.C. 154(b) by 283 days.

(21) Appl. No.: 11/218,951

(22) Filed: Sep. 2, 2005

(65) Prior Publication Data

US 2007/0054785 A1 Mar. 8, 2007

(51) Int. Cl.
*A63B 21/00* (2006.01)
*A63B 21/062* (2006.01)

(52) U.S. Cl. ..... 482/99; 482/100; 482/101; 482/138

(58) Field of Classification Search ..... 482/97–103, 482/92–94, 44, 45, 80, 121, 129, 130, 135–138
See application file for complete search history.

(56) References Cited

U.S. PATENT DOCUMENTS 3,012,777 A * 12/1961 Hotas ..... 482/100
4,231,568 A 11/1980 Riley
4,346,888 A * 8/1982 Szabo ..... 482/101
4,600,189 A * 7/1986 Olschansky et al. ..... 482/100
5,102,121 A * 4/1992 Solow et al. ..... 482/94
5,152,733 A * 10/1992 Farenholtz et al. ..... 482/135
5,242,344 A * 9/1993 Hundley ..... 482/93
5,263,914 A * 11/1993 Simonson et al. ..... 482/99
5,302,161 A * 4/1994 Loubert et al. ..... 482/8
5,308,304 A * 5/1994 Habing ..... 482/99
5,356,360 A * 10/1994 Johns ..... 482/99
5,370,595 A * 12/1994 Voris et al. ..... 482/100
5,447,480 A * 9/1995 Fulks ..... 482/99
5,468,202 A * 11/1995 Habing ..... 482/100
5,722,921 A * 3/1998 Simonson ..... 482/100
5,830,116 A * 11/1998 Gautier ..... 482/99
6,090,020 A * 7/2000 Webber ..... 482/100
6,203,474 B1 3/2001 Jones
6,238,323 B1 5/2001 Simonson
6,302,833 B1 * 10/2001 Ellis et al. ..... 482/100
6,394,937 B1 5/2002 Voris
6,443,874 B1 * 9/2002 Bennett ..... 482/44
6,488,612 B2 12/2002 Sechrest
6,595,903 B2 * 7/2003 Nerio et al. ..... 482/100
6,824,505 B1 * 11/2004 Chang ..... 482/95
2002/0086777 A1 7/2002 Charnitski (Continued)

FOREIGN PATENT DOCUMENTS

FR 2585958 A1 * 2/1987

*Primary Examiner*—Loan H Thanh
*Assistant Examiner*—Victor K Hwang

(57) ABSTRACT

A multi-purpose exercise apparatus used for linear and rotational resistance exercises with varying heights, diameters, angular ranges and planes. The apparatus relates to a frame (frame 430) and at least one carriage (300) supported by and movable on the frame. The carriage (300) supports at least one spooling force transmitter (102), and/or at least one translating force transmitter (101), which is connected to a resistance source (resistance source 494) through a flexible connector (476). The spooling force transmitter (102) is connected to a rigid arm (390) to which the user can apply rotational force against the spool and connected resistance. The spooling force transmitter (102) pivots on a positioning axis that is coincident with the longitudinal axis of the flexible connector (476) immediately before the connector attaches to the spooling force transmitter (101). The user can apply force to the translating force transmitter (101) to perform guided straight-line motions in a variety of directions.

38 Claims, 46 Drawing Sheets

U.S. PATENT DOCUMENTS

2002/0111254 A1 8/2002 O'Hearn
2002/0137605 A1* 9/2002 Olsen ..... 482/99
2002/0193213 A1 12/2002 Batca et al.
2003/0060343 A1 3/2003 Sechrest
2004/0157711 A1 8/2004 Regev

* cited by examiner

UNIQUELY MULTI-FUNCTIONAL EXERCISE DEVICE

CROSS REFERENCE TO RELATED APPLICATIONS

Not Applicable

FEDERALLY SPONSORED RESEARCH

Not Applicable

SEQUENCE LISTING OR PROGRAM

Not Applicable

BACKGROUND

The invention relates to an exercise device, more specifically to an exercise machine, capable of providing a choice of a wide variety of resistance exercises to a diverse population of users with varying needs.

Interest in resistance training is growing as we have come to better understand its myriad benefits. Resistance trainers come in all sizes, shapes, genders, and ages, vary in their physical abilities and have a wide variety of rationales for their training, rationales which may well change within the same individual over time. Some resistance exercisers train for general fitness, others to gain or lose weight, still others to improve their sports performance, and still others use resistance training for rehabilitative purposes. Trainers pursuing improved sports performance and rehabilitation often find it difficult, if not impossible, to perform resistance exercises that closely simulate the movements of the sports activities or those involved in daily living. Moreover, many trainers have multiple objectives and their emphasis on one or another of those objectives can shift in the short or long term.

While needs are broad, vary from individual to individual, and can change, economic, time and space limitations, constrain the commercial enterprises that offer resistance training. That is, it is difficult to provide resistance training equipment that meets the needs of all their actual and potential customers. Those who train at home generally face even more severe constraints of this nature. Consequently, there is always a desire for resistance training equipment that is more versatile.

Information relevant to attempts to address these problems can be found in U.S. Patent Nos. 2004/0157711A1 to Regev, 2003/0060343 to Sechrest et. al., 2002/0193213 to Batca et al., 2002/0111254 to O'Hearn, 2002/0086777 to Charnitski, and issued U.S. Pat. No. 6,488,612 to Sechrest et. al., U.S. Pat. No. 6,394,937 to Voris, U.S. Pat. No. 6,302,833 to Ellis et al., U.S. Pat. No. 6,203,474 to Jones, U.S. Pat. No. 6,238,323 to Simonson, U.S. Pat. No. 6,090,020 to Webber, U.S. Pat. No. 5,447,480 to Fulks, U.S. Pat. No. 5,102,121 to Sollow et al. and U.S. Pat. No. 4,231,568 to Riley et al.

However, each one of these references suffers from one or more of the following disadvantages:

1) Lack of ability to provide the resistance patterns of certain athletic or sports events, rehabilitation exercises or activities of daily living.
2) Significant limits on the variety of exercises that can be performed.
3) Significant limits on the height, angular range, and diameter of rotation that is possible.
4) Inability to select and fix the angle of the exercise to be performed.

5) Inability to permit consistent resistance for both linear and rotational exercises.
6) Inability to permit both guided and freer movements.
7) Need for multiple stations.
8) Inability to serve trainers in standing, sitting, and reclining positions.
9) Lack of adequate adjustability for trainees of differing sizes and capabilities.
10) Requirement for complex lever, gear or other mechanisms for transmitting force from a resistance source to the user.

For the foregoing reasons, there is a need for a machine that can provide consistent linear and rotational resistance at virtually any height relative to the user, at any angle, in any arc plane and angular range, both linearly rotationally, guided and free in a relatively simple way. Various versions of the apparatus described herein address all of the aforementioned deficiencies. Further objects and advantages of the invention will become apparent from a consideration of the drawings and ensuing description.

SUMMARY

The present apparatus that satisfies the need for consistent linear and rotational resistance, can accommodate users of practically any height, and permits the user to select from a wide range of linear and rotational resistance heights and directions, and a very wide arc size and arc angle range on a single apparatus.

The apparatus comprises a frame and a carriage that can be adjusted in height and/or angle relative to the frame. The carriage supports one or more force transmitters to which is attached a flexible connector that is linked to a resistance source. The carriage is adapted to permit each force transmitter to move in at least one degree of freedom relative to the carriage, while the carriage is itself capable of supporting the force transmitter in a plurality of fixed positions relative to the frame. In some preferred versions of the apparatus, the force transmitter translates along the horizontal axis of the carriage. In other embodiments, the transmitter is a spool that rotates relative to the carriage. In still other embodiments, one carriage supports both kinds of force transmitters.

Similarly, some embodiments of the apparatus enable the height of the force transmitter relative to the user to be adjusted. In other embodiments, the axis of rotation of the force transmitter can be adjusted and in still other embodiments, both kinds of adjustments are enabled. In all cases, the position of the transmitter relative to the user can be fixed once it is selected by the user.

When the force transmitter is a spool, a rigid arm can be attached to a shaft that supports the spool, enabling the user to apply force to apply angular force the rigid arm to perform an exercise that involves a rotational motion.

Through the use of pivoting mechanisms, the angle of the carriage, or sections thereof, relative to the frame, can be adjusted around a horizontal, a vertical axis, or both, permitting the user to exercise in a wide variety of directions.

In a number of preferred embodiments, the diameter, degree and plane of any angular rotation, as well as the height at which it occurs, are selected by the user. The user is able to employ the device while standing, sitting, or reclining. Implements are added to the end of the flexible connector or crank arm to simulate the movements of many sports and permit many rehabilitative exercises to be performed.

The unprecedented adjustability of the apparatus enables the user to perform the vast majority of resistance exercises ever invented and some that have never been performed before.

In the drawings, some closely related figures have the same number but different alphabetic suffixes.

DRAWINGS

Figures

These and other features, aspects and advantages of the present apparatus will become better understood with reference to the following description, appended claims, and accompanying drawings where:

Figure 4:
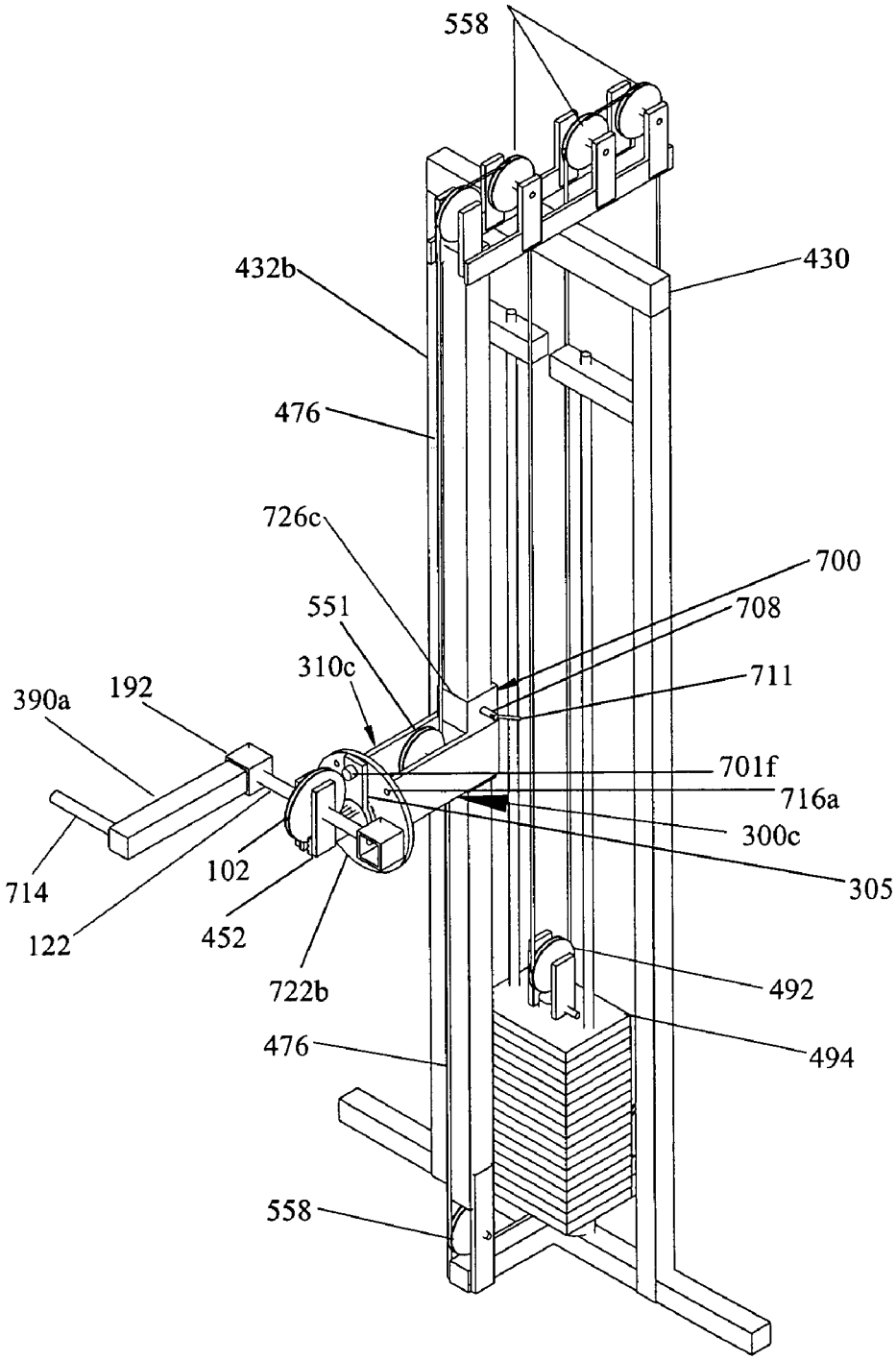
FIG. 4 shows another variation of the spool pivoting device shown in FIG. 1, with a circular plate spool angle locking device mounted on the carriage.
Figure 9:
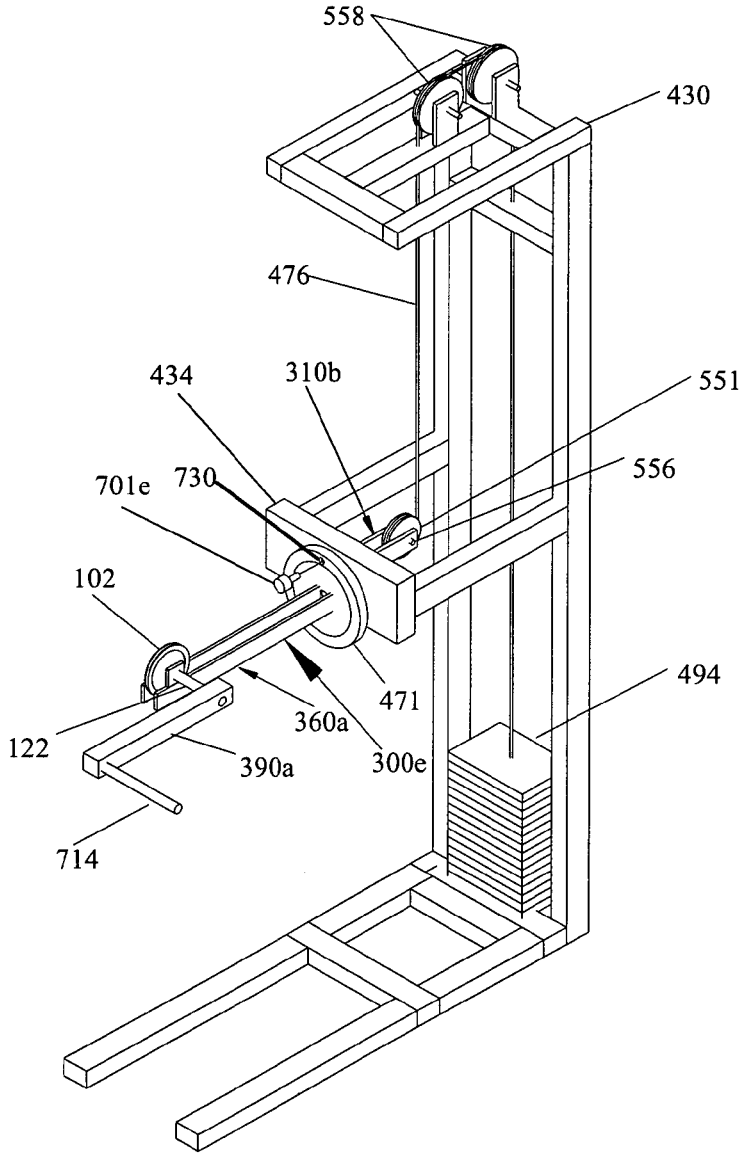
Figure 9A:
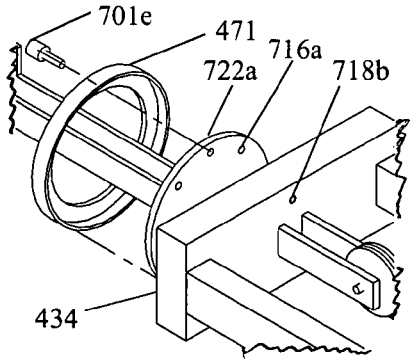

FIG. 9 shows a pivoting carriage similar to that in FIG. 4 but with the carriage supported by a horizontal rigid frame member and the carriage pivoting capability enabled by a cup-shaped member supporting a circular plate instead of a tube. FIG. 9A shows an exploded detail of the alternative carriage pivot mechanism from the left rear side of the apparatus (as compared with the front right side perspective view in FIG. 9).

Figure 10:
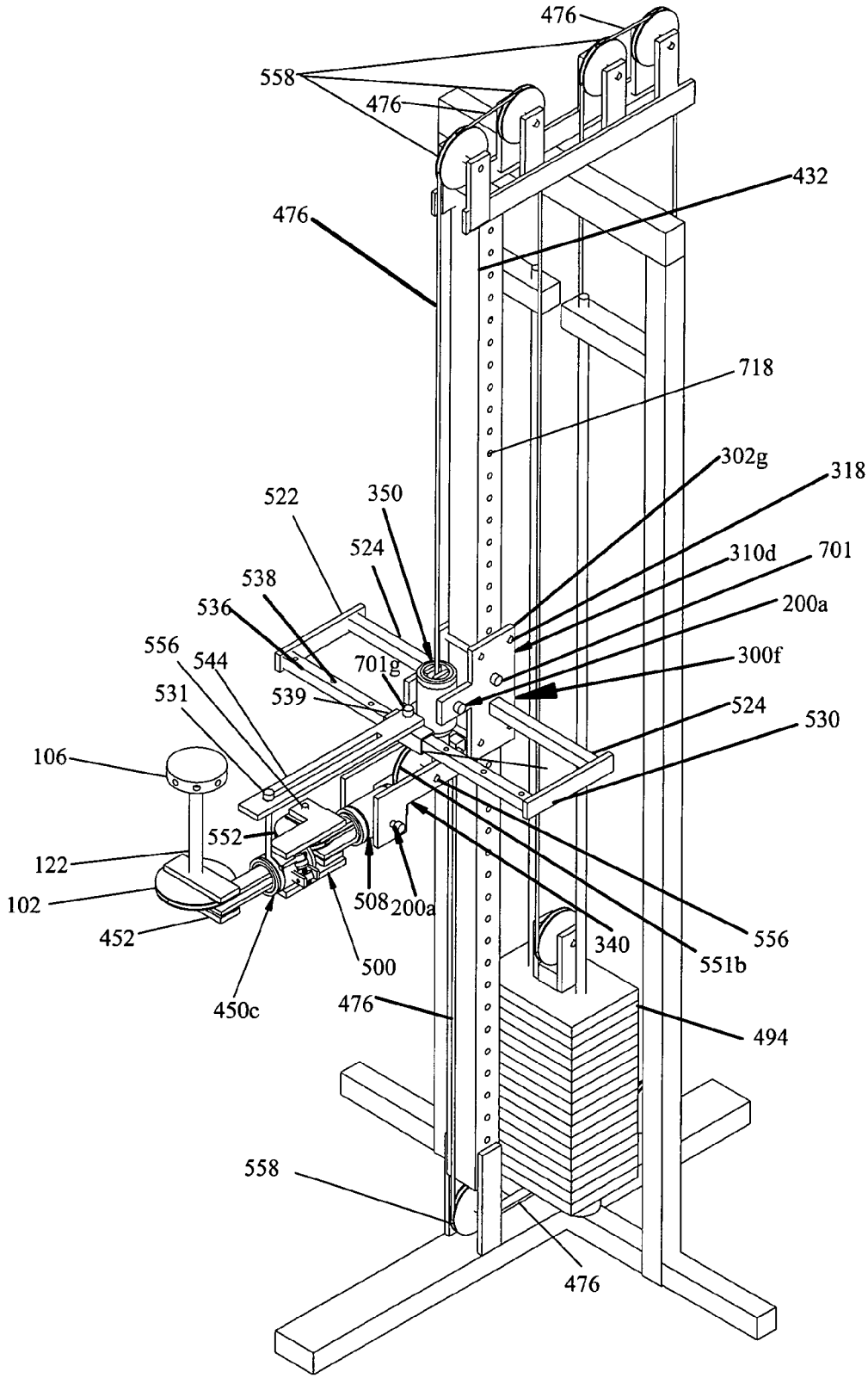

FIG. 10 shows a version of the apparatus with a vertical axis carriage pivot mechanism and a constraint mechanism.

Figure 10A:
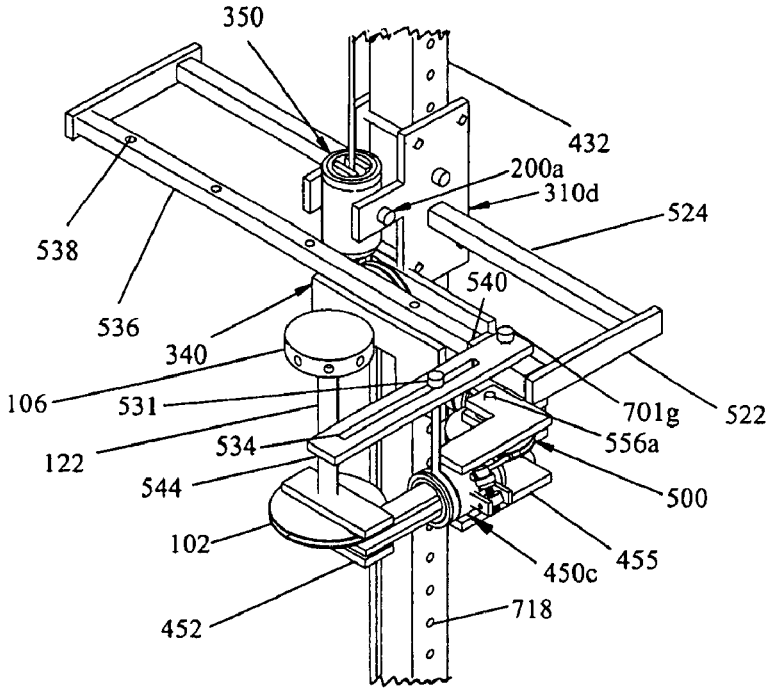
Figure 10B:
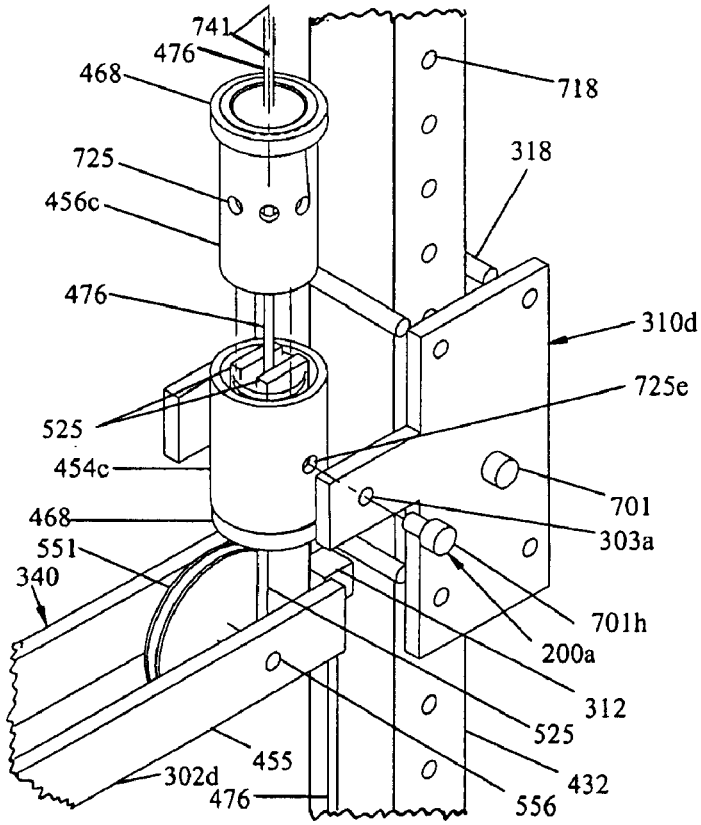
Figure 10C:
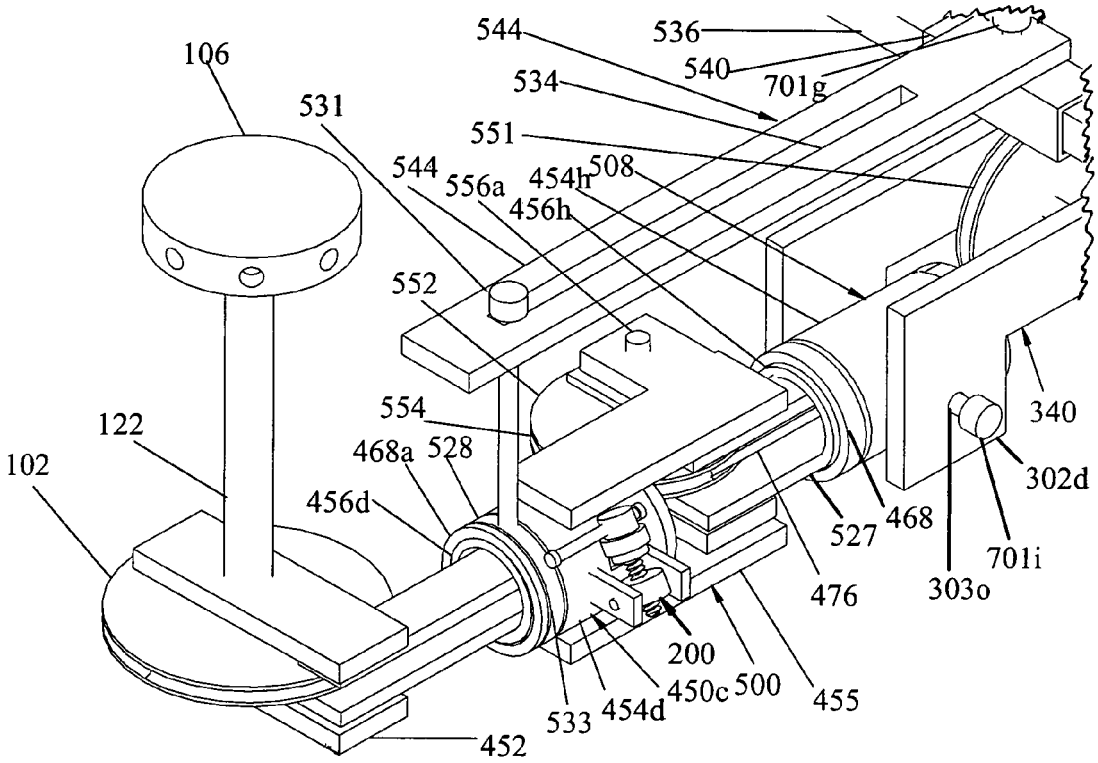
Figure 10D:
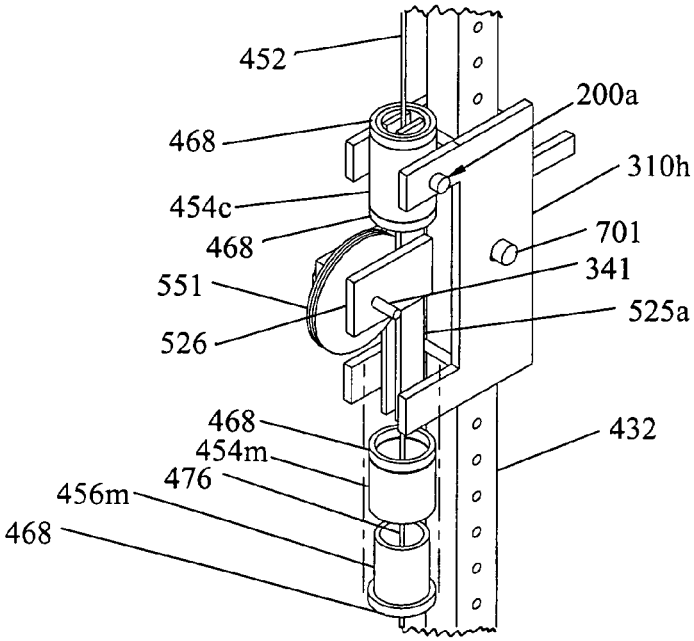

FIG. 10A shows the apparatus in FIG. 10 with the carriage turned on the vertical axis pivot mechanism 90 degrees from the position shown in FIG. 10. FIG. 10B shows an exploded detail of the vertical axis pivot mechanism shown in FIG. 10. FIG. 10C shows another detailed view of the vertical axis pivot mechanism and constraint shown in FIG. 10. FIG. 10D shows a detail of an alternative version of the pivot mechanism to the one detailed in FIG. 10B.

Figure 11:
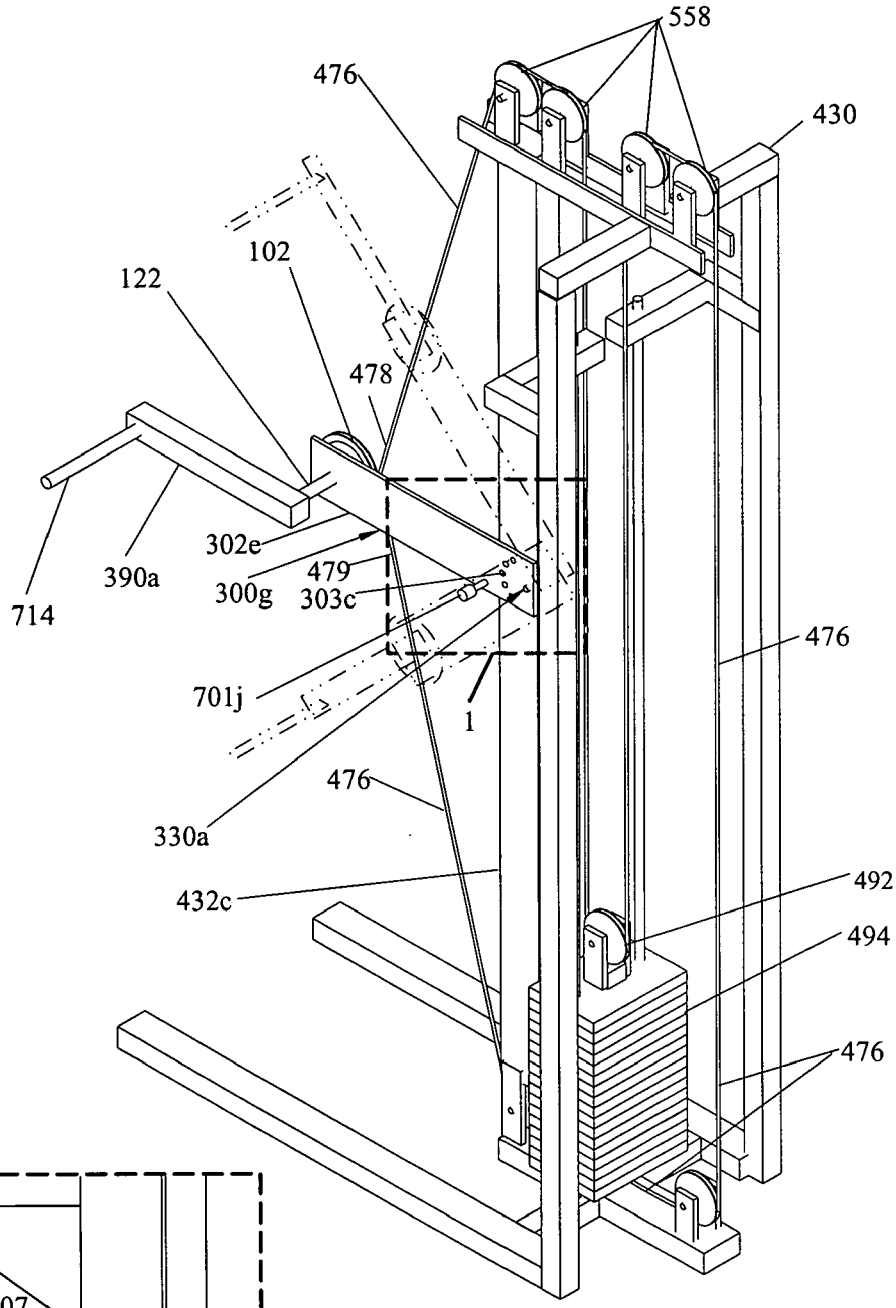

FIG. 11 shows a carriage that supports a force transmitting spool at a variety of heights using a horizontal axis pivot mechanism. FIG. 11 A shows a detail of the horizontal axis carriage pivoting mechanism shown in FIG. 11.

Figure 12:
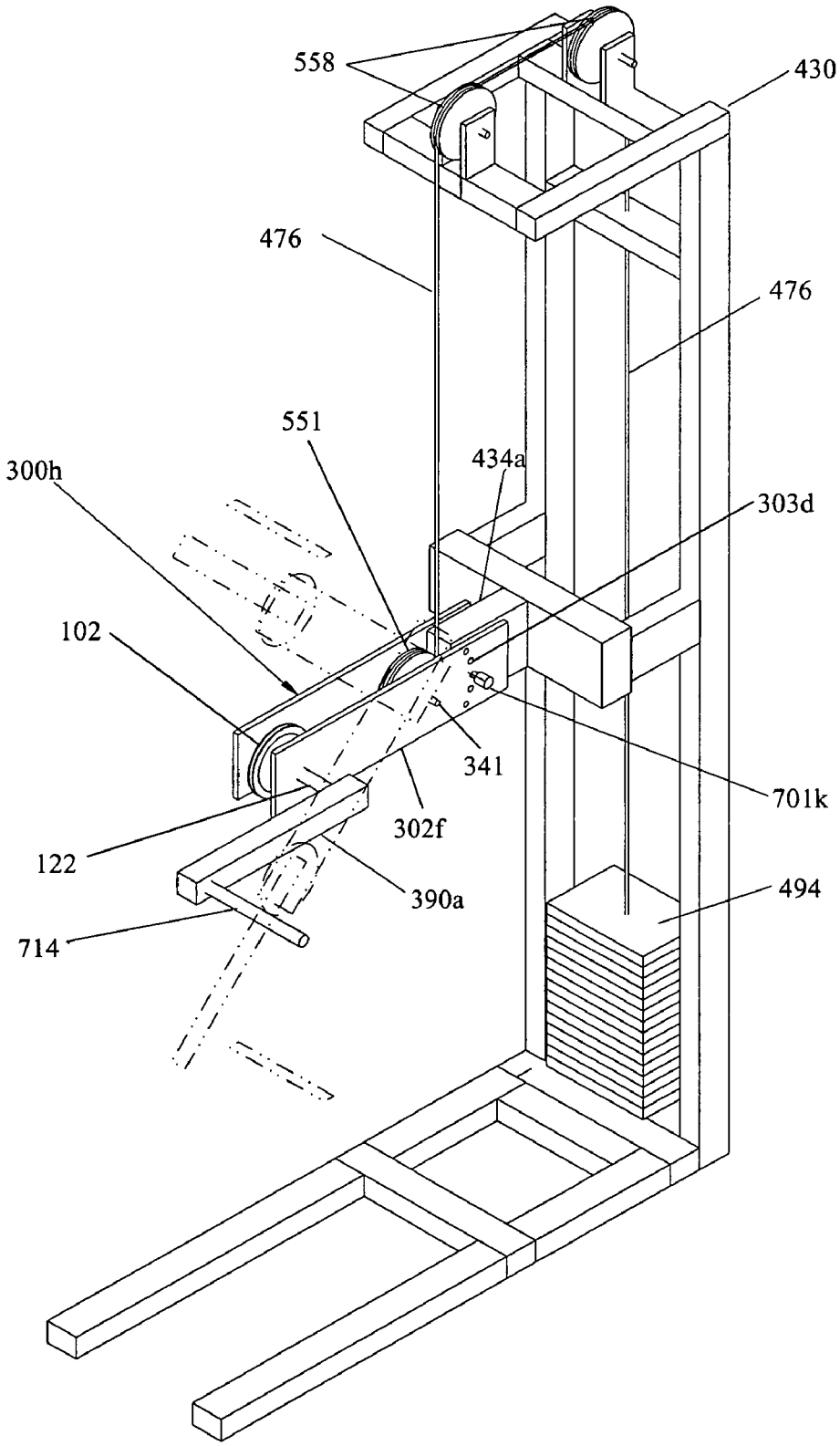

FIG. 12 shows another variation of the horizontal axis pivoting type of carriage shown in FIG. 11, with the carriage and the carriage itself mounted on a horizontal frame member.

Figure 13:
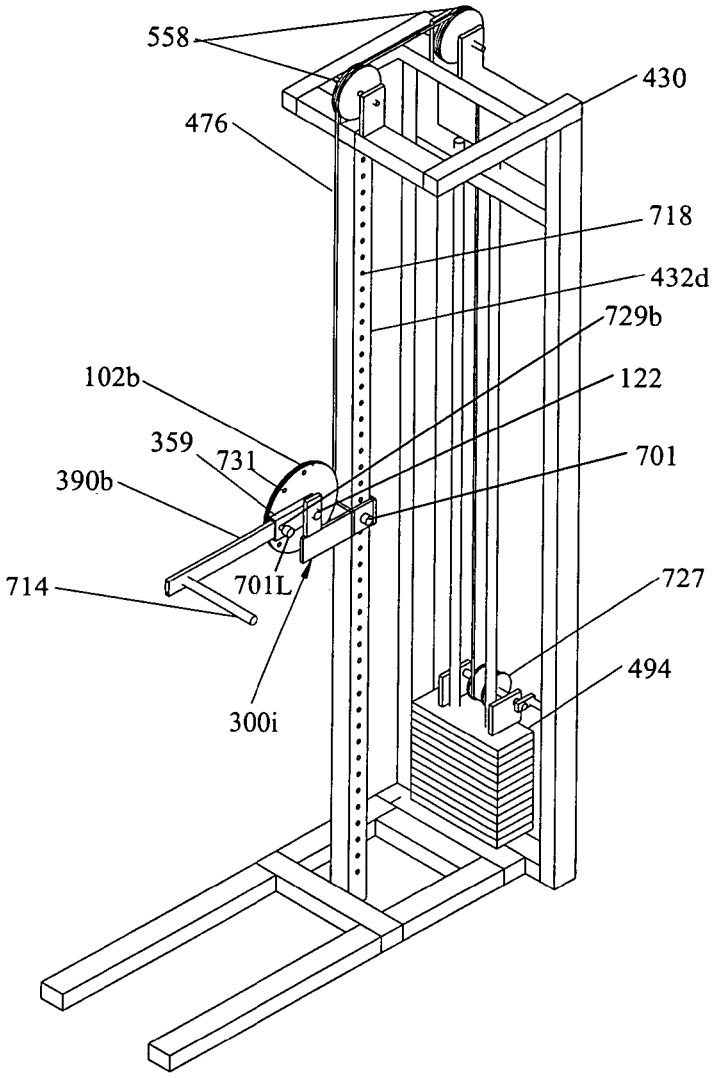
Figure 13A:
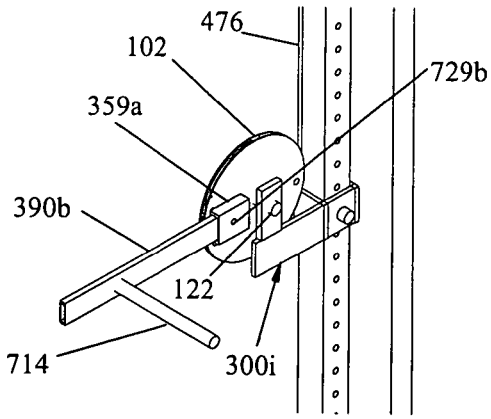

FIG. 13 shows a version of the apparatus in which the connection of the rigid arm to the spooling force transmitter is direct. FIG. 13A shows a detail of another version of the rigid arm to spool connection.

Figure 14:
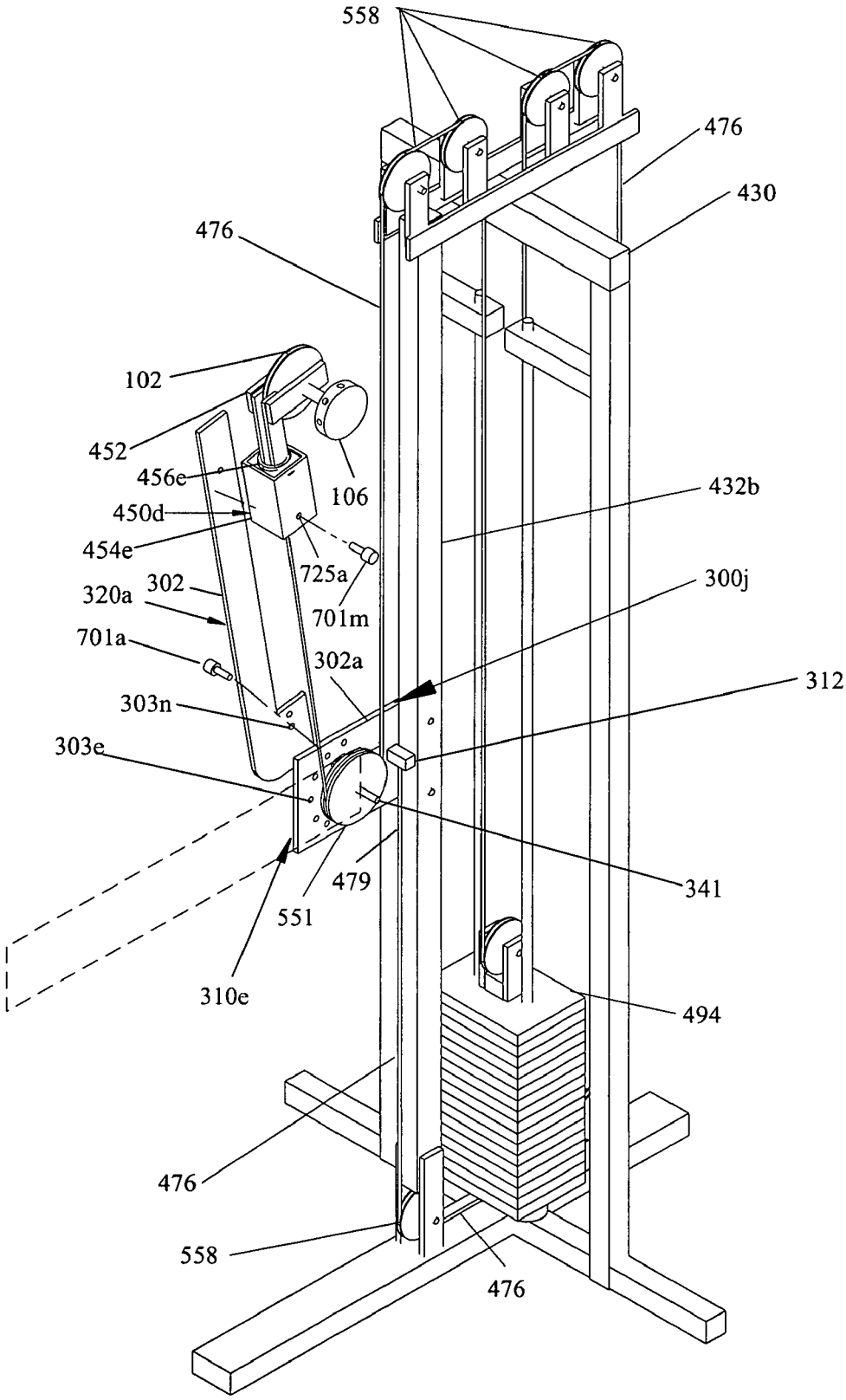

FIG. 14 shows a version of the apparatus with a horizontal axis carriage pivot, the carriage having 2 sections, each with only one carriage wall.

Figure 1:
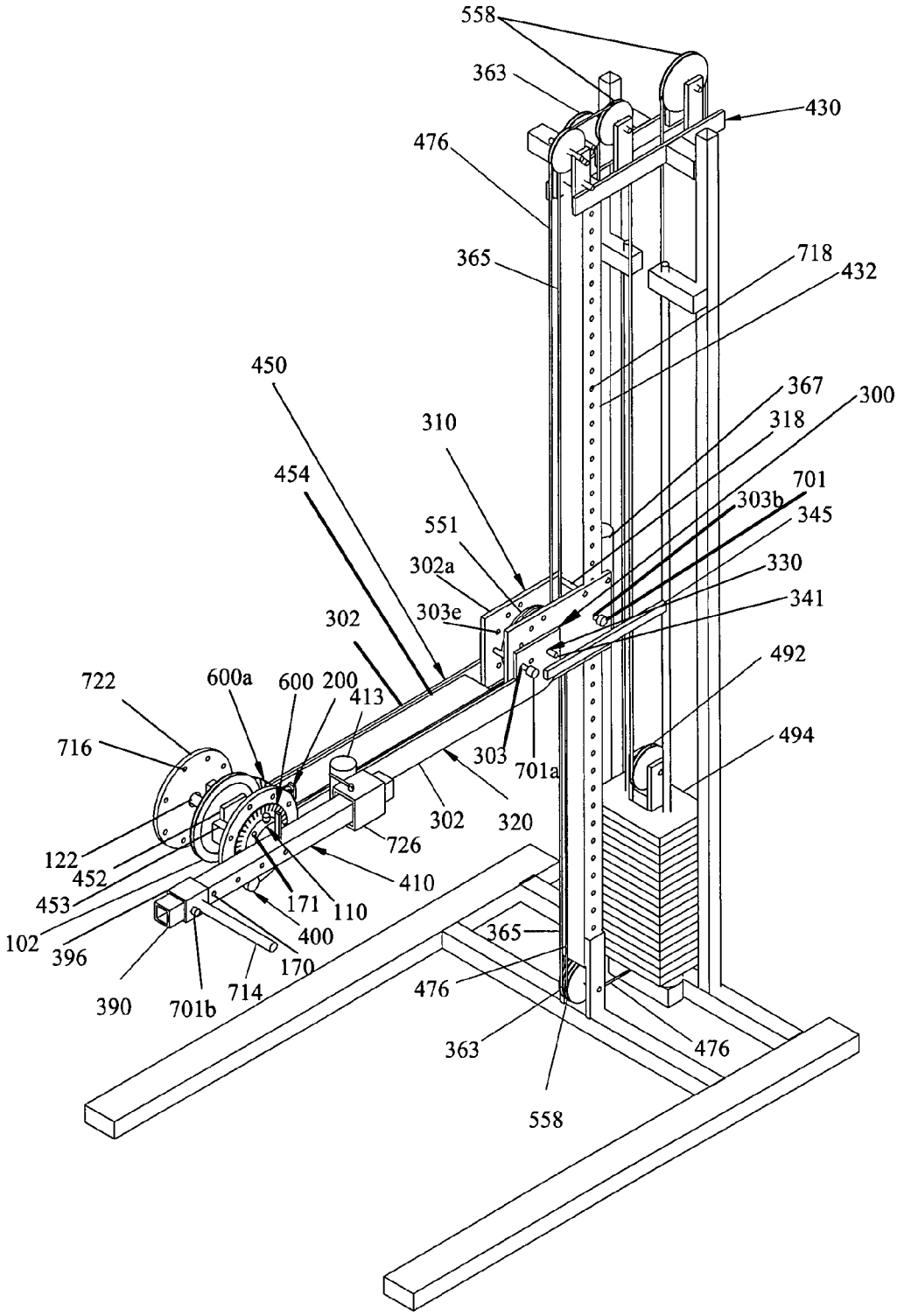
FIG. 1 shows a perspective view of a preferred embodiment of the apparatus with a spooling force transmitter capable of pivoting on its positioning axis.
Figure 15:
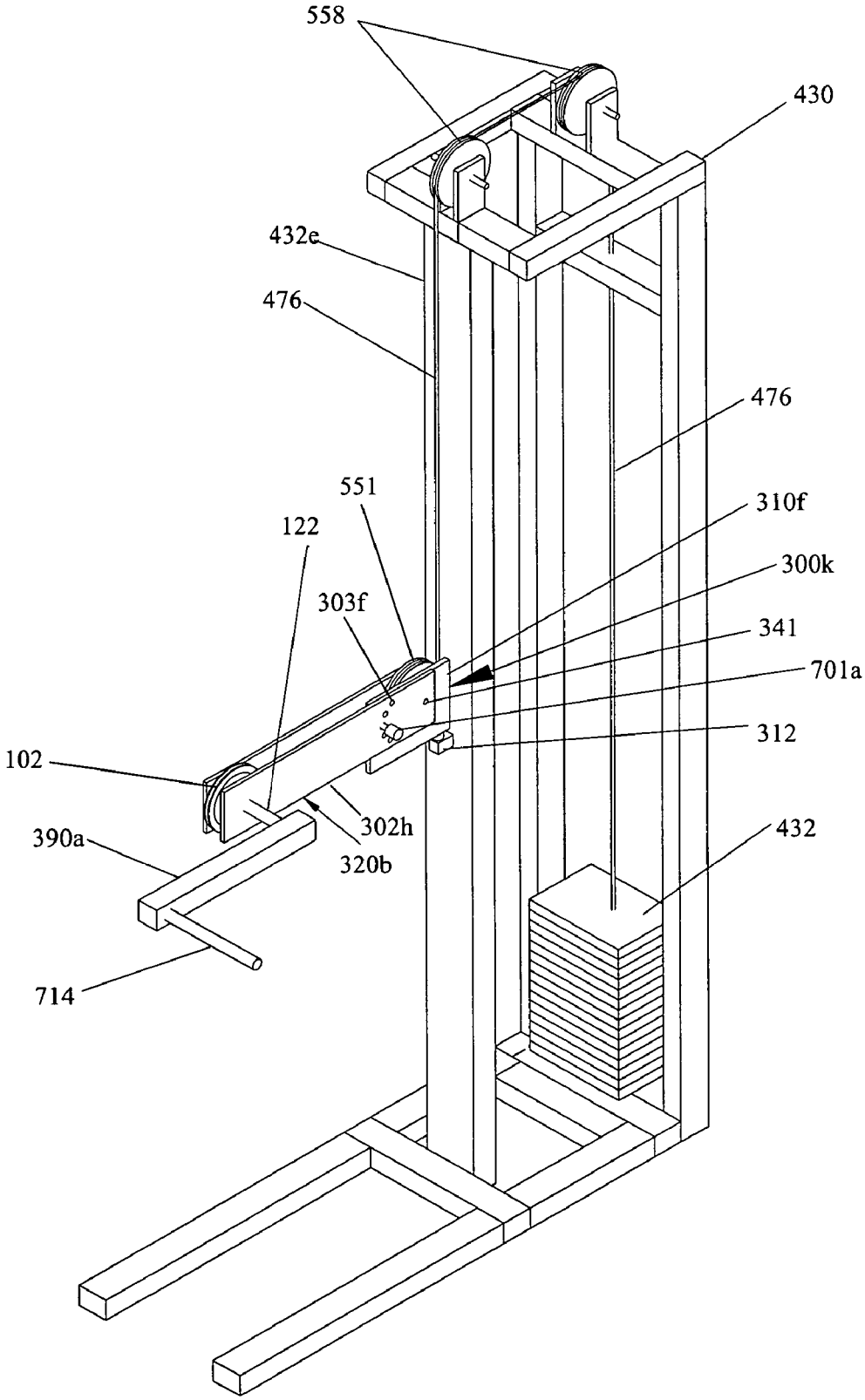

FIG. 15 shows a variation of the horizontal carriage pivoting mechanism shown in FIG. 1.

Figure 16:
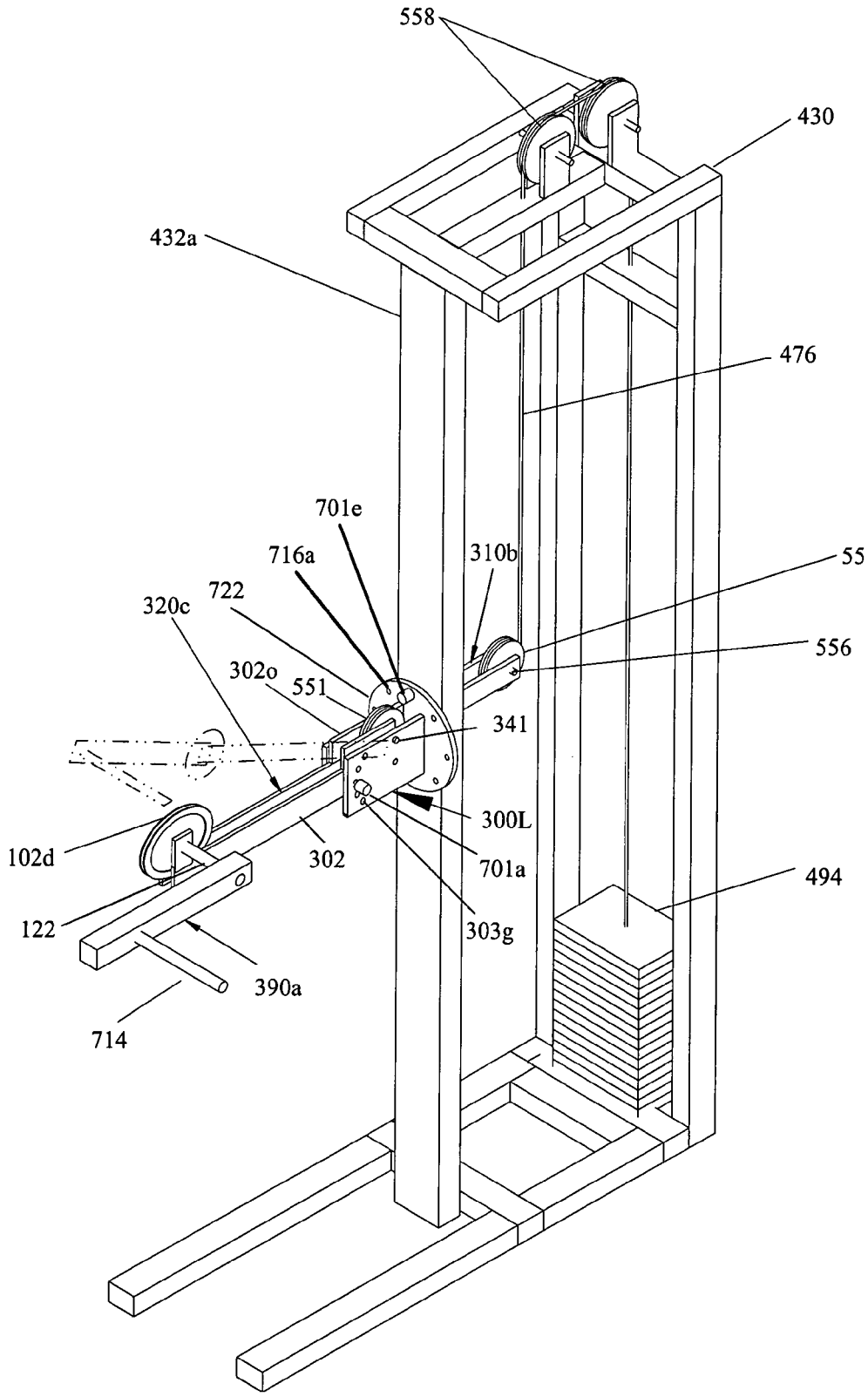

FIG. 16 shows another version of the apparatus, this version having a carriage with three sections.

Figure 17:
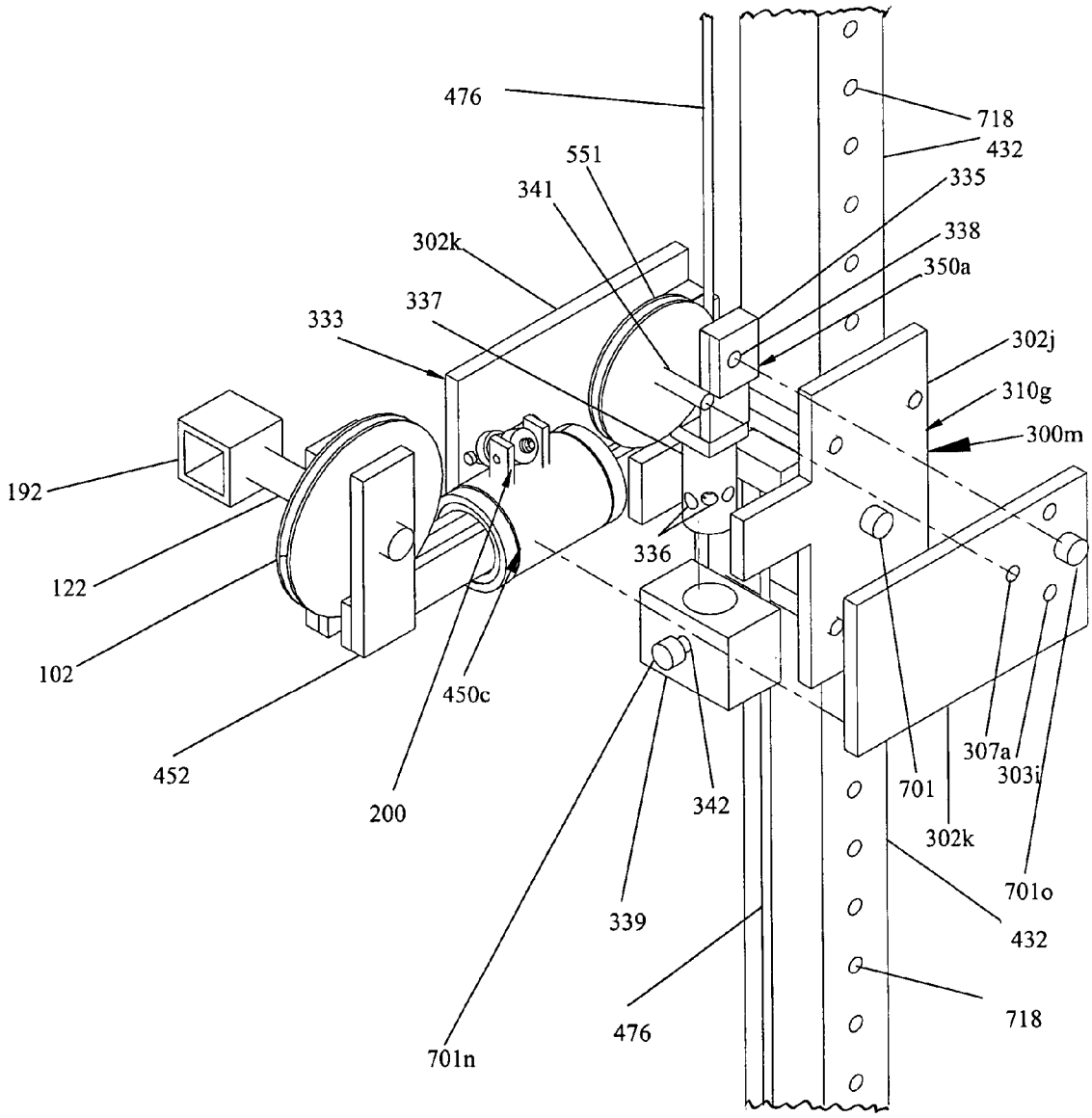

FIG. 17 shows a detail of a carriage in which the vertical and horizontal carriage pivot mechanisms are combined.

Figure 18:
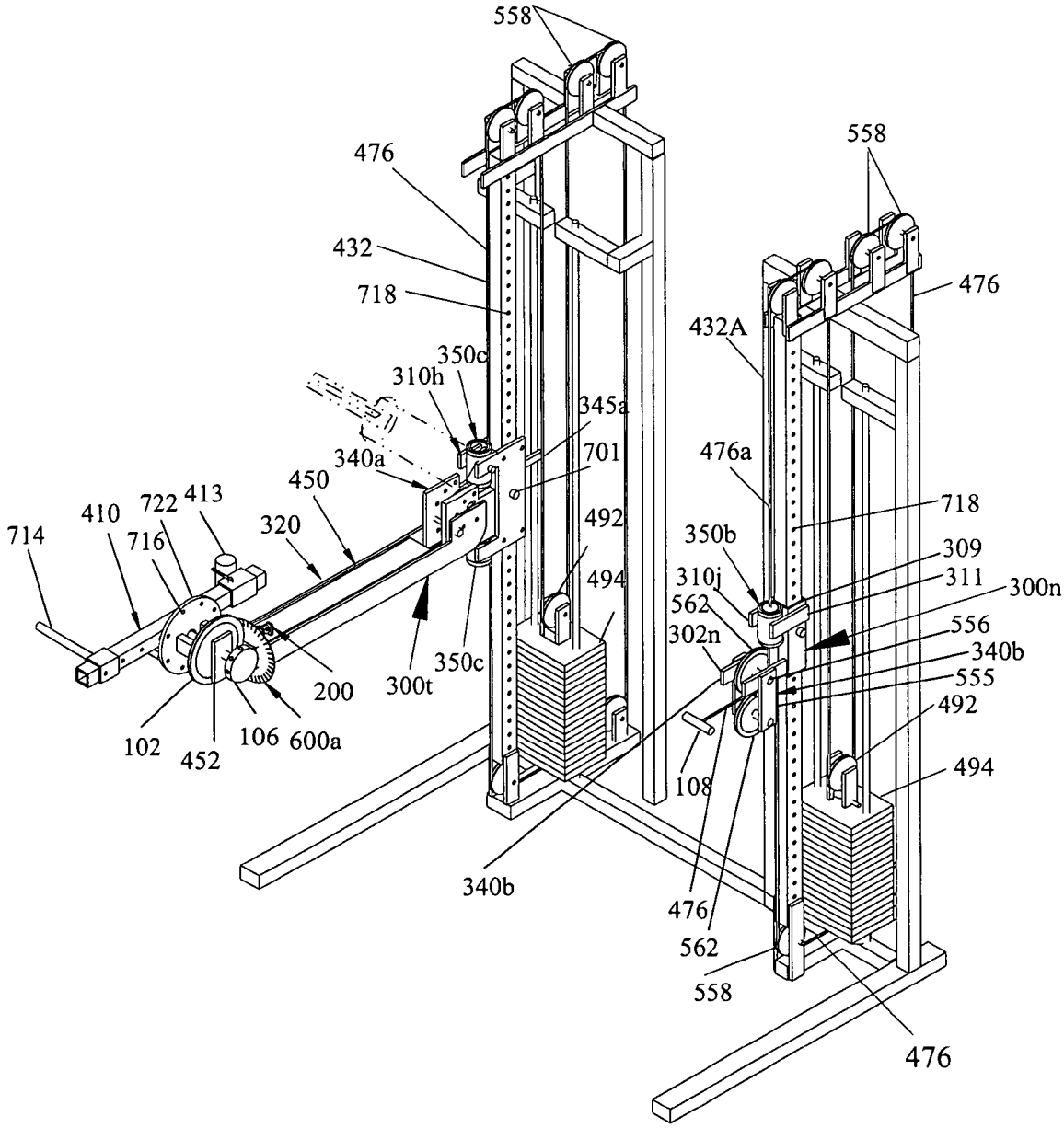
Figure 18A:
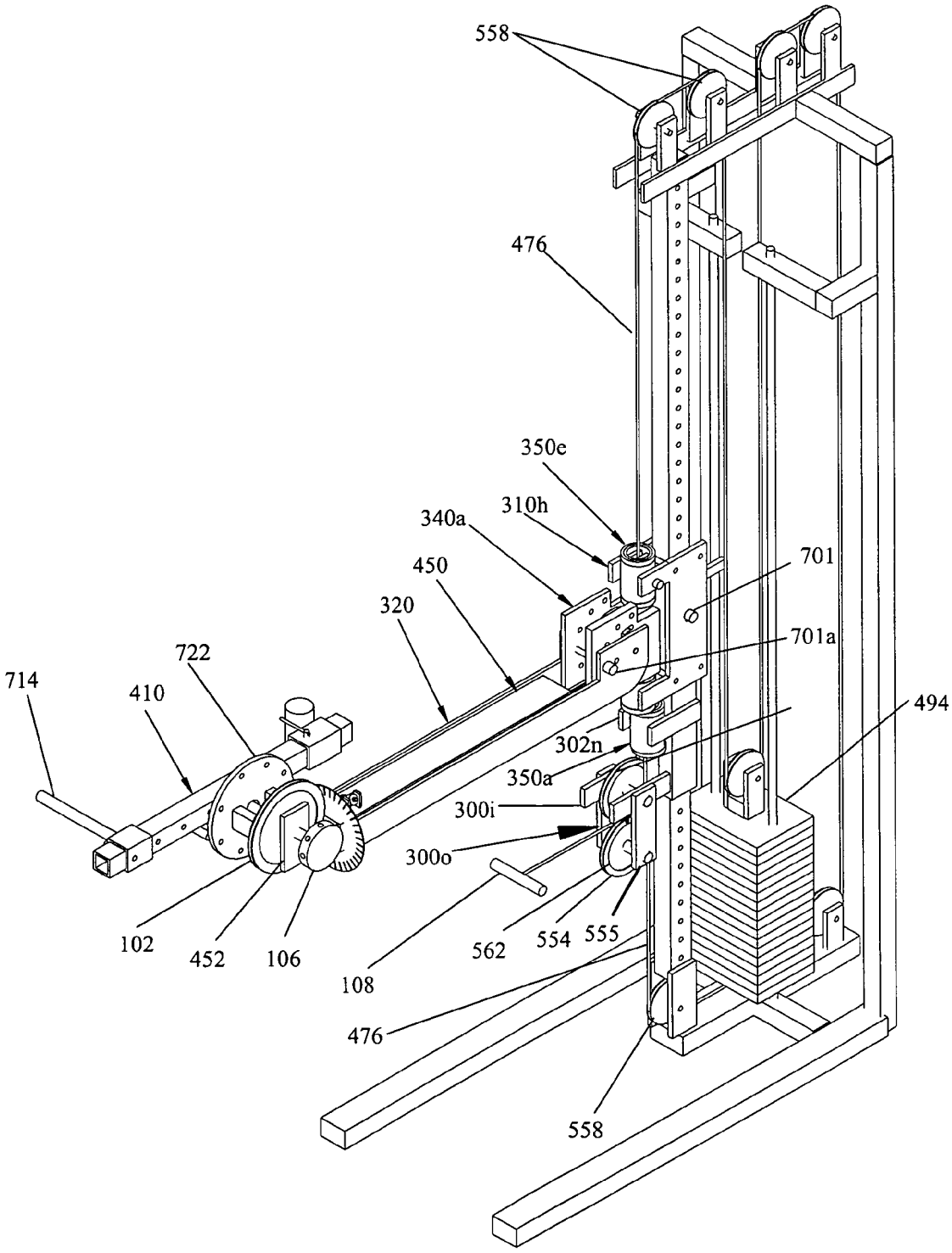

FIG. 18 another preferred version of the apparatus which is similar to the one in FIG. 1 but to which a second carriage adapted to support a set of pulleys configured in what those familiar with the exercise industry will recognize as a cable column mechanism has been added. FIG. 18A shows an apparatus similar in functionality to the one shown in FIG. 18 but with the added pulley set being attached to the underside of the carriage.

Figure 19:
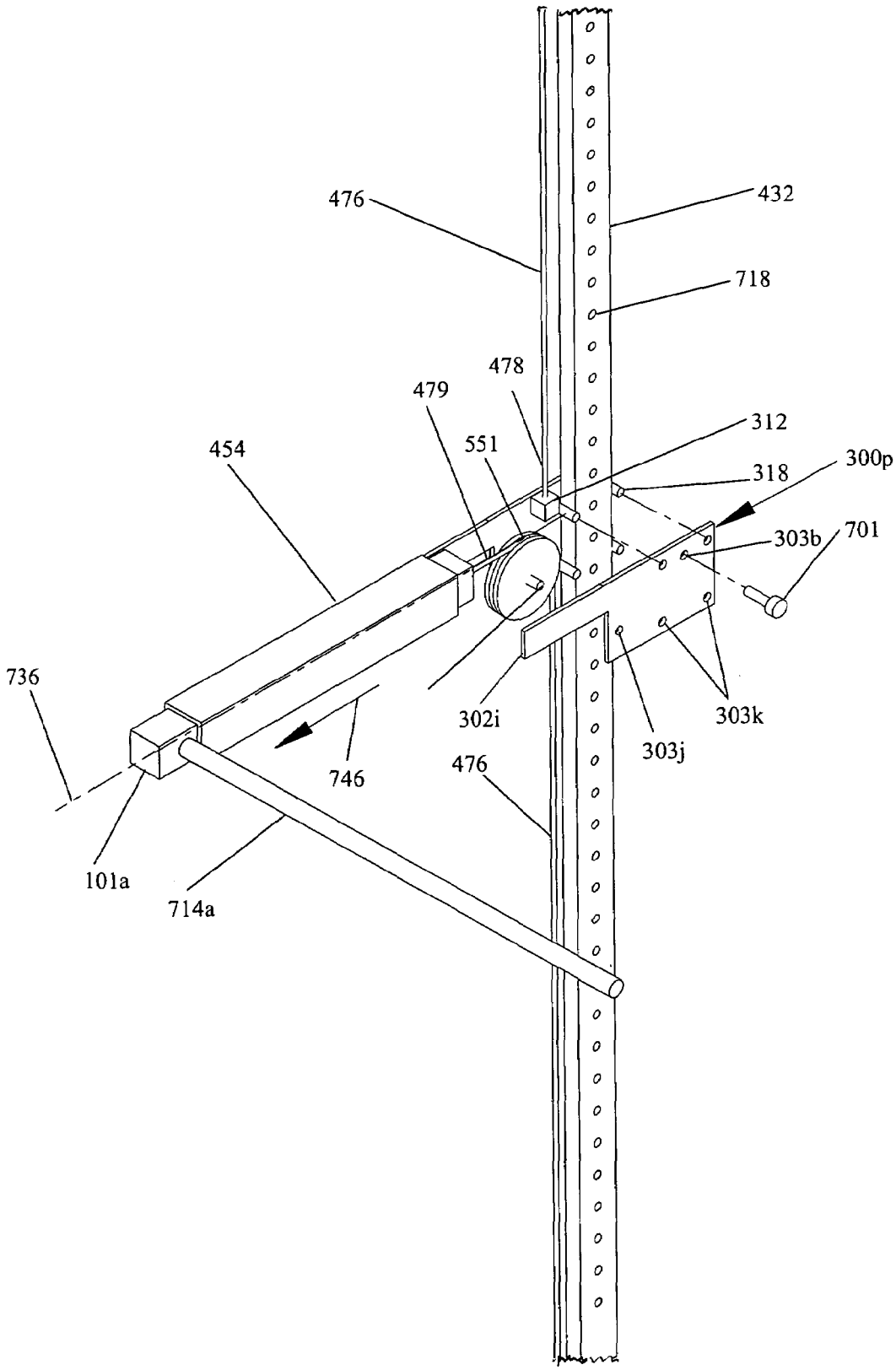

FIG. 19 shows a version of the apparatus with only a translating force transmitter mounted inside the carriage.

Figure 20:
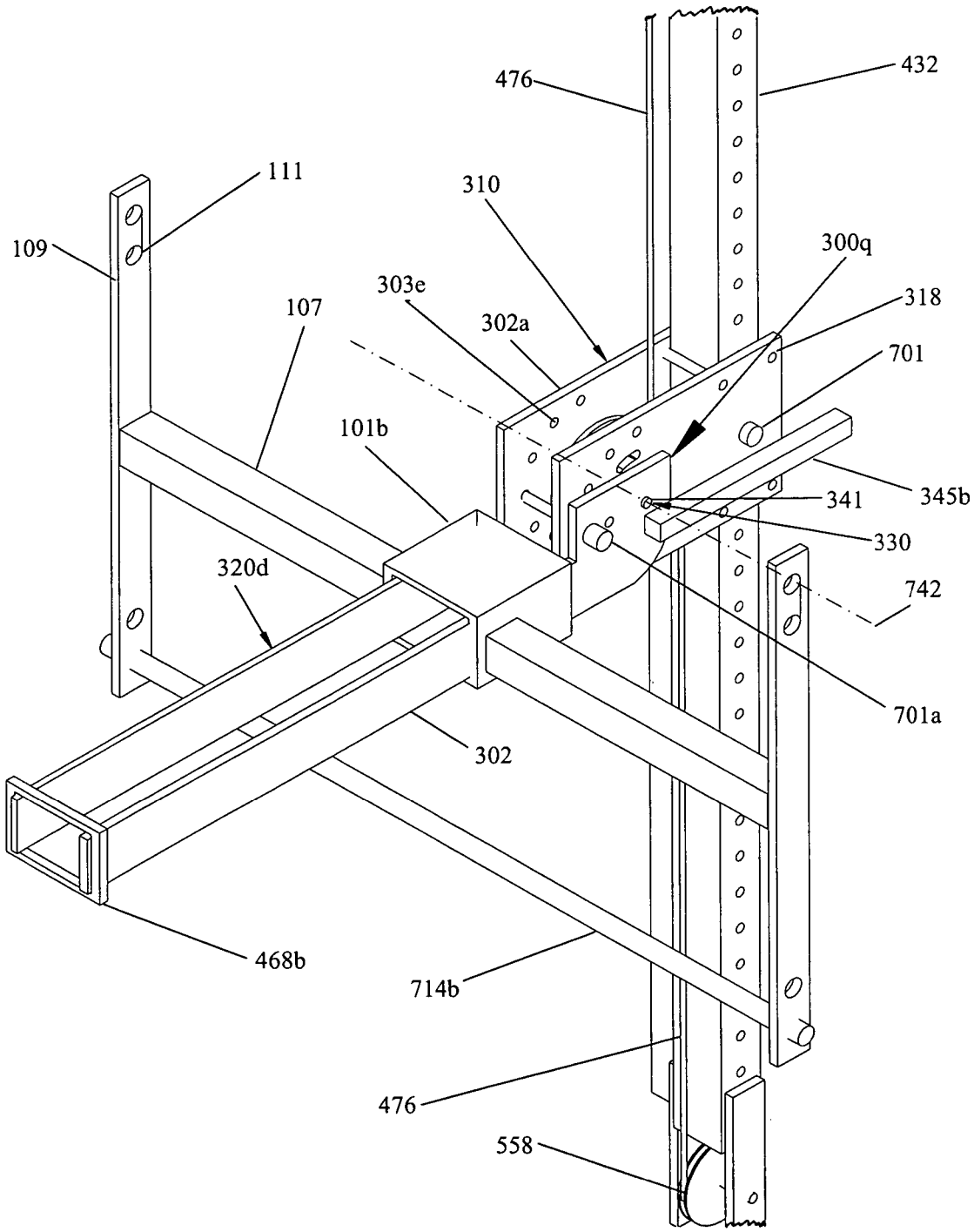

FIG. 20 shows an additional version of the apparatus with only a translating force transmitter, the transmitter mounted outside the carriage.

Figure 21:
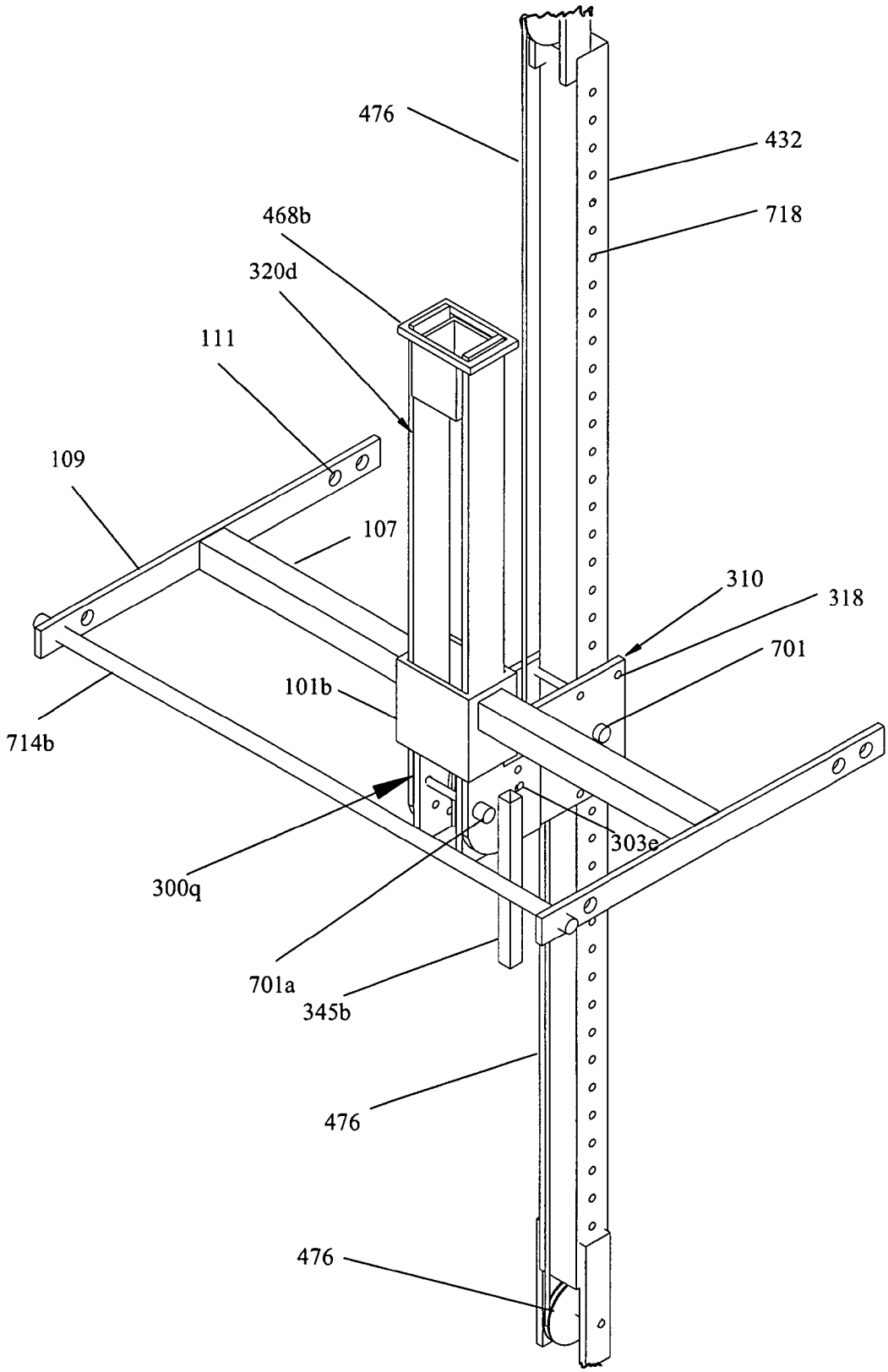

FIG. 21 shows the same apparatus as FIG. 20 but with the carriage tilted up on its horizontal axis at an angle of 90 degrees relative to the carriage shown in FIG. 20.

Figure 22:
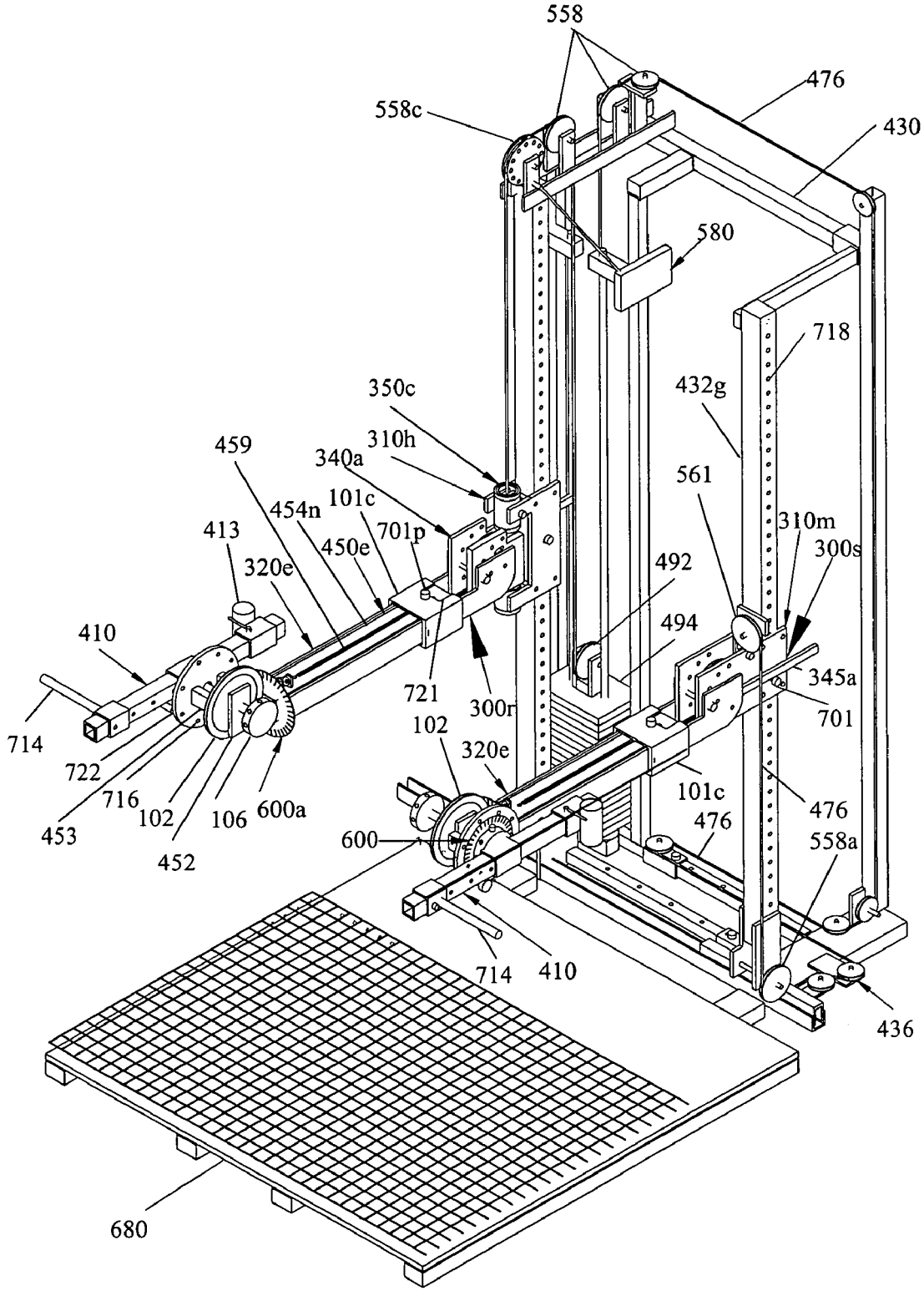

FIG. 22 shows a version of the apparatus similar to that shown in FIG. 1 but with two carriages that support both translating and spooling force transmitters.

Figure 23:
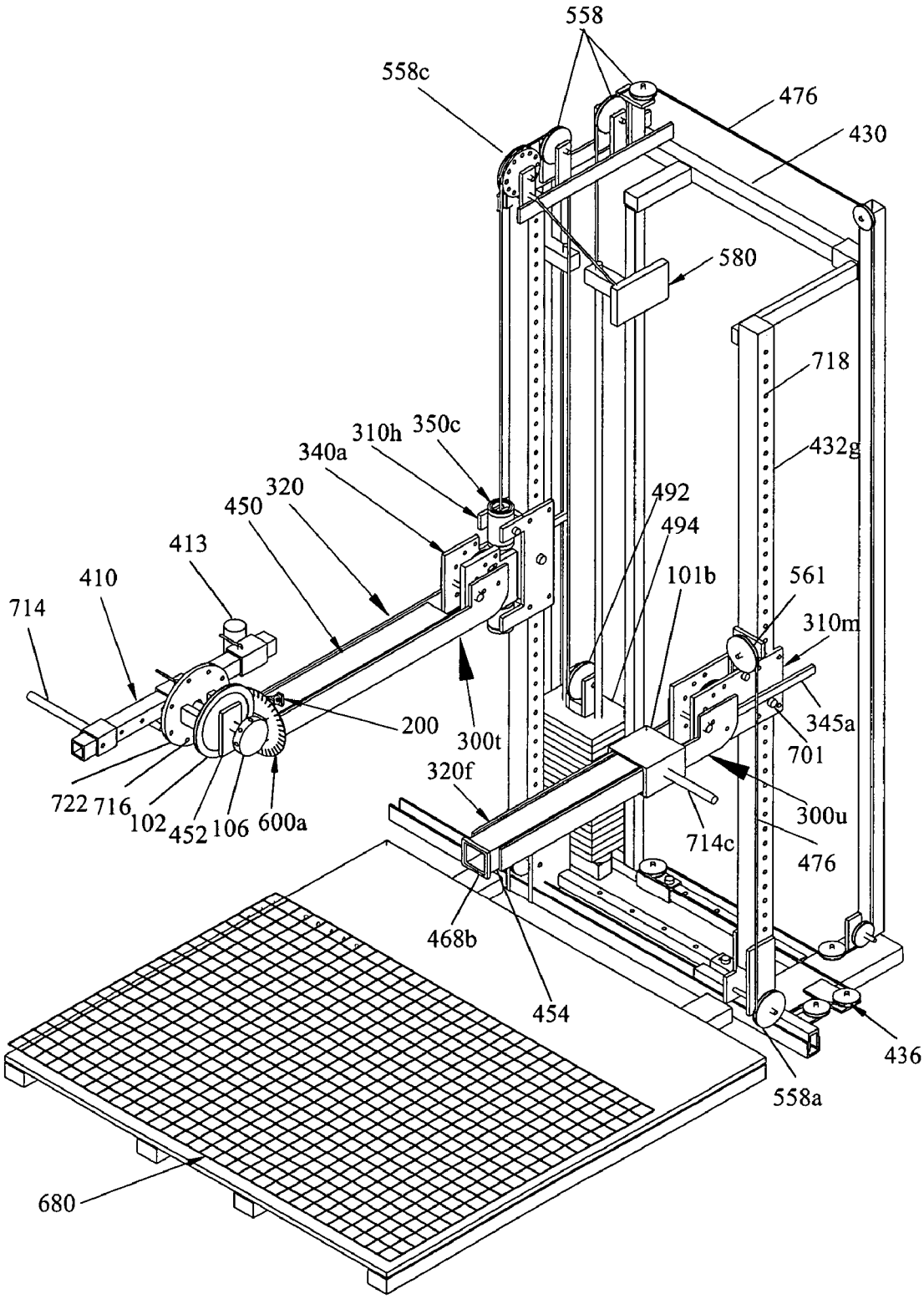

FIG. 23 shows another version of the apparatus similar to the apparatus in FIG. 22 but in which one carriage supports only a spooling force transmitter and the other carriage supports only a translating force transmitter.

Figure 24:
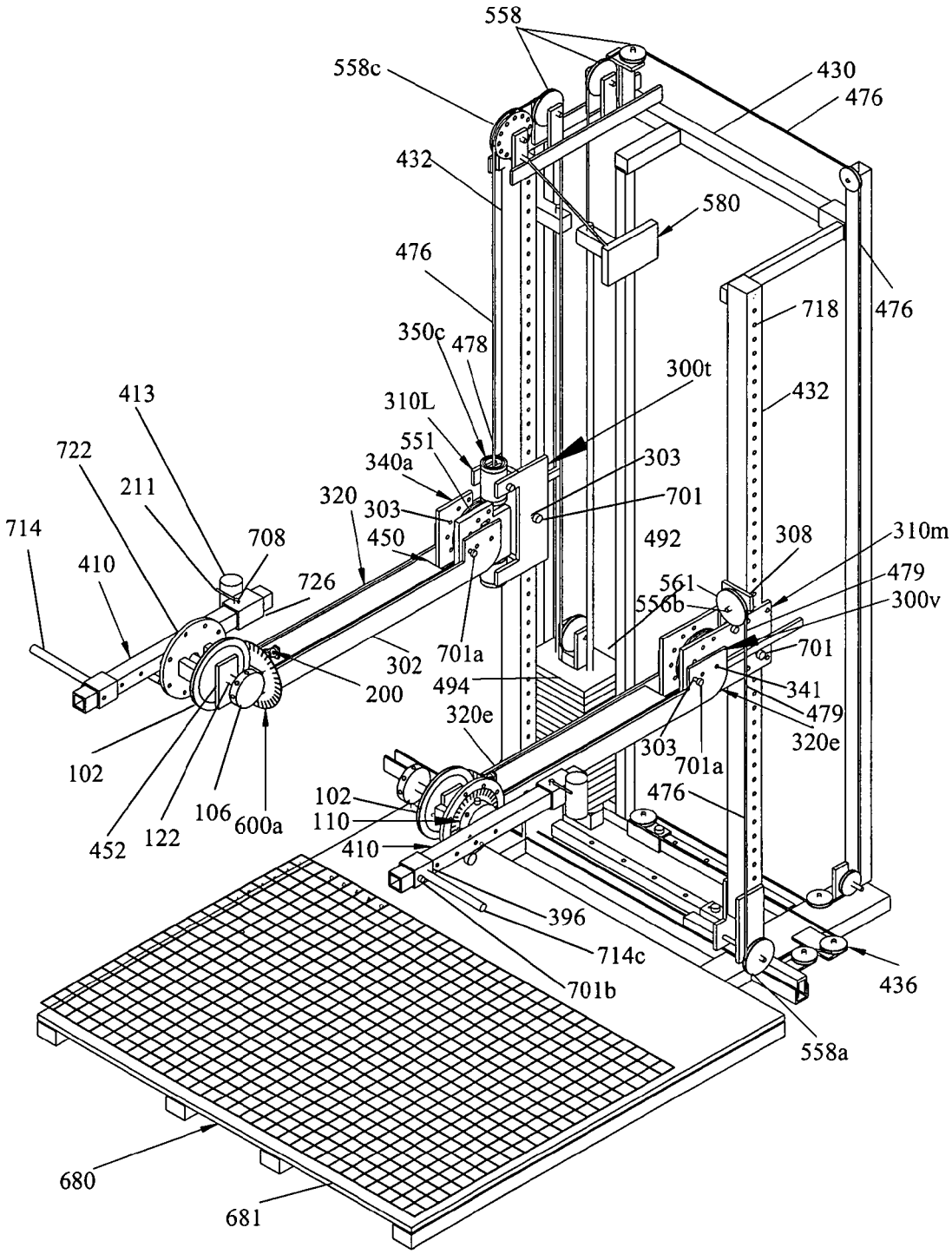

FIG. 24 shows a version of the apparatus similar to the one in FIG. 22 but with each carriage only supporting a spooling force transmitter.

Figure 25:
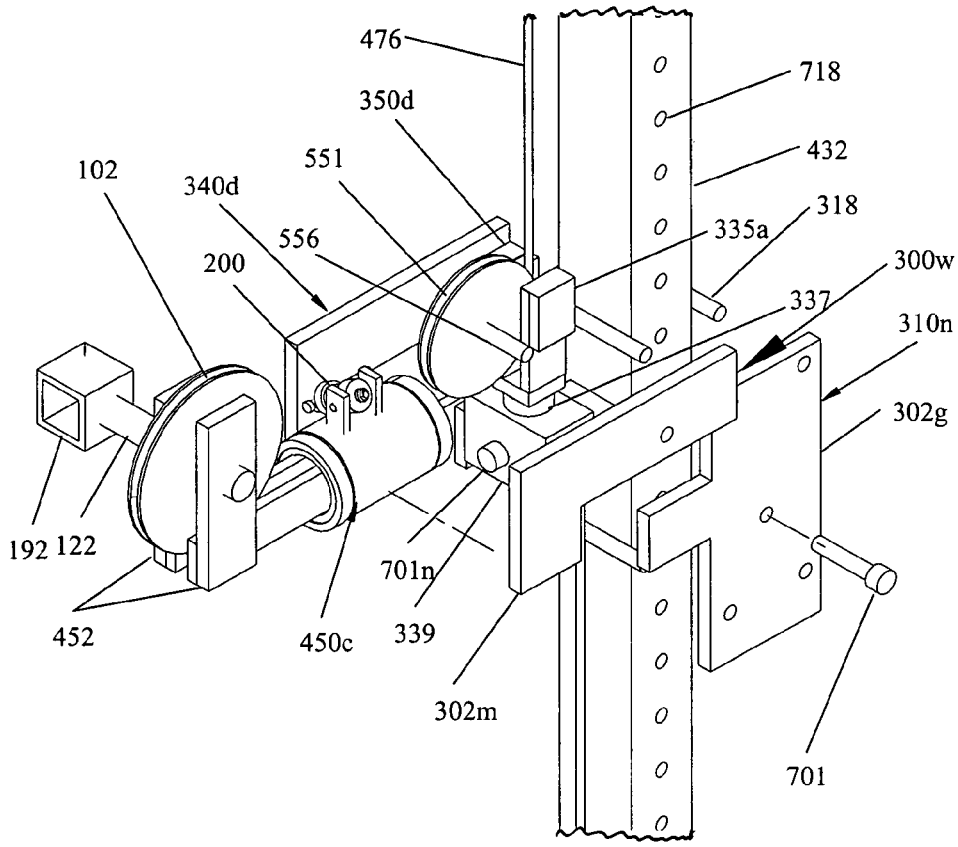

FIG. 25 shows an exploded view of another version of the vertical axis pivot mechanism but was introduced in FIG. 10.

Figure 2:
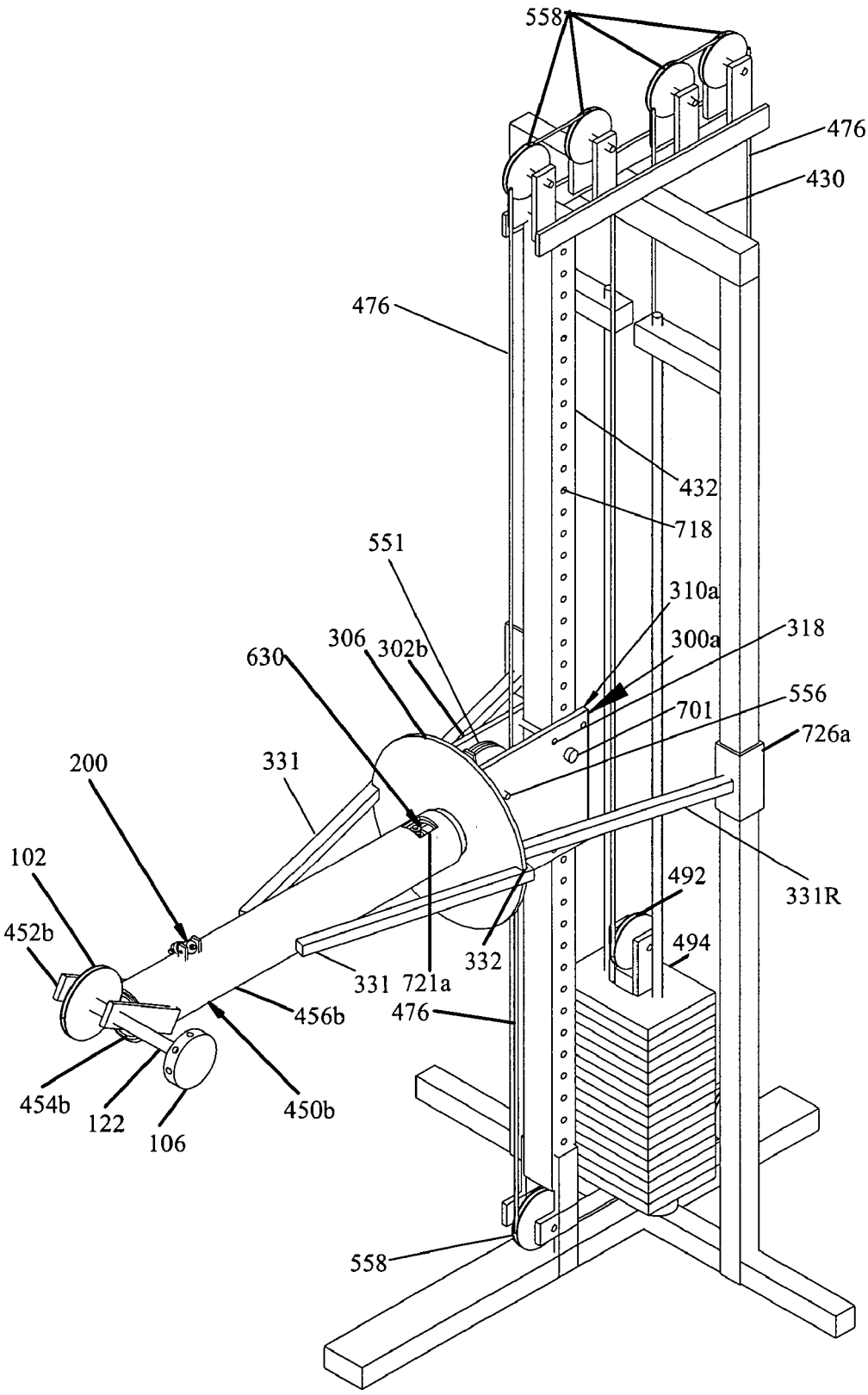
FIG. 2 shows another version of the apparatus with a rotating outside tube and the force transmitting spool supporting arms mounted on the outside of the rotating tube.
Figure 26:
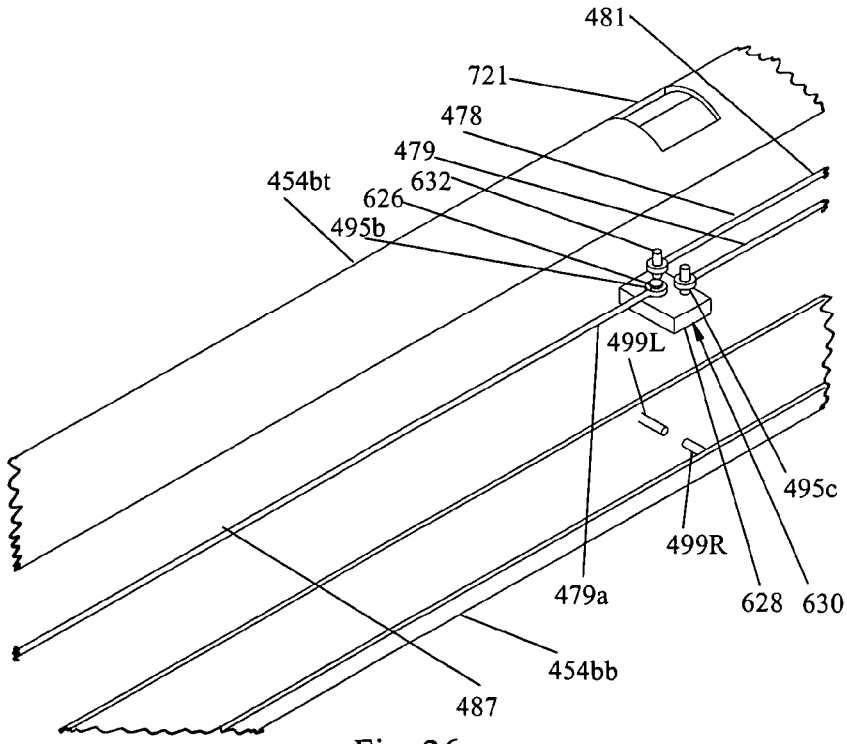

FIG. 26 shows the detail of the whiffletree mechanism that is employed but not visible in the version of the apparatus shown in FIG. 2.

Figure 27:
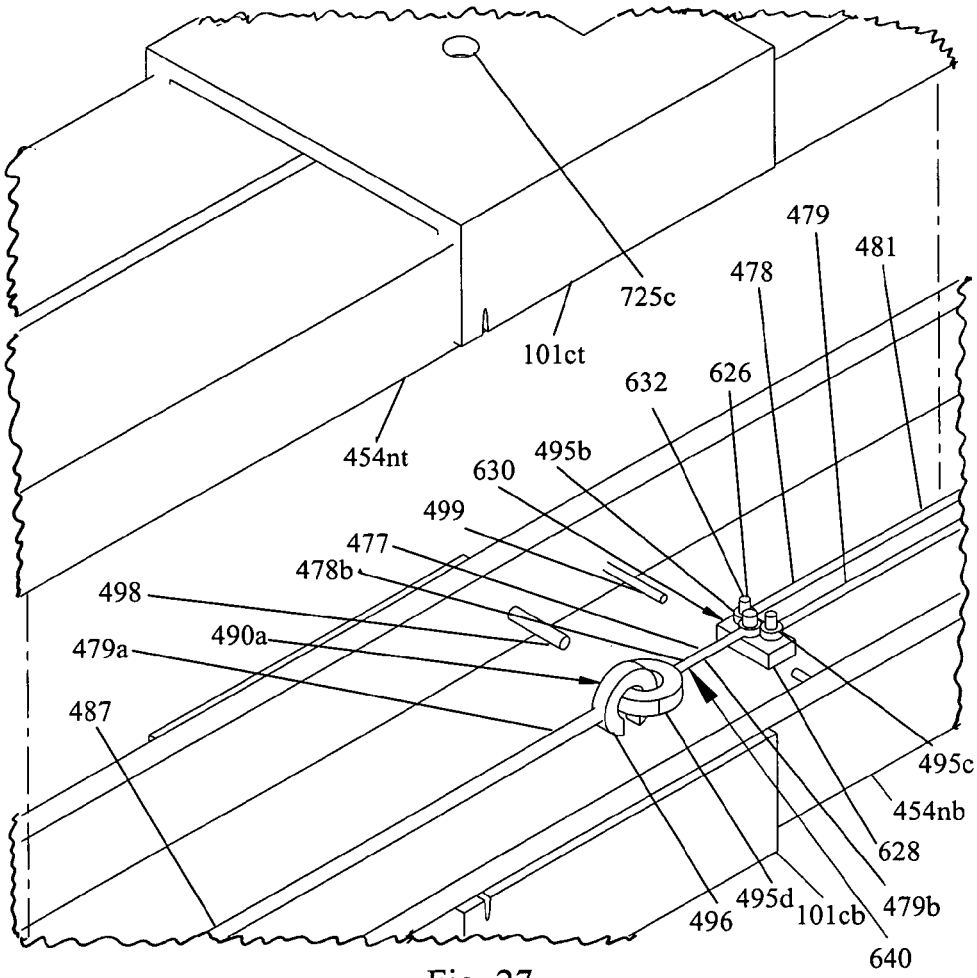
Figure 65:
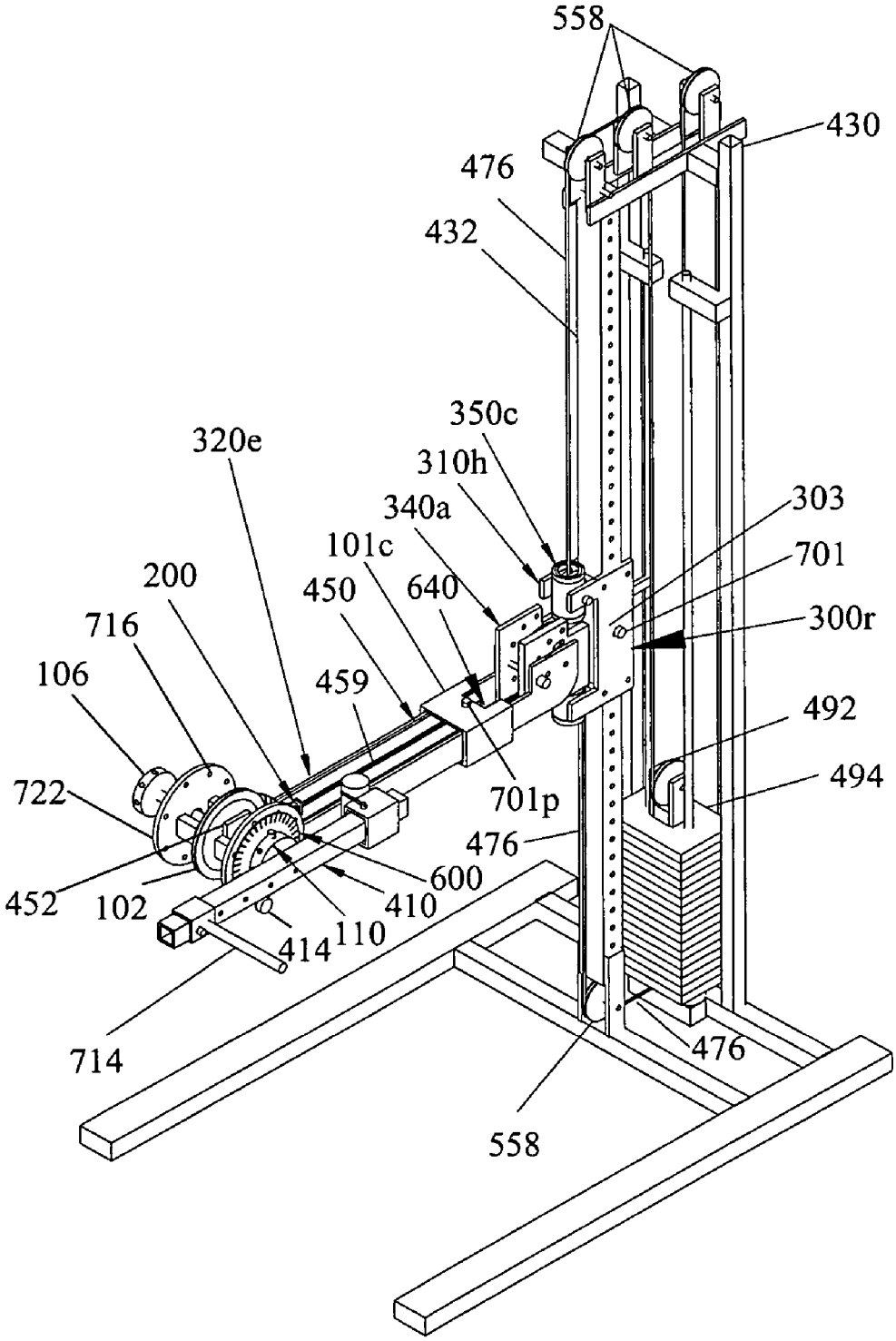

FIG. 27 shows the detail of a combined and whiffletree translating tube attachment mechanism that is employed but not visible in the apparatus in FIG. 65.

Figure 28:
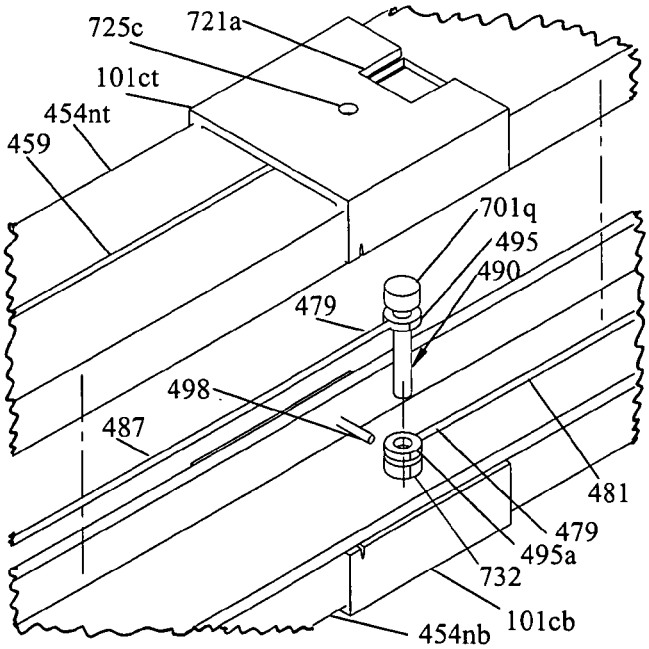

FIG. 28 shows the detail of the flexible connector and translator coupler that is used but not visible in FIG. 22.

FIGS. 29-32C show alternative approaches to the one shown in FIG. 1 that can be used to adjust the effective length of the rigid arm.

Figure 33:
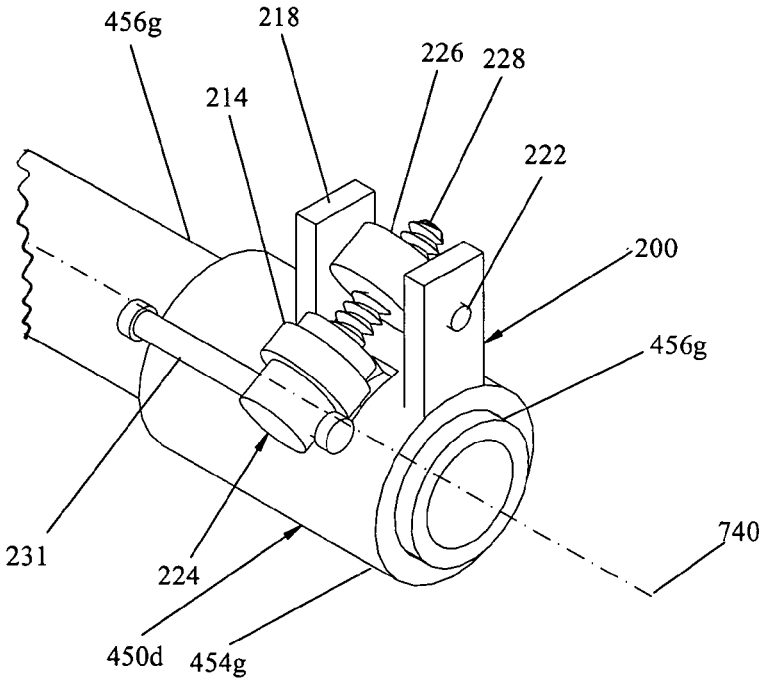
Figure 33A:
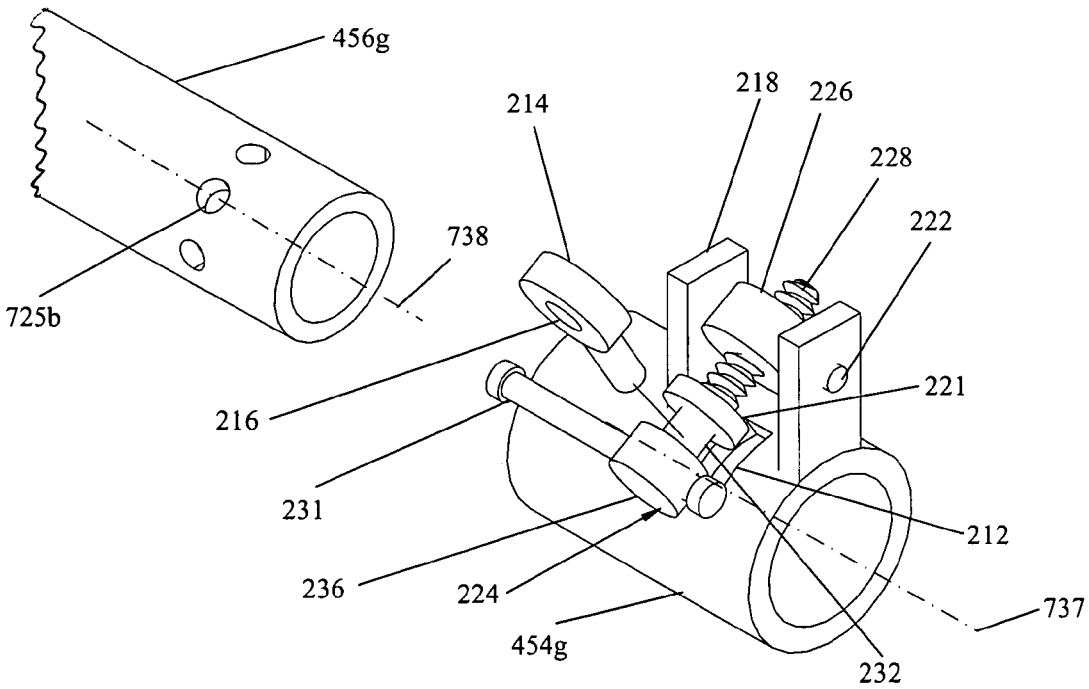

FIG. 33 shows the detail of the angle locking mechanism first presented in FIG. 1. FIG. 33A provides the detail of an exploded version of the mechanism shown in FIG. 33.

Figure 34:
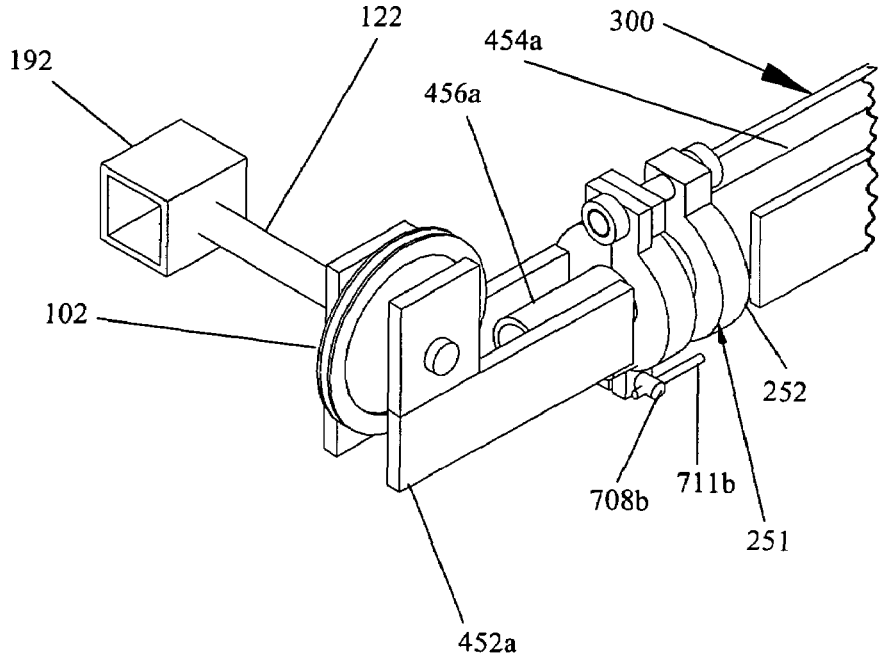

FIG. 34 shows a spool angle clamp that as an alternative to the angle adjustment mechanism shown in FIG. 1. FIG. 34 A shows an exploded detail of the clamp in FIG. 34.

Figure 35:
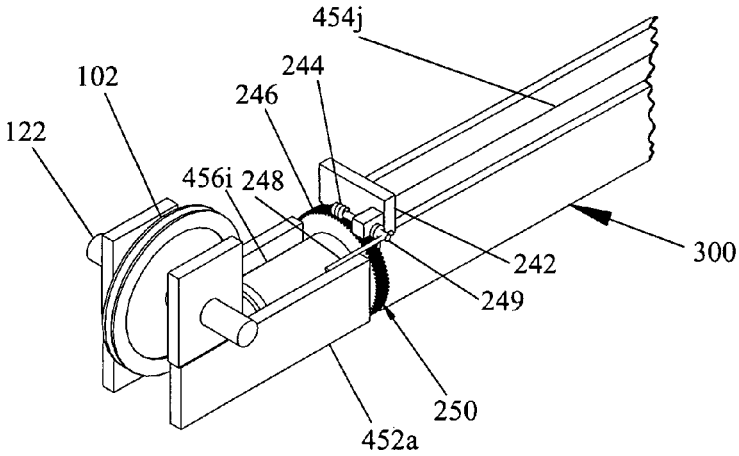
Figure 35A:
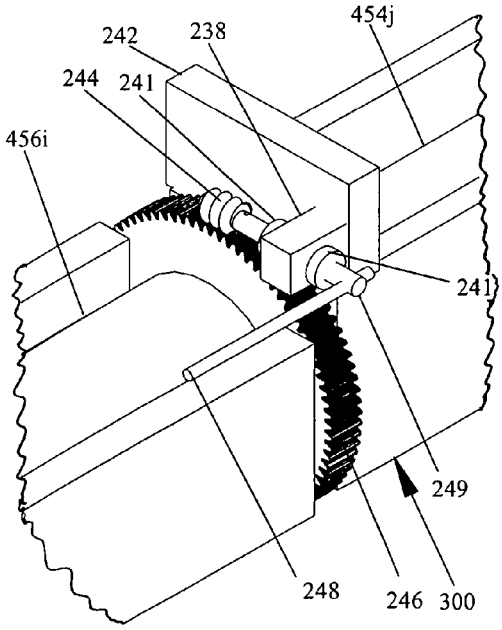

FIG. 35 shows a worm gear angle locking mechanism while FIG. 35A shows further detail of that mechanism.

Figure 36:
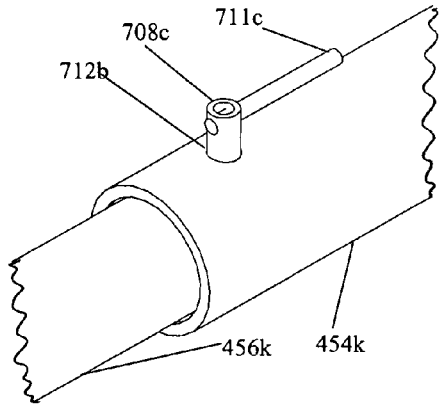

FIG. 36 shows a simple angle locking mechanism with a threaded hole in the outer tube and a screw that is tightened against the inner tube.

Figure 37:
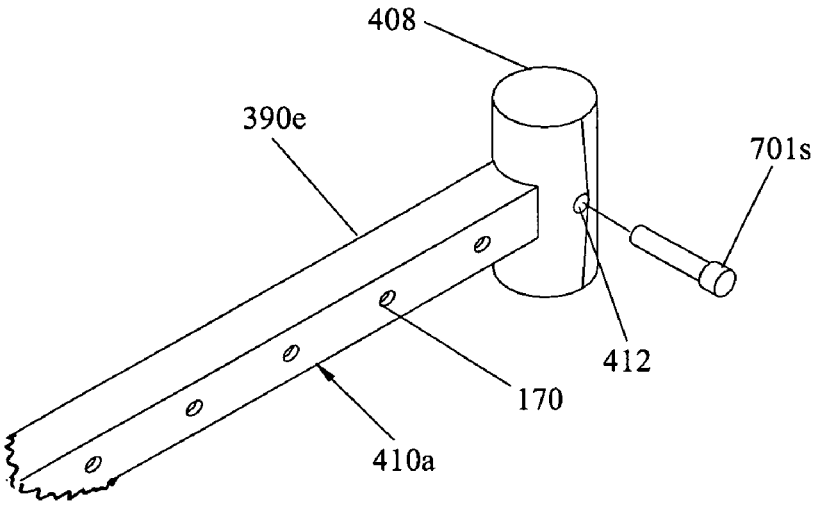
Figure 37A:
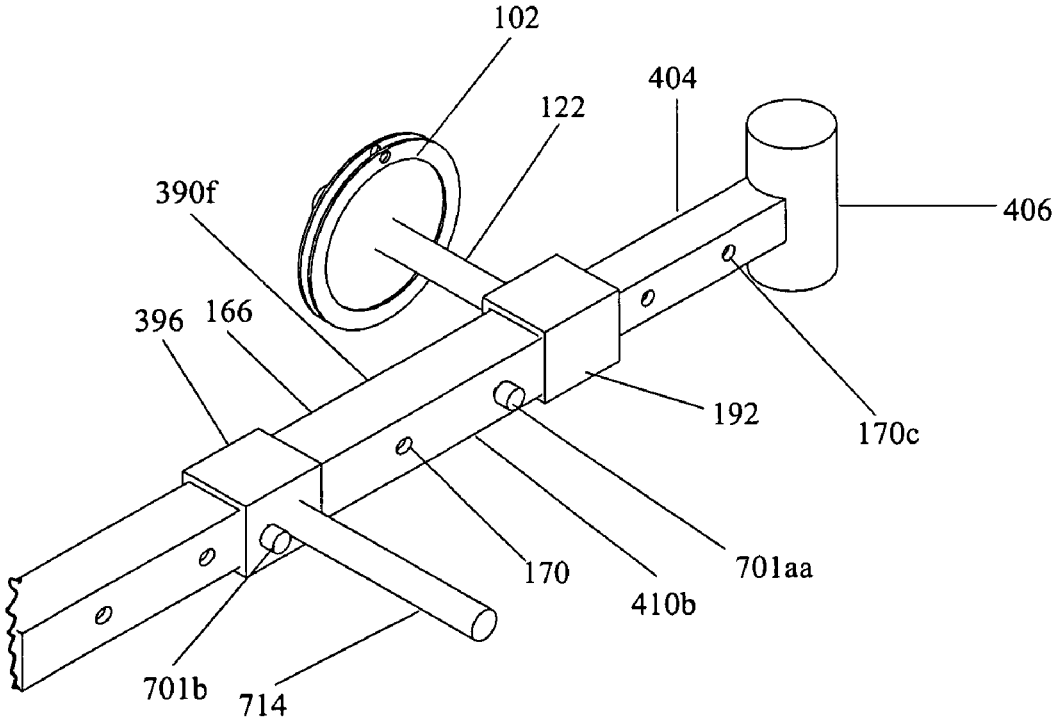

FIG. 37 shows an alternative to the counterweighted rigid arm shown in FIG. 1 FIG. 37A shows an additional alternative version of the counterweight mechanism.

FIGS. 38-41, 42 A-B and 43-46 show a series of mechanisms for coupling and decoupling the rigid arm and spool shaft.

Figure 47:
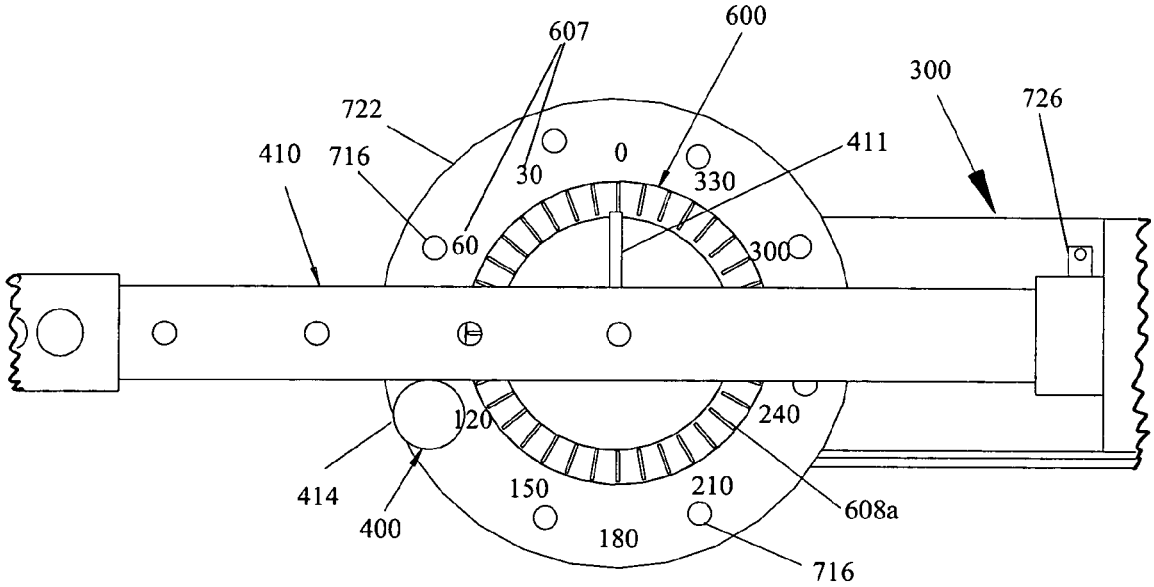
Figure 47A:
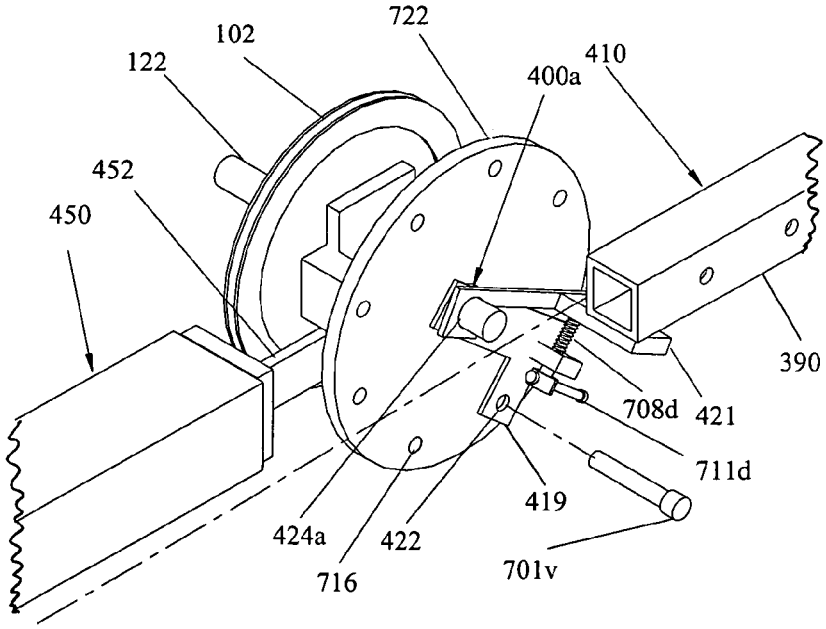

FIG. 47 shows right side view detail of the angle measurement mechanism and the reverse motion brake shown in FIG. 1. FIG. 47A shows an alternative to the structure shown in FIG. 47 with brake that includes a more precise start angle adjustment mechanism.

Figure 48:
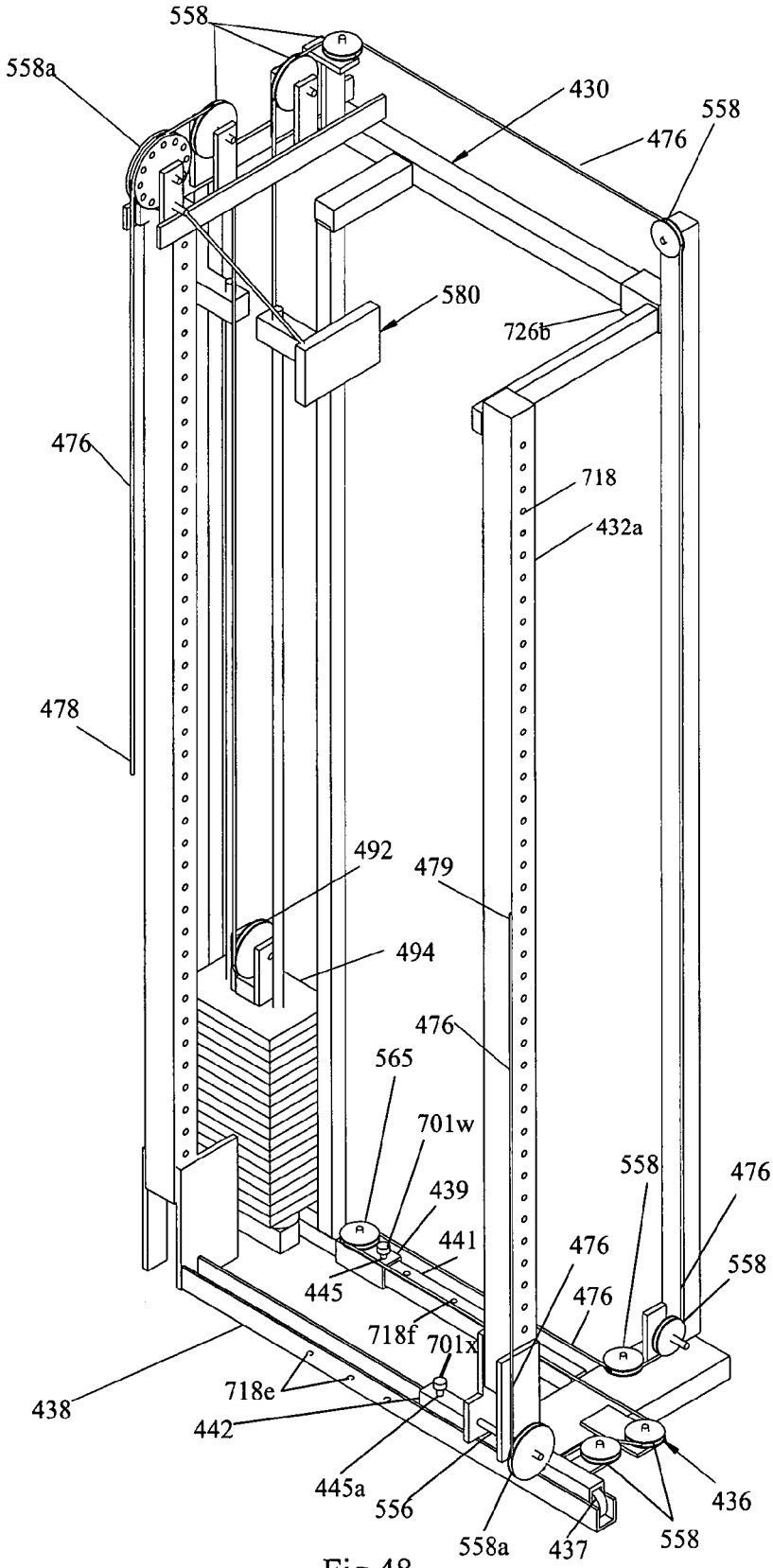

FIG. 48 shows the detail of the mechanism that permits one carriage to vary its distance from the other, first shown in FIG. 22 (a width adjustment mechanism).

Figure 49:
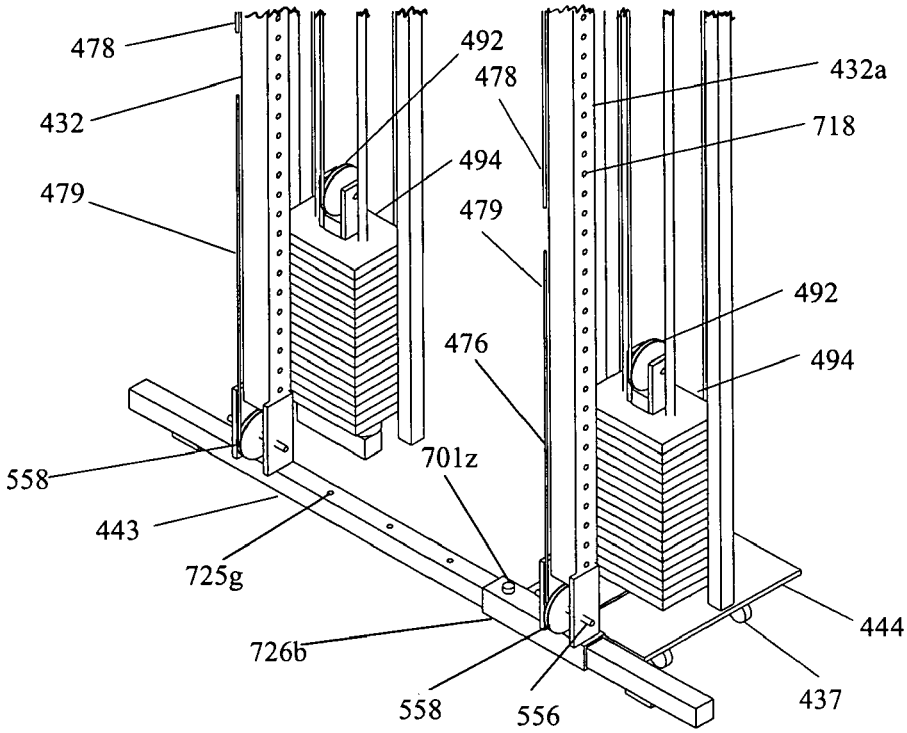

FIG. 49 shows another version of the width adjustment, mechanism.

Figure 50:
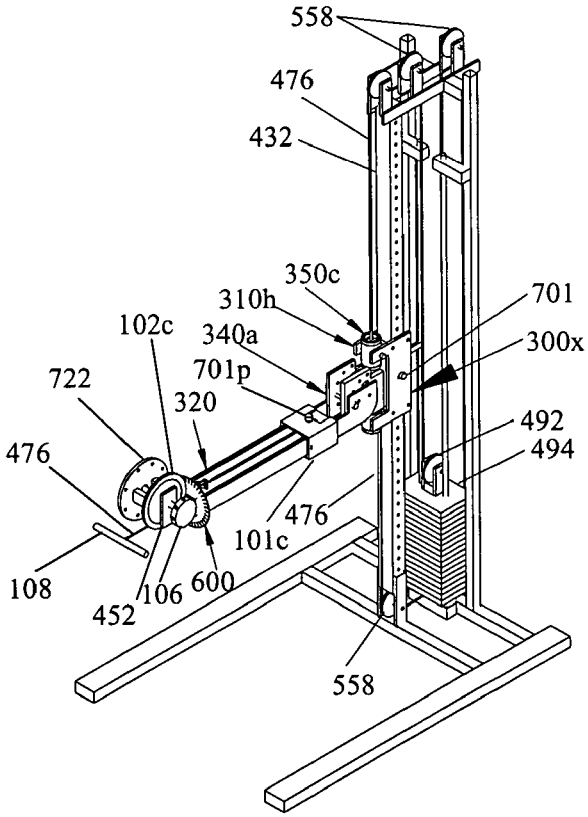

FIG. 50 shows a alternative version of the apparatus shown in FIG. 1 with a flexible connector coupler added so that the apparatus employed as a pulley system in addition to a spooling system.

Figure 51:
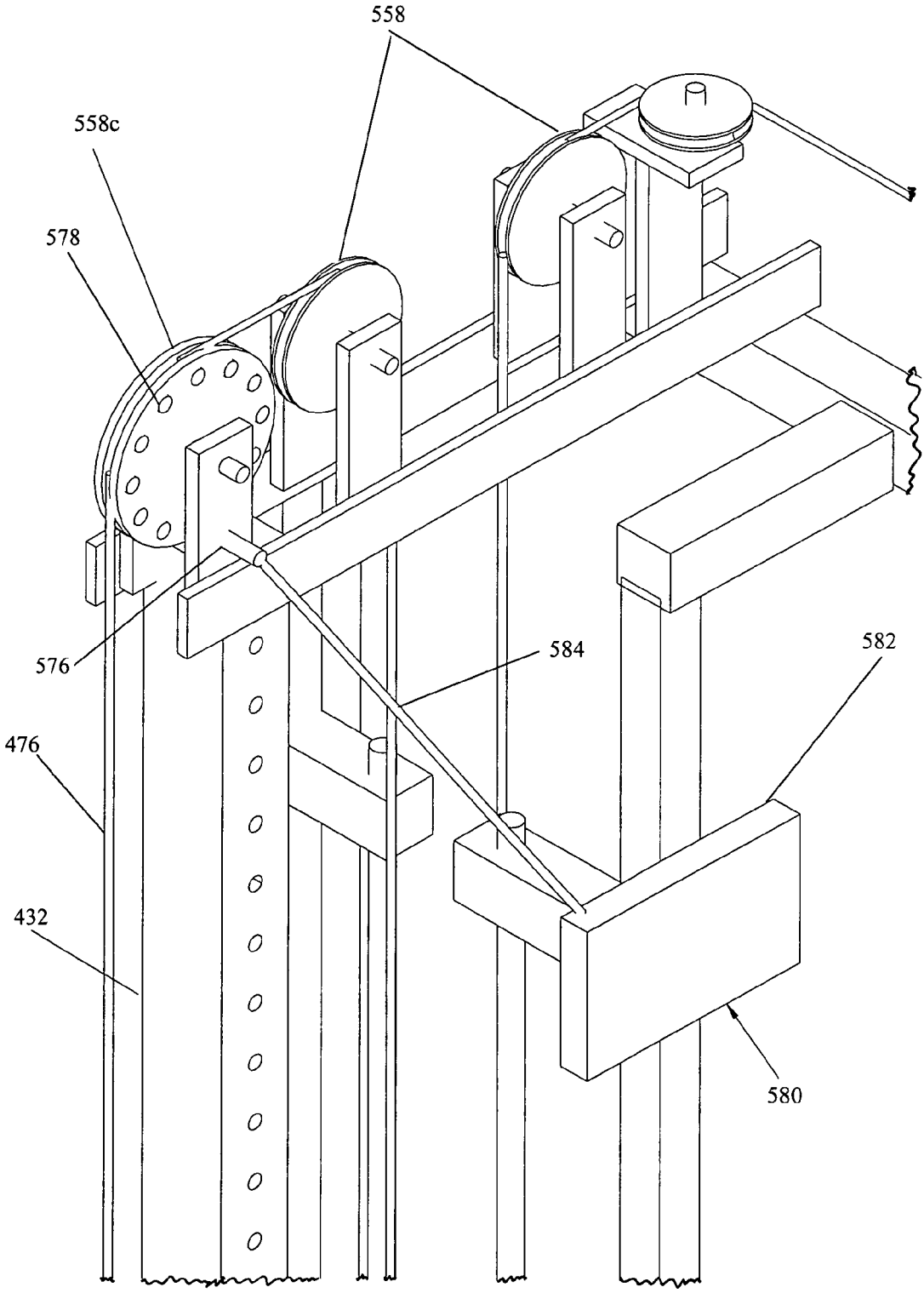

FIG. 51 shows a detail of the speed measurement mechanism of FIG. 22.

Figure 52:
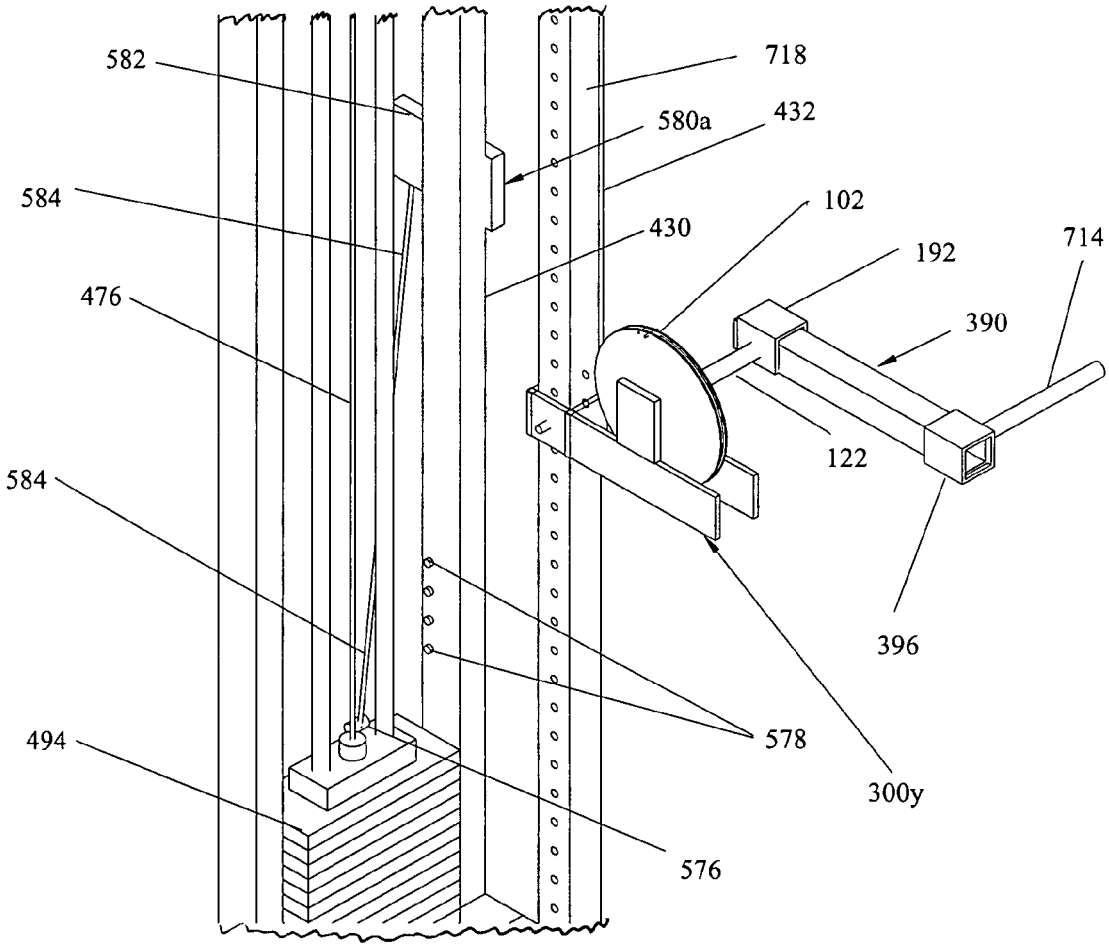
Figure 53:
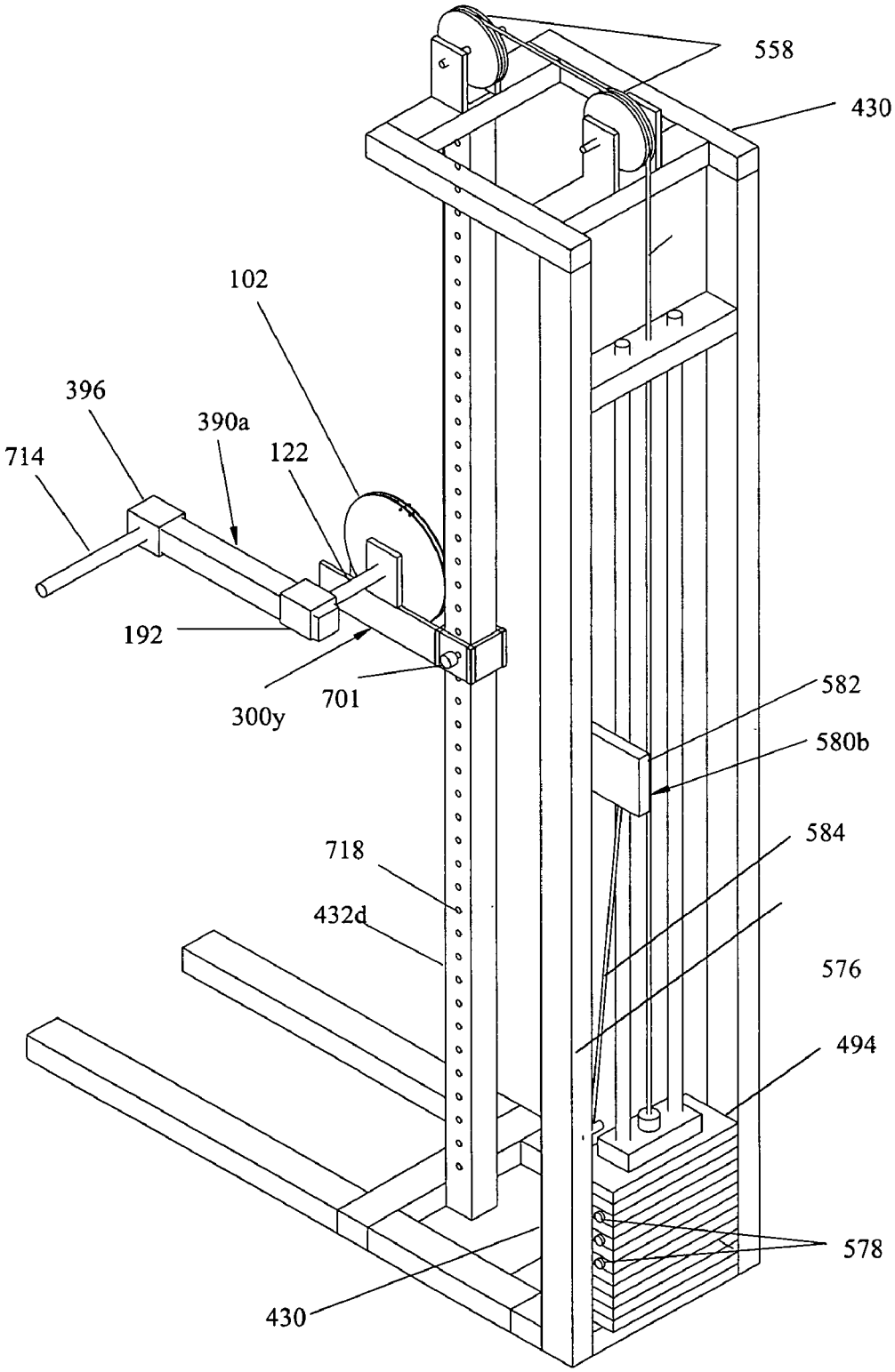
Figure 54:
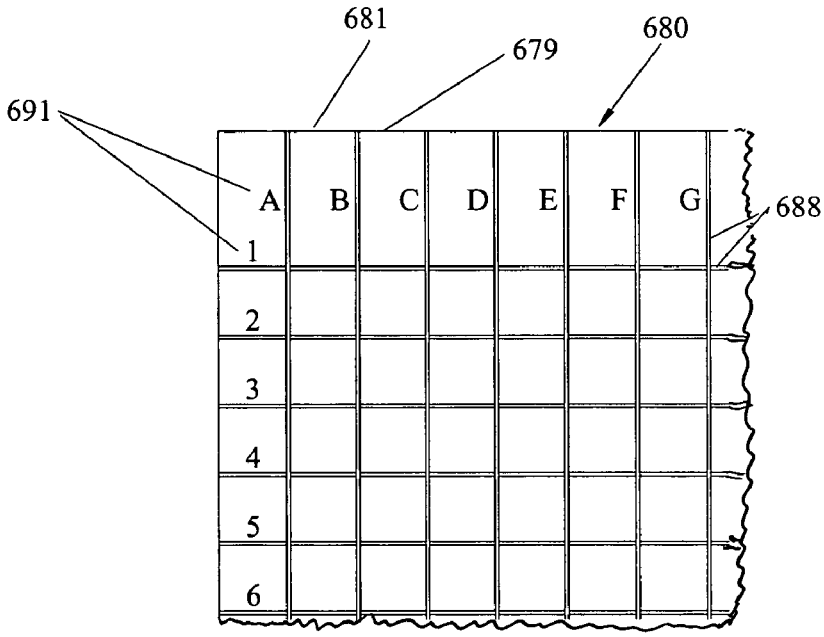

FIGS. 52 and 53 show alternative versions of the speed measurement mechanism introduced in FIG. 22 FIG. 54 shows a detail of the locational indicator of the apparatus in FIG. 22.

Figure 55:
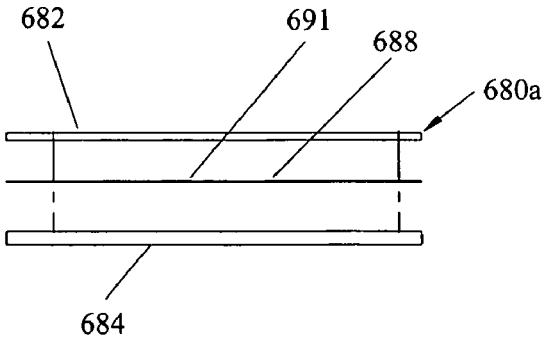
Figure 56:
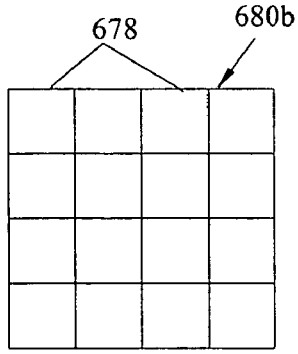

FIGS. 55 and 56 show alternative locational indicators.

FIG. 57 through 60 show various views and details of mechanisms for coupling and decoupling the spool from the flexible connector so that the spool can be used as a pulley.

Figure 61:
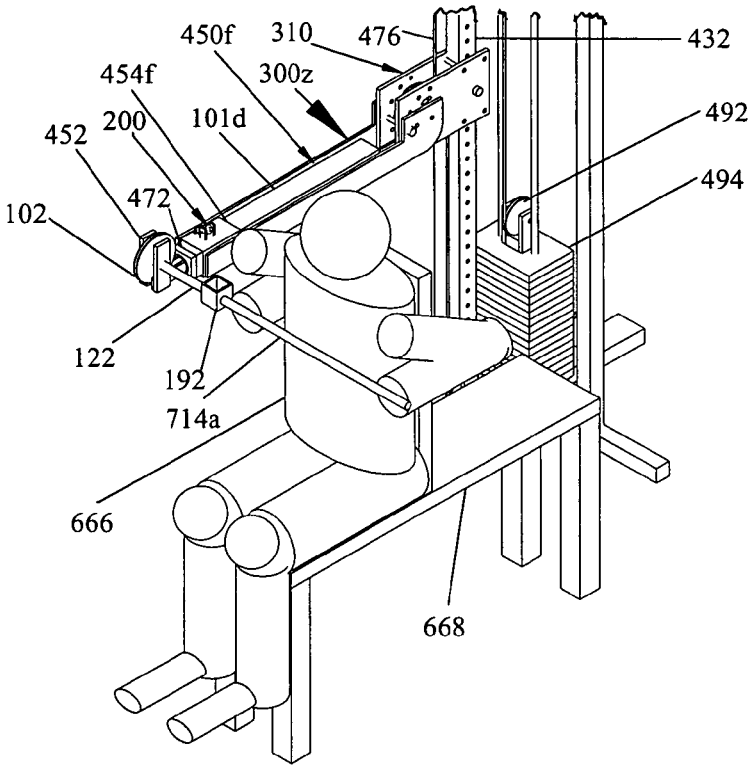
Figure 62:
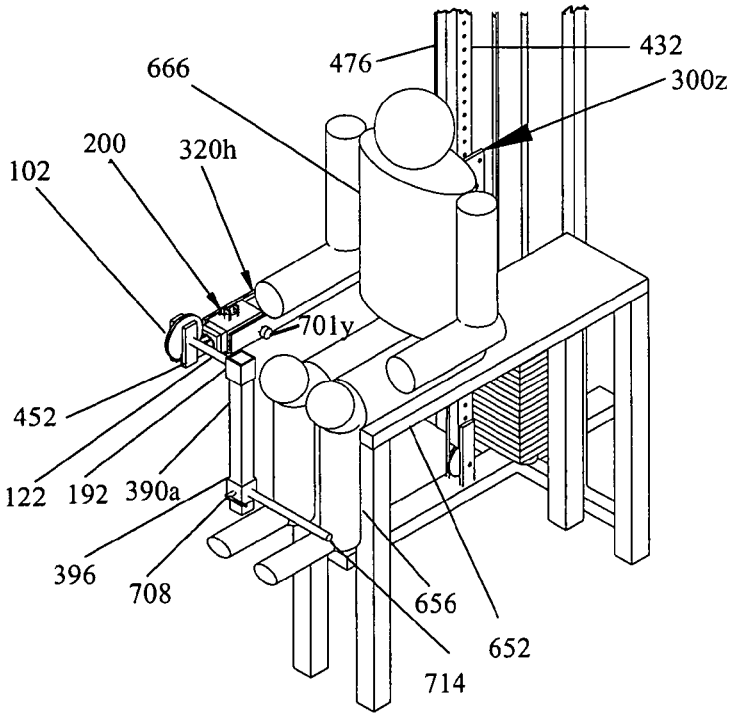

FIGS. 61 and 62 show how the addition of various exercise benches can be used in conjunction with the apparatus, increasing the number of available exercise options.

Figure 63:
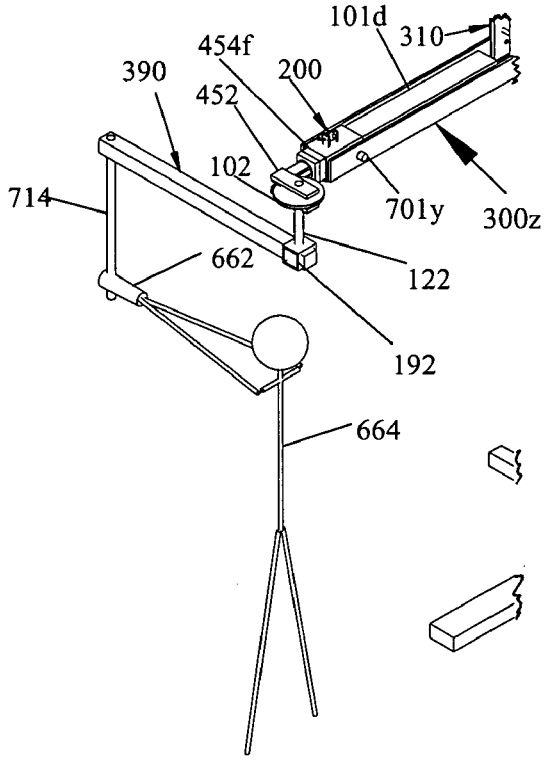

FIG. 63 shows a stick figure of a user simulating a swing with a baseball or softball bat by connecting a bat handle-shaped implement to the rigid arm.

Figure 64:
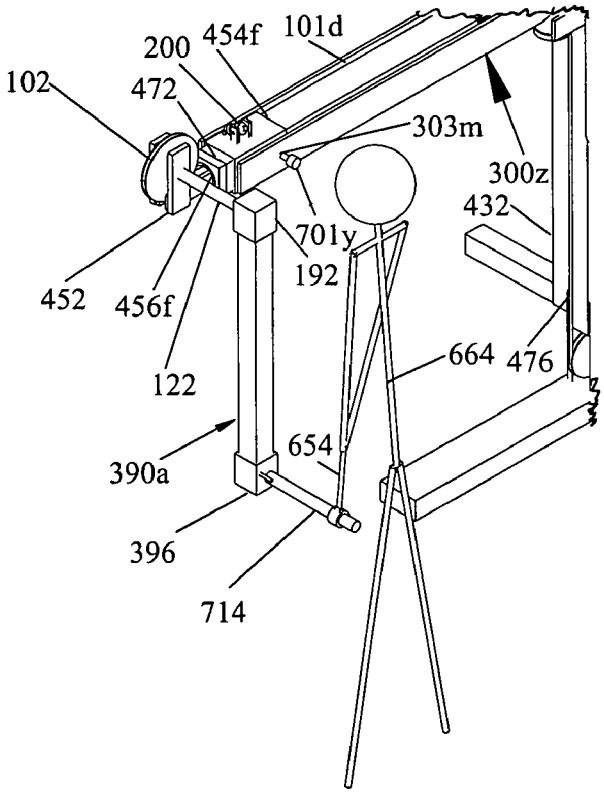

FIG. 64 shows a similar stick figure simulating a golf swing with a different shaped implement attached to the rigid arm when it is set in a different position.

FIG. 65 shows a preferred embodiment of the apparatus similar to the one shown in FIG. 1 but with the carriage supporting both a spooling and a translating force transmitter.

DRAWINGS

Reference Numerals

101-101*e* translating force transmitter
101*ct* top of translating force transmitter
101*ct* bottom of translating force transmitter
102-102*d* spooling force transmitter
106 curved shaft end
107 bar support rail
108 user handle
109 bar support connector
110 rigid arm coupler
111 hole in bar support connector
112 spool rim hole
113 non-adjustable decoupler
114 deep recess
116 spool wall hole
117 slot in sleeve
118 end ring
119 spring loaded ball
120-120*a* flexible connector coupler
121 end ring locking pin
122 spool shaft
126 spool rim
128 retaining sleeve head
129 retaining sleeve
131 end cylinder
142 spool wall
165 curved receptacle
166 curved receptacle base
167-167*a* hole parallel to spool shaft
170-170*c* hole in rigid arm
171 hole perpendicular to spool shaft
182 curved and flat end
184 gear on shaft
185 gear receptacle
188-188*a* flat sided end
189 slot in rigid arm
192 rigid arm sleeve
195 flexible connector link
196-196*a* flat inner side receptacle
197 pivoting spool rim pin mechanism
198 curved and flat receptacle
199 spool rim pin
200 angle locking mechanism
212 adjustment slot
214 angle-adjustment ring and pin
216 ring opening
218 tube-screw support
221 ring on bolt
222 ring shaft
224 screw-adjustment bolt
226 threaded adjustment-angle ring
228 screw-adjustment bolt thread
231 angle-adjustment screw handle
232 screw-adjustment bolt shaft
236 adjustment screw head
238 bracket extension
241 worm gear screw-ring
242 worm gear bracket
244 worm gear screw
246 worm gear
248 worm gear screw-handle
249 worm gear screw head
250 worm gear angle adjustor
251 pivoting angle-locking clamp
252 large clamp ring
254 left clamp ring
256 right clamp ring
258 upper clamp extension
259 clamp ring pivot
262 ring constraint
264 hole for constraint pin
266 threaded bolt hole
268 clamp pivot hole
300-300*aa* carriage
302-302*n* carriage wall
303-303*r* carriage wall hole
304 carriage extension plate
305 frame extension plate
306 carriage stabilization plate
307-307*a* pivot hole in carriage wall
308 carriage sleeve
310-310*n* frame adjacent section
311 pivot support
312 carriage attachment fixture
316-316 horizontal pivot pin
318 carriage roller
320-320*h* pivotable on horizontal axis section
330-330*a* horizontal axis pivoting mechanism
331 stabilizer arm

331R rear stabilizer arm
332 slot in stabilizer arm
333 combined vertically and horizontally pivotable carriage section
335-335*a* pivot frame
336 hole in shaft
337 vertical pivot shaft
338 pivot hole
339 pivot base
340-340*c* pivotable on vertical axis section
341 combined horizontal pivot and pulley shaft
342 hole in base
345-345*b* carriage counterweight arm
350-350*d* vertical axis pivot mechanism
359-359*a* rigid arm to spool connector
360-360*a* rotating section
363 counterweight pulley
365 counterweight flexible connector
367 carriage counterweight
390-390*h* rigid arm
396-396*a* handle sleeve
397 hole in handle sleeve
398 inside rigid arm handle
400-400*a* start angle adjustment and brake
401 inside crank arm hole
403 rectangular arm end
404 inside counterweight arm
406 counterweight on sliding arm
408 sliding counterweight
410-410*b* counterweighted rigid arm
411 arm extension
412 counterweight hole
413 counterweight
414 start angle stopper
419 start angle bracket
421 start angle arm
422 hole in start angle bracket
424 shaft hole
430 frame
432-432*e* vertical rigid member
432*g* second vertical rigid member
434-434*a* horizontal frame member
436 width adjustment mechanism
437 wheel
438 width track
439 take-up slide
441 take-up tube
443 width tube
442 take-up rail
444 frame dolly
445 hole in width track
446 hole in take-up rail
450-450*e* tube set
452-452*c* spool support
453 spool support and circular plate connector
454-454*m* fixed tube
454*bt* and 454*nt* top of fixed tube
454*bb* and 454*nb* bottom of fixed tube
455 tube support
456-456*k* rotating tube
457 tube extension
459 slot in tube
461 key
462 key channel in transmitter
463 key channel in fixed tube
468-468*b* tube-retaining ring
471 flange
472 solid end with hole
473 pivot ring
476 flexible connector
477 middle connector
478-478*b* first end
479-479*b* second end
481 rear section
487 front section
490-490*a* flexible connector and translator coupler
492 resistance pulley
494 resistance source
495-495*d* closed end loop
496 open end loop
498 front carriage pin
499L left rear carriage pin
499R right rear carriage pin
500 redirection assembly
508 redirecting tube set
522 rail connector
524 rear rail
525-525*a* carriage connector arm
526 pulley support
527 redirecting pulley support
530 constraint mechanism
531 redirection pin
533 redirection ring
534 maintenance arm slot
536 angle-maintenance rail
538 hole in angle-maintenance rail
540 angle-maintenance arm sleeve
544 angle-maintenance arm
545 hole in maintenance arm
546 hole in maintenance sleeve
551 carriage pulley
552 redirecting pulley
554 pulley rim
554 pulley rim
555 vertical carriage extension
556-556*b* pulley shaft
558-558*a* frame pulley
561 perpendicular carriage pulley
562 user pulley
565 take-up pulley
576 magnetic field sensor
578 magnet
580-580*b* speed measurement device
582 CPU
584 sensor to CPU wire
600-600*a* angle measurement mechanism 710-710*b* hinged clamp
607 numerical angle indicia
608 angle indicia
626 center pivot
628-628*a* arm
630 whiffletree
632 side pivot
640 combination whiffletree and translating force transmitter coupler
652 bench
654 golf implement
656 lower legs
662 baseball bat implement
664 stick figure user
666 tubular figure
668 upright bench
678 squares
680 locational indicator

681 user platform
682 platform transparent layer
684 platform opaque layer
688 grid lines
691 grid indicia
700 screw clamp
701-701*aa* locking pin
702L left clamp side
702R right clamp side
703 hole in extension
704L left lower clamp extension
704R right lower clamp extension
705 threaded hole in extension
706L left clamp extension
706R right upper clamp extension
708-708*d* bolt
711-711*d* bolt handle
712-712*a* threaded hole
714-714*c* rigid user handle
716-716*b* hole in plate
717 frame pin
718-718*j* hole in frame
719 pivot pin
721-721*a* opening
722-722*b* circular plate
725-725*j* hole in tube
726-726*c* sliding tube
727 winch
729-729*a* hole in sleeve
730 hole in flange
731 hole in spool
732 pin fastener
733 rotating tube hole
734 rotational axis
735 flexible connector longitudinal axis
736 carriage longitudinal axis
737 fixed tube longitudinal axis
738 rotating tube longitudinal axis
739 positioning axis
740 shared longitudinal axis
741 vertical axis
742 horizontal axis
744 section angle
745*a*-745*h* removable rigid arm coupler
746 translating force

DETAILED DESCRIPTION

Definitions

The following terms used in the description of the versions of the apparatus described:

Flexible Connector—A flexible entity capable of wrapping around a spool, such as a cable, rope, belt, band or chain, the entity made of a material of sufficient strength to transmit force between a user and an apparatus which opposes the force generated by the user.

Resistance Source—An apparatus that provides resistance to the exerciser, such as weight plates, weight stacks, flat or coiled springs made of metals, plastics and similar materials, hydraulic pistons, flywheels, elastic bands, cords and cables, lever arms and frictional devices.

Carriage—A mechanism connected to a frame, at least a part of which is movable relative to the frame.

Spool—A device having a curved rim and adapted to have a flexible connector affixed to it while engaging the connector on its rim such that the connector can be wrapped around the rim when the spool is turned.

FIGS. 1 and 1A, 8, 33 and 47

A Preferred Embodiment

A preferred embodiment of the apparatus is illustrated in FIG. 1. The apparatus has a frame 430 and a vertical rigid member 432, which supports a carriage 300 having a frame adjacent section 310 which is adjacent to the vertical rigid member 432 and a section that pivots about a horizontal axis, hereinafter referred to as a "pivotable on horizontal axis section" 320 that is connected to the frame adjacent section 310 via a horizontal axis pivot mechanism 330. It should be noted that the carriage sections shown in FIG. 1 and in subsequent figures are generally assemblies and are identified by lead lines with arrowheads pointing to those sections. However, the carriages 300 (and 300 with suffixes such as 300*a*) are often comprised of two or more sections. In such a case the carriage has a larger arrowhead than the arrowhead(s) pointing to the sections it subsumes.

In FIG. 1, each carriage section has a pair of carriage walls 302 on either side of the section, which supplies strength and rigidity to that carriage section (although one wall sections could be used, an example of which is shown in FIG. 14). In FIG. 1, the carriage 300 is adapted for positioning its height relative to the frame through the frame adjacent section 310. The frame adjacent section 310 can be fixed at various heights along the vertical rigid member 432 by aligning a carriage wall hole 303*b* in one of the carriage walls 302*a* of the frame adjacent section 310 with a hole in frame 718 and inserting a locking pin 701 through the holes so aligned. The frame adjacent section 310 is held together by a series of carriage rollers 318 that also facilitate the carriage's 300 movement up and down on the vertical rigid member 432, but bearings, wheels and similar devices could be used as well.

This embodiment of the apparatus is also adopted for positioning a section of the carriage 300 at selected angles to the frame. The horizontal axis pivoting mechanism 330, comprises a combined horizontal pivot and pulley shaft 341 that is supported by the frame adjacent section 310. The angle of the pivotable on horizontal axis section 320 relative to the frame adjacent section 310 is controlled by aligning one of a plurality of carriage wall holes 303*e* in the carriage walls 302*a* of the frame adjacent section 310 with a carriage wall hole 303 in the carriage wall 302 of the pivotable on horizontal axis section 320 and inserting the locking pin 701*a* in the holes so aligned.

A series of frame pulleys 558 guide a flexible connector 476 from a resistance pulley 492 connected to a resistance source 494 (here depicted as a typical weight stack but other forms of resistance as described in the definitions section of this specification could easily be depicted and employed as well) toward a carriage pulley 551, which further directs a first end 478 (not visible in FIG. 1 but visible in FIG. 1A) of the flexible connector 476 toward a spooling force transmitter 102 to which the flexible connector 476 is connected. A second end 479 (not visible in FIG. 1 but visible in FIG. 14) of the flexible connector 476 is attached to a carriage attachment fixture 312 (also visible in FIG. 14). This flexible connector and pulley arrangement forms a closed loop configuration that is well known in the industry, so that when the carriage 300 is raised, the length of the flexible connector above it shortens while the length of the flexible connector below it lengthens by the same amount, and vice versa (the disadvantage of such an arrangement is that the resistance experienced by the user is equal to half the amount actually generated by the resistance source because of the mechanical advantage conferred by the loop).

Figure 1A:
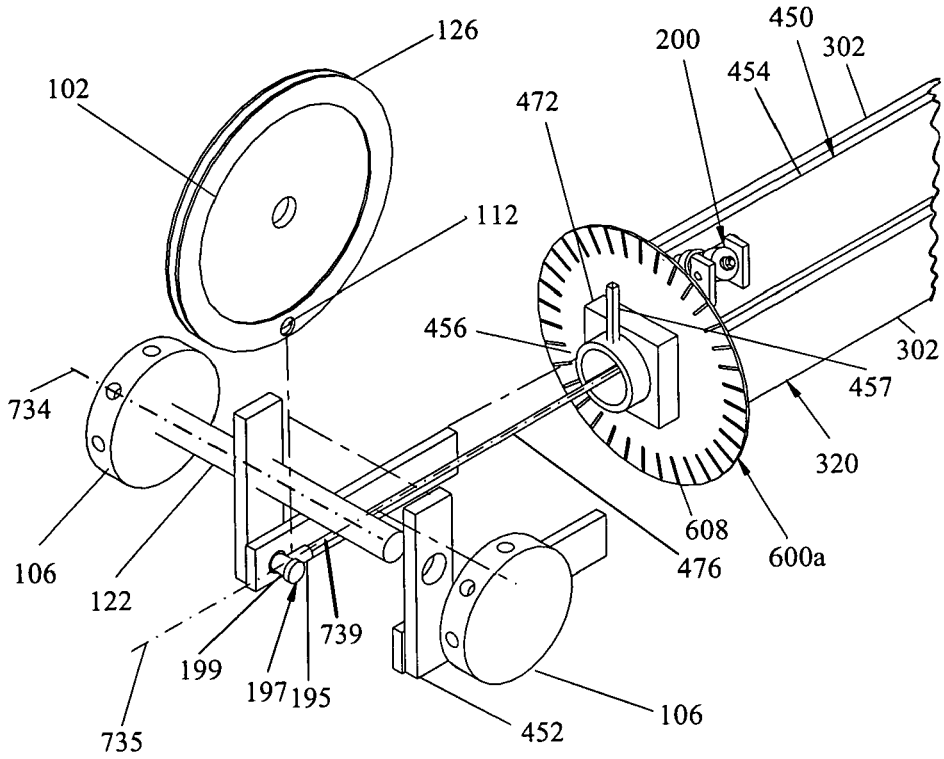
FIG. 1A shows a detail of the spool pivoting mechanism integrated with the carriage shown in FIG. 1.

FIG. 1A, which shows an exploded section of the pivotable on horizontal axis section 320 of the carriage 300, where it is connected to the spooling force transmitter 102. Here the carriage walls 302 of the pivotable on horizontal axis section 320 support a tube set 450 which comprises a square fixed tube 454 that supports a solid end with hole 472. The solid end with hole 472 rotatably supports a rotating tube 456. The flexible connector 476 passes through the coincident longitudinal axes of the fixed tube 454 and the rotating tube 456 (comparable axes are visible in FIGS. 33 and 33A) where its first end 478 (more visible in FIG. 1B) is attached to a pivoting spool rim pin mechanism 197. The pivoting spool rim pin mechanism 197 comprises a spool rim pin 199 and a flexible connector link 195 which pivots within, and perpendicular to, the spool rim pin 199. The pivoting spool rim pin mechanism 197 is attached to the spooling force transmitter 102 by placing either side of the spool rim pin 199 in a spool rim hole 112 in a spool rim 126 of the spooling force transmitter 102. The rotating tube 456 is attached to a set of spool support arms 452 that rotatably support a spool shaft 122, which itself supports the spooling force transmitter 102. The entire combination of the rotating tube 456, spool support arms 452, spool shaft 122 and spooling force transmitter 102 pivot about the shared longitudinal axes of the rotating tube 456 and the fixed tube fixed tube 454. That shared axis is coincident with a positioning axis 739 that is coincident with a flexible connector longitudinal axis 735 immediately before the flexible connector contacts the spool rim 126. The pivotability of the spool rim pin 199 relative to the flexible connector link 195 enables the spooling force transmitter to pivot about its positioning axis 739 without twisting the flexible connector 476.

An angle measurement mechanism 600*a* mounted on the pivotable on horizontal axis section 320 enables the angle of the rotating tube 456 relative to the fixed tube 454 to be measured by comparing the position of a tube extension 457 that is attached to the rotating tube 456 with a series of angle indicia lines 608 on the angle measurement mechanism 600*a*.

FIG. 8

Figure 8:
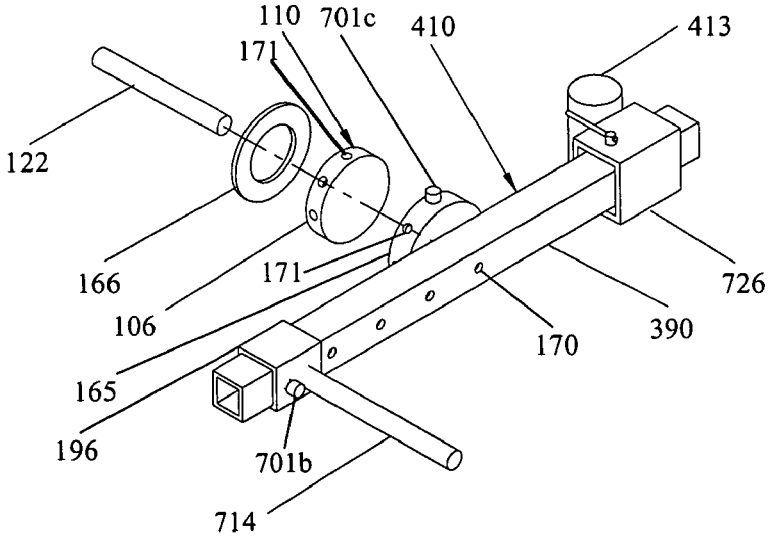
FIG. 8 shows an exploded detail of the rigid arm coupler and the rigid arm with counterweight shown in FIG. 1.

In FIG. 1, the spool shaft 122 is connected to a counterweighted rigid arm 410 by a rigid arm coupler 110. An exploded detail of the rigid arm coupler 110 is shown in FIG. 8. Here a curved shaft end 106 and a curved receptacle base 166 are exploded away from a curved receptacle 165 into which the 106 is inserted (the shape of the curved receptacle 165 is better seen in FIG. 38). The curved receptacle base 166 is attached to the curved receptacle 165, enclosing the curved shaft end 106 but permitting it to rotate with the 122. However, when a hole perpendicular to spool shaft 171 in the curved receptacle 165 is aligned with one of the holes perpendicular to spool shaft 171 of the curved shaft end 106, a locking pin 701*c* is inserted into the holes so aligned, locking the curved receptacle 165 and curved shaft end 106 together. When the curved receptacle 165 and curved shaft end 106 are locked together by the 701*c* and a force is applied to a rigid user handle 714, that force is transmitted to the spool shaft 122, turning the spooling force transmitter 102.

The user chooses which of the holes perpendicular to spool shaft 171 should be aligned by determining the rigid arm angle at which the user wishes to begin a given exercise. The angle is indicated by an angle measurement mechanism 600, a detail of which is provided in FIG. 47. Here a series of angle indicia 608 and numerical angle indicia 607, combined with a pointer 411, indicate the angle of the counterweighted rigid arm 410 relative to the spooling force transmitter 102. It should be noted that the choice of start angle function of the rigid arm coupler 110 and similar components to be discussed later also afford the user the option of beginning an exercise with a portion of the flexible connector 476 wrapped around a portion of the spooling force transmitter 102. This can be useful when the user wishes to vary the effective length of the flexible connector (e.g., when the pivotable on horizontal axis section 320 is tilted downward a portion of the flexible connector's 476 length is freed up and the connector slackens).

In FIG. 1, it can be seen that the counterweighted rigid arm 410 has the rigid arm 390 and the rigid user handle 714 on one side of the spool shaft 122, so that a user can effectively apply a force to the rigid arm 390 and experience an opposing force from the resistance source 494. A counterweight 413 at the opposite side of the rigid arm 390 from the rigid user handle 714 counterbalances the weight of the rigid user handle 714 and the part of the rigid arm 390 that is on the same side of the spool shaft 122 as the rigid user handle 714. The distance of the 413 relative to the 122 can be adjusted via a sliding tube 726 to which the counterweight 413 is attached. The sliding tube 726 has a threaded hole 712 (visible in FIG. 29) into which a bolt 708 is inserted and turned by applying force to a bolt handle 711. The rigid user handle 714 is connected to the rigid arm 390 via a handle sleeve 396 which can be placed at selected positions along the rigid arm 390 by aligning sleeve hole 397 (visible in FIG. 44) with a hole in rigid arm 170 and inserting the locking pin 701*b* in the holes so aligned.

FIGS. 47 and 47A

FIG. 47 provides a detail of the start angle adjustment and brake 400 shown in FIG. 1, that enables the starting angle of the rigid arm 390 to be selected and stops any backward motion of the counterweighted rigid arm 410 beyond its starting point if the user suddenly eliminates the force that is being applied to the rigid arm 390 via the rigid user handle 714. FIG. 47 provides the detail of the start angle adjustment and brake 400. The start angle adjustment and brake 400 comprises a circular plate 722 with a series of holes in plate 716. After connecting the counterweighted rigid arm 410 to the curved shaft end 106 at the desired angle relative to the spool shaft 122, using the rigid arm coupler 110, a start angle stopper 414 is inserted in one of the holes in plate 716 just behind the point where the counterweighted rigid arm 410 will begin to rotate during an exercise. The start angle stopper 414 arrests backward motion of the counterweighted rigid arm 410 beyond its starting point and helps to establish the starting position of the counterweighted rigid arm 410.

The mechanism shown in FIG. 47 is only one approach to adjusting the start angle of the rigid arm 390 and preventing it from rotating too far backward. For example, FIG. 47A shows a detail of start angle adjustment and brake 400*a* that affords more precise control of the start angle than the embodiment shown in FIG. 47 and arrests reverse motion as well. In FIG. 47A, the rigid arm 390 is exploded away from the start angle adjustment and brake 400*a* to provide a better view of the start angle adjustment and brake 400*a*. A start angle bracket 419 with a shaft hole 424 (not visible here on the start angle bracket 419 but aligned with a shaft hole 424*a* in a start angle arm 421) that fits over the spool shaft 122 in a position adjacent to the circular plate 722. The start angle bracket 419 has the hole in start angle bracket 422 which is placed at the same distance from the 122 as the holes in plate 716 of the circular plate 722. When one of the holes in plate 716 is aligned with the hole in start angle bracket 422, the locking pin 701*v* can be inserted into the holes so aligned, locking the start angle bracket 419 in place relative to the circular plate 722. The user chooses the most appropriate hole in plate 716 to align with the hole in start angle bracket 422 on the basis of the approximate start angle of the rigid arm 390 that is desired for a given exercise.

The shaft hole 424*a* enables the start angle arm 421 to fit over the spool shaft 122 adjacent to the start angle bracket 419. The start angle arm 421 has a threaded hole 712*a* (not visible here) into which the bolt 708*d* is placed. Turning the bolt handle 711*d* of the bolt 708*i* turns the bolt 708*d*, which contacts the start angle arm 421. Consequently, the distance between the ends of the start angle bracket 419 and the start angle arm 421 distal from the spool shaft 122 is adjusted by turning the bolt 708*d*. The distal end of the start angle arm 421 contacts the 390 so that adjusting the distance of the distal ends of the start angle bracket 419 and the start angle arm 421 also adjusts the angle of the 390.

FIG. 33

One very important capability of a number of embodiments of the apparatus is the ability to adjust and lock the spool at a variety of angles on its positioning axis 739 through an angle locking mechanism. A wide variety of such mechanisms could serve this purpose. For example, FIG. 33 shows a detail of a angle locking mechanism 200 that appears in FIG. 1, viewed from the front and left of the mechanism. The angle locking mechanism 200 in FIG. 33 is mounted on the fixed tube 454*g* (which in FIG. 33 is round in shape but the angle locking mechanism 200 works the same on a square tube or a round one). Here a pair of tube-screw supports 218 are attached to the fixed tube 454*g* and support a threaded adjustment-angle ring 226 via a ring shaft 222 on either side of threaded adjustment-angle ring 226 such that the ring pivots within the tube-screw supports 218. A screw-adjustment bolt 224 screws into the threaded adjustment-angle ring 226, and can be turned by applying force to an angle-adjustment screw handle 231. The screw-adjustment bolt 224 is inserted in an angle-adjustment ring and pin 214.

FIG. 33A shows more details of the angle locking mechanism 200. by exploding the rotating tube 456*g* backward from the fixed tube fixed tube 454*g* and exploding the angle-adjustment ring and pin 214 upward from the fixed tube fixed tube 454*g*. It can be seen that a fixed tube longitudinal axis 737 and a rotating tube longitudinal axis 738 shown in FIG. 33A are coincident with a shared longitudinal axis 740 of the two tubes shown in FIG. 33. The rotating tube 456*g* has a plurality of holes in tube 725*b*. The angle of the rotating tube 456*g* relative to the fixed tube fixed tube 454*g* is controlled by selecting one of the holes in fixed tube 725*b* into which the angle-adjustment ring and pin 214 is inserted after it passes through an adjustment slot 212 in the fixed tube fixed tube 454*g*. Then screw-adjustment bolt 224 is turned via force applied to the angle-adjustment screw handle 231. Angle-adjustment ring and pin 214 has a ring opening 216 into which a screw-adjustment bolt shaft 232 of the screw-adjustment bolt 224 fits. An adjustment screw head 236 and a ring on the bolt 221 on the screw-adjustment bolt 224 keep the bolt from translating relative to the angle-adjustment ring and pin 214, there being enough clearance between the ring opening 216 and the screw-adjustment bolt shaft 232 for the shaft to turn freely within the angle-adjustment ring and pin 214. This turning causes a screw-adjustment bolt thread 228 portion of screw-adjustment bolt 224 to be screwed into the threaded adjustment-angle ring 226. The depth to which the screw-adjustment bolt thread 228 is turned in the threaded adjustment-angle ring 226 by the screwing action precisely controls the angle of the rotating tube 456*g* relative to the fixed tube fixed tube fixed tube 454*g* within the limits of the adjustment slot 212 in the fixed tube fixed tube 454*g*.

In FIG. 1, a carriage counterweight 367 is connected to the carriage 300 through a connector to counterweight 365 that is guided from the carriage counterweight 367 to the carriage 300 by a series of counterweight pulleys 363. The carriage counterweight 367 is of sufficient weight to assure that the carriage will remain at a given height if the locking pin 701 that locks the carriage 300 in position is removed, and it makes raising and lowering the carriage 300 easy for the user. A carriage counterweight arm 345 attached to the pivotable on horizontal axis section 320 makes in easy for the user to adjust the angle of the section by counterbalancing the weight of the section. While these counterweights are not shown on every apparatus for the sake of illustrative simplicity, they would probably be used for all embodiments in which the weight of the carriage was sufficient for it to move when the supporting locking pin 701 was removed, or if the force needed to move a given carriage section was higher than what might be preferred by most users.

Operation—FIG. 1

In operating the apparatus the user selects the appropriate height of the carriage 300, aligns the carriage wall holes 303*b* in the carriage wall 302*a* of the frame adjacent section 310 with the hole in frame 718 that will enable the frame adjacent section 310 to be fixed at the appropriate height and inserts the locking pin 701. Similarly, the user then chooses the desired angle of the pivotable on horizontal axis section 320 relative to the frame adjacent section 310, aligns the carriage wall hole 303 in the carriage wall 302 of the pivotable on horizontal axis section 320 with the appropriate carriage wall hole 303*g* in the carriage wall 302*a* of the frame adjacent section 310 and inserts the locking pin 701*a*.

The user selects the appropriate start angles for the rotating tube 456 relative to the fixed tube fixed tube 454 and locks the rotating tube 456 at the appropriate angle by the method described above during the explanation of the workings of the angle locking mechanism 200. The user would select the start angle for the counterweighted rigid arm 410 by aligning the appropriate holes in the 106 and curved receptacle 165, as was already described in the discussion of FIG. 8. The start angle stopper 414 is inserted in the appropriate hole in plate 716 in the circular plate 722 to prevent the counterweighted rigid arm 410 from moving backward past its beginning angle. The user selects the appropriate position of the rigid user handle 714 along the rigid arm 390 by aligning the sleeve hole 397 in the handle sleeve 396 with the desired hole in rigid arm 170 in the counterweighted rigid arm 410 and inserting the locking pin 701*b*.

Additional Embodiments

FIGS. 10 and 10A through 10 C

FIG. 10 shows another preferred embodiment of the apparatus with a more compact carriage 300*f* that is adjustable in certain ways that are different from the embodiment shown in FIG. 1.

Specifically, in this embodiment, the carriage 300*f* consists of the frame adjacent section 310*d* and a section that pivots about a vertical axis, hereinafter referred to as a "pivotable on vertical axis section" 340. A vertical axis pivoting mechanism 350 makes it possible to position the pivotable on vertical axis section 340 at various angles relative to the frame adjacent section 310*d* around a vertical axis 741 (visible in FIG. 10B).

Two additional features, working together, add another capability to the carriage 300*f*. A constraint mechanism 530 operates to keep the longitudinal axis of the fixed tube 454*d* (fixed tube 454*d* is more visible in FIG. 10C and a comparable longitudinal axis is illustrated is FIG. 33A) parallel to the carriage walls 302*g* of the frame adjacent section 310*d* as the pivotable on vertical axis section 340 pivots on the vertical axis pivoting mechanism 350. The other feature of the carriage 300*f* which enables the axis of the tube set 450*c* to remain parallel is a redirection assembly 500. The redirection assembly 500 in effect provides the carriage 300*f* with a joint that enables the tube set 450*c* to sustain the position of its longitudinal axis as the pivotable on vertical axis section 340 pivots on the vertical axis pivoting mechanism 350.

A detail of the vertical axis pivoting mechanism 350 is shown in FIG. 10 B. Here a portion of the vertical axis pivoting mechanism 350 is exploded upward to make its components more visible. The vertical axis pivot mechanism 350 comprises the rotating tube 456*c* which rotates within the fixed tube 454*c*. A set of tube-retaining rings 468 above and below the fixed tube 454*c* are affixed to the rotating tube 456*c* and keep the rotating tube 456*c* from translating upward or downward. The rotating tube 456*c* supports a pair of carriage connector arms 525 that are connected to and support a pair of the carriage walls 302*d* that are part of the pivotable on vertical axis section 340. An angle locking mechanism 200*a* in vertical axis pivoting mechanism 350 comprises a plurality of holes in tube 725 in rotating tube 456*c*, a hole in tube 725*e* in fixed tube 454*c*, a hole in carriage wall 303*a* in carriage section 310*d* and a locking pin 701*h*. The user aligns one of the holes in tube 725 with the hole in tube 725*e* and the hole in carriage wall 303*a* and inserts locking pin 701*h* to lock the angle of the rotating tube 456*c* relative to the fixed tube 454*c*. The angle of the pivotable on vertical axis section 340 relative to the frame adjacent section 310*d* could of course be controlled by other mechanisms such as the angle locking mechanism 200 type already discussed above.

FIG. 10C provides a detail of the redirection assembly 500, which comprises a redirecting tube set 508 and a redirecting pulley 552 having a pulley rim 554. The redirecting tube set 508 is supported by the carriage walls 302*d* of the pivotable on vertical axis section 340 that are connected to the carriage connector arms 525. The redirecting tube set 508 comprises a fixed tube 454*h* attached to the carriage walls 302*d* and the rotating tube 456*h* that is pivotably supported by the fixed tube 454*h*. The angle of the rotating tube 456*h* relative to the fixed tube 454*h* around their shared longitudinal axis is fixed by the locking pin 701*h* inserted through the hole in carriage wall 303*o* in carriage wall 302*d*, the hole in tube 725*f* in the fixed tube 454*h* and one of the holes in tube 725 in the 456*h* (the hole in tube 725*f* and holes in tube 725 are not visible in this figure but are similar to the hole in tube 725*e* in fixed tube 456*c* and holes in tube 725 in rotating tube 456*c* in FIG. 10B). The flexible connector 476 is guided by the carriage pulley 551 through the center of the redirecting tube set 508 to contact a section of pulley rim 554 of the redirecting pulley 552, which directs the connector through the center of the tube set 450*c* and on toward the spooling force transmitter 102. As shown, the redirection assembly 500 mechanism is configured for rotations of the pivotable on vertical axis section 340 to the right (the kind of rotation shown in FIG. 10A). If the pivotable on vertical axis section 340 was to be rotated to the left, the rotating tube 456*h* of the redirecting tube set 508 would have to be rotated 180 degrees relative to the position shown is FIG. 10 and fixed there via the locking pin 701*h*.

The rotating tube 456*h* of the redirecting tube set 508 supports two redirecting pulley support arms 527 which themselves support a pulley shaft 556*a*. The pulley shaft 556*a* rotatably supports the redirecting pulley 552 and a set of two tube supports 455 that are attached to the fixed tube 454*d* of the tube set 450*c*. Similar to the apparatus shown in FIG. 1A, here the rotating tube 456*d* is rotatably supported by the fixed tube 454*d* and the rotating tube 456*d* supports two spool supports 452 which themselves support the spool shaft 122.

When the pivotable on vertical axis section 340 is pivoted on the vertical axis pivoting mechanism 350, the tube supports 455 pivot in a compensating fashion on the pulley shaft 556*a* supporting the redirecting pulley 552 and the pulley rim 554 of the redirecting pulley 552 directs the flexible connector 476 toward the center of the tube set 450*c* and on to the spooling force transmitter 102.

The constraint mechanism 530 is shown in detail in FIG. 10 A. The mechanism comprises a rear rail 524 mounted on either side of the frame adjacent section 310*d*. The rear rails 524 support a set of rail connectors 522 which themselves support an angle maintenance rail 536. The angle maintenance rail 536 slidably supports an angle-maintenance arm sleeve 540 and a angle-maintenance arm 544 attached to the 540. The angle-maintenance arm sleeve has a hole in angle-maintenance sleeve 546 and the angle-maintenance arm 544 has a hole in maintenance arm 545 which are aligned with each other (not visible) and through which the locking pin 701*g* is inserted. The angle-maintenance rail 536 has a series of angle-maintenance rail holes 538 which when aligned with the hole in angle-maintenance arm sleeve 546 and the hole in maintenance arm 545 enables the locking pin 701*g* to be inserted, locking the angle-maintenance arm sleeve 540 and the angle-maintenance arm 544 in place along the angle maintenance rail 536. The angle-maintenance arm 544 has a maintenance rail arm slot 534 along which a redirection pin 531 can slide. The redirection pin 531 is connected to the redirection ring 533 (better seen in FIG. 10*c*) which is connected to a the tube set 450*c*, preventing the position of the tube set's longitudinal axis from changing as the pivotable on vertical axis section 340 pivots.

FIG. 10A shows the pivotable on vertical axis section 340 after it has been rotated to the right 90 degrees from its position in FIG. 10. Here the tube supports 455 have pivoted 90 degrees on the pulley shaft 556*a* from their positioning FIG. 10.

Alternative Vertical Carriage Pivot Mechanisms—FIGS. 25 and 17

It should be noted that many versions of the vertical axis pivoting mechanism 350 could be employed as long as they provide the same kind of pivoting motion (i.e., on a vertical axis). For example, one alternative version is shown in FIG. 25. Here the carriage pulley 551 is rotatably supported by the pulley shaft 556, which itself is supported by the carriage walls 302*m* of the pivotable on vertical axis section 340*d*, the carriage walls 302*m* also supporting the tube set 450*c*. The carriage walls 302*m* are supported a pivot frame 335. The pivot frame 335 is supported by a vertical pivot shaft 337, the vertical pivot shaft 337 being rotatably supported by a pivot base 339. The pivot base 339 is supported by the carriage walls 302*g* of the frame adjacent section 310*n*. The angle of the pivotable on vertical axis section 340*d* relative to the frame adjacent section 310*n* on the vertical axis is determined by aligning one of a series of holes in shaft 336 in the vertical pivot shaft 337 (no visible in FIG. 25 but visible in FIG. 17)

with a hole in base 342 (also visible in FIG. 17) in the pivot base 339 and inserting the locking pin 701*h* in the holes so aligned.

The vertical axis and horizontal axis pivots can also be combined as shown in FIG. 17. Here a pivoting mechanism similar to the one shown in FIG. 25 is employed, comprising the pivot base 339 pivotably supporting a vertical pivot shaft 337 that in turn supports the pivot frame 335. However, here the pivot frame 335 supports the carriage walls 302*k* of a combined vertically and horizontally pivotable section 333, the carriage walls 302*k* rotatably supported by the combined horizontal pivot and pulley shaft 341 through a pivot hole in carriage wall 307*a* in each of the carriage walls 302*k* which are placed over the combined horizontal pivot and pulley shaft 341. The combined horizontal pivot and pulley shaft 341 also rotatably supports the carriage pulley 551. The angle of the combined vertically and horizontally pivotable section 333 relative to the frame adjacent section 310*f* on the horizontal axis is determined by aligning one of a series of carriage wall holes 303*i* in the carriage wall 302*k* of the combined vertically and horizontally pivotable section 333 with a pivot hole 338 in the pivot frame 335 and inserting the locking pin 701*o* in the holes so aligned. The angle of the combined vertically and horizontally pivotable section 333 on the vertical axis is selected in the same was as was discussed in the description of FIG. 25 immediately above.

FIG. 24—Multiple Carriages

The version of the apparatus in FIG. 24 is similar to the one in FIG. 1 except that there are two vertical rigid members 432, two carriages (300*t* and 300*v*) and associated mechanisms such as spooling force transmitters 102 and the counterweighted rigid arms 410. A locational indicator 680 and a speed measurement device 580 are also shown (these will be explained in FIGS. 51 and 54 discussed later in this specification). Finally, the distance between the carriages 300*t* and 300*v* can be adjusted using a width adjustment mechanism 436 and the angle of the carriages relative to one another on a vertical axis can be adjusted using the vertical axis pivoting mechanism 350*c* of the carriage 300*t*.

A detail of the vertical axis pivoting mechanism 350*c* of FIG. 24, is shown in FIG. 10D. Here a U-shaped frame adjacent section 310*h* supports the same fixed tube 454*c* as was shown in FIG. 10B, as well as the angle locking mechanism 200*a*, above the carriage pulley 551. However, frame adjacent section 310*h* also supports a second fixed tube 454*m* below the carriage pulley 551, the tube rotatably supporting a rotating tube 456*m*, the rotating tube attached to a set of carriage connector arms 525*a*. The connector arms 525*a* support a set of pulley supports 526 that support the combined horizontal pivot and pulley shaft 341, which rotatably supports carriage pulley 551 and pivotable on horizontal axis section 320 of carriage 300*t* of FIG. 24. When the carriage 300*t* in FIG. 24 is pivoted at the vertical axis pivoting mechanism 350*c* the distance and angles of the spooling force transmitters 102, relative to one another, is modified. A vertical axis pivoting mechanism 350*c* could easily be installed on carriage 300*v*, permitting a section of it to be rotated on a vertical axis as well (two vertical pivot mechanisms are shown in FIG. 18).

The carriage 300*v* has a support plate 308 which supports a pulley shaft 556*b* that itself rotatably supports a perpendicular carriage pulley 561. The perpendicular carriage pulley 561 directs the second end 479 of the flexible connector 476 coming up from the frame pulley 558*a* mounted under and alongside the vertical rigid member 432 and then to the carriage 300*v* (in much the same way that the frame pulley 558*c* on top of the vertical rigid member 432 directs the first end 478 toward the carriage 300*t*). This permits the flexible connector 476 emerging from frame pulley 558*a* to enter the carriage 300*v* from a similar direction as it enters the carriage 300*t*, enabling the carriages 300*t* and 300*v* to work in the same way when sections of the carriages are tilted on their horizontal axes. However, if such tilting was not desired but two carriages were, the second carriage could be positioned so that the flexible connector came over the top of carriage pulley 551 and was directed toward the spooling force transmitter (a carriage with the flexible connector 476 going over the top of the carriage pulley 551 is shown in FIG. 19).

In FIG. 24, the second end 479 attaches to the spooling force transmitter 102 on carriage 300*v* instead of the carriage attachment fixture 312 to which the second end 479 is attached in FIG. 1. This permits a single resistance source 494 to generate resistance for two spooling force transmitters 102.

FIGS. 48 and 49—Width Adjustments

The width adjustment mechanism 436 enables the vertical rigid member 432 and associated carriage 300*v* in FIG. 24 to be moved to modify the distance between the carriage 300*t* and the carriage 300*v*. A detailed view of the width adjustment mechanism 436 is provided in FIG. 48 by removing the carriages 300*t* and 300*v* and the locational indicator 680. In FIG. 48, it can be seen that a series of frame pulleys 558 guide the flexible connector 476 from the resistance pulley 492 toward both vertical rigid members 432. Before reaching the vertical rigid member 432 supporting carriage 300*v*, the flexible connector 476 is guided to a take-up pulley 565 which further guides the flexible connector 476 toward another series of frame pulleys 558 and 558*a*, those frame pulleys guiding the second end 479 of the flexible connector 476 up toward the underside of carriage 300*v* (which has been removed here but is visible in FIG. 24).

The vertical rigid member 432 supporting carriage 300*v* is supported by a take-up rail 442 that rests within a width track 438 on a series of wheels 437. The vertical rigid member 432 is locked in place by inserting the locking pin 701*x* in a hole 445*a* in the take-up rail 442 and through one of a series of the holes in frame 718*e* in the bottom of width track 438 (the hole in frame under locking pin 701*x* not visible). Moving the vertical rigid member 432 would result in changes in the flexible connector 476 tension where it not for some method of taking up and slack in the flexible connector 476 created by movement of the vertical member 432. A mechanism for adjusting flexible connector 476 tension is provided by adjusting the distance of the take-up pulley 565 from the vertical rigid member 432. The take-up pulley 565 is rotatably mounted on a take-up slide 439 which can be locked at various points along a take-up tube 441 by inserting the locking pin 701*w* through a hole in the take-up slide 445 (not visible here but beneath locking pin 701*w*) and through one of a series of holes in frame 718*f* in the take-up tube 441. It should be noted that the flexible connector take-up capability of the width adjustment mechanism 436 can also be used to adjust the effective length of the flexible connector 476, so that when take-up pulley 565 is moved toward carriage 300*v* flexible connector 476 length is freed up (less is available when the carriage is moved in the opposite direction). This is especially useful when both carriages are being tilted up or down at the same time.

There are many ways for the carriages to be adjusted. A detail of an alternative approach is shown in FIG. 49. FIG. 49 also shows how two resistance sources can be incorporated into a version of the apparatus with two vertical rigid members and two carriages, supplying separate resistance to each carriage. In such a case, both carriages (removed from FIG. 49 to make the width adjustment mechanism more visible) could be similar to the one shown in FIG. 1, to the carriages 300*t* and 300*v* shown in FIG. 24, or to a variety of other carriages shown in other parts of this description and equivalent ones not shown.

In FIG. 49, each resistance source 494 is connected through a resistance pulley 492 to a flexible connector 476. One of the resistance sources 494 is mounted on a frame dolly 444. The frame dolly 444 is supported by a series of wheels 437, that permit the dolly to roll. The frame dolly 444 is attached to the sliding tube 726*b* which supports the vertical member 432 such that the member can slide along a width tube 443. The width tube 443 has a series of the holes in tube 725*g* and the sliding tube 726*b* has a similar hole in tube 725*h* (not visible but is under the locking pin 701*z* shown in the sliding tube 726*b*). When the hole in tube 725*h* in the sliding tube 726*b* is aligned with the hole in tube 725*g* in the width tube 443, the locking pin 701*z* is inserted to lock the sliding tube 726*b* in position (along with the associated second vertical member 432*g* and the frame dolly 444).

FIGS. 54-56—Locational Indicators and 51-53—Speed Measurement Devices

The locational indicator 680 shown in FIG. 24 enables the user to measure and replicate his or her position relative to the apparatus. Details of the locational indicator 680 are shown in FIG. 54, which shows a top view of a user platform 681 that supports the user. The user platform 681 has a series of grid lines 688 and a set of grid indicia 691. These elements, in combination, permit the user to accurately measure his or her position. In FIG. 54 the grid lines 688 and grid indicia 691 are on the surface of the 681, but a number of other possibilities would work as well. For instance, FIG. 55 shows a right side view of an embodiment of the locational indicator 680 that has a platform opaque layer 684 on which the grid indicia 691 and grid lines 688 are placed. A platform transparent layer 682 is then placed over the platform opaque layer 684 and the grid lines 688 and the grid indicia 691, protecting them from wear yet visible to the user. Still another approach to indicating location is simply to arrange a series of squares 678 as is shown in FIG. 56. The ability of the user to identify his or her position using the series of squares 678 could be enhanced by making the squares of different colors, different hatch patterns or indicia unique to particular squares.

FIG. 24 also shows a speed measurement device 580 that measures the speed with which the user moves the flexible connector 476. A detail of the speed measurement device 580 is shown in FIG. 51. Here it can be seen that a magnetic field sensor 576 is mounted on the frame 430 at a specific distance from the pulley shaft 556 that supports the frame pulley 558*c* at the top of the vertical rigid member 432. A series of magnets 578 are mounted on the frame pulley 558*c* at the same distance from the pulley shaft 556 as the magnetic field sensor 576. When the user applies force to the spooling force transmitter 102, the flexible connector 476 turns the frame pulley 558*c*, causing the magnets 578 to pass the magnetic field sensor 576. A sensor to CPU wire 584 connects the magnetic field sensor 576 to a CPU 582 (central processing unit) similar to the kind in use in the fitness industry on treadmills. The CPU 582 displays such data as the maximum rate at which the magnets 578 passed the magnetic field sensor 576 on each repetition of the exercise.

A variety of other approaches to measuring movement speed could be employed. For example, FIG. 52 shows a detail of a version of the speed measurement device 580*a* in which the magnetic field sensor 576 is mounted on the resistance source 494 and the magnets 578 are mounted on the frame 430. The magnetic field sensor 576 is moved past the magnets 578 when the flexible connector 476 is moved and the result is displayed on the CPU 582.

FIG. 53 shows a version of the speed measurement device 580*b* that is similar to the one used in FIG. 52 but here the magnets 578 are mounted on the resistance source 494 and the magnetic field sensor 576 is mounted on the frame 430. Still other arrangements of energy sensors (e.g., light) and emitters, and movement sensors, could be used for the same purpose.

FIG. 18—An Apparatus Including a Standard Cable Column Capability

The apparatus is FIG. 18 shows another version of the apparatus in which an apparatus supporting the carriage 300*t* in FIG. 24 can be combined with a second carriage 300*n* supporting a more conventional "cable column" mechanism, of which there are many varieties in the industry today. Here the carriage 300*n* has its own second resistance source 494 but the carriage could easily be connected to a resistance source 494 that serves two carriages as is shown is FIG. 24. In FIG. 18, the second carriage 300*n* shown is height adjustable in a similar way to the carriage 300*t*, wherein the frame adjacent section 310*h* comprises a carriage sleeve 309 with a hole in sleeve 729*a* (not visible) through which the 701 is inserted into one of the holes in frame 718. The 309 supports two pivot supports 311 that themselves support a vertical axis pivot mechanism 350*b*. The vertical axis pivot mechanism 350*b* on the 300*n* works in the same way as was shown in the vertical axis pivot mechanism 350 in FIG. 10 and supports the pivotable on vertical axis section 340*b* except that the carriage connector arms 525 of the vertical axis pivot mechanism 350*b* supports a pair of carriage walls 302*n* that support a pair of vertical carriage extensions 555 which rotatably support two user pulleys 562, each having a pulley rim 554.

On carriage 300*n*, the first end 478 of the flexible connector 476, instead of being attached to a spooling force transmitter 102 (as it is on carriage 300*t*) passes between the user pulleys 562 and on to point where it is attached to a user handle 108. The second end 479 of the flexible connector 476 is attached to the carriage attachment fixture 312 supported by the frame adjacent section 310*i* as it was in FIG. 1, but the carriage attachment fixture 312 is not visible here. The user pulls on the user handle 108 of the type shown, or any of a wide variety of cable handles used in the industry today, as well as ones to be developed in the future, to perform exercises which require straight line resistance that is not closely guided (i.e., conventional pulley resistance). The vertical axis pivoting mechanism 350*b* shown does not have the tube angle locking mechanism 200*a* shown in the vertical axis pivoting mechanism 350 of FIG. 10 but such a feature could easily be added. Not having the locking pin feature enables the pivotable on vertical axis section 340*b* to rotate freely on its vertical axis, which is useful for certain exercises. The pivot on vertical axis pivoting mechanism 350*b* shown could also easily be replaced others with a similar function, such as the one shown in FIG. 17.

In addition, the carriage 300*n* of FIG. 18 could be introduced as an attachment to another carriage such as carriage 300*t* of FIG. 18. A detail of such an arrangement is shown in FIG. 18A. Here a carriage 300*o* supports a spooling force transmitter 102 in a similar way to carriage 300*t* shown in FIG. 18. In addition, carriage 300*o* supports the carriage sleeve 309 of a carriage identical to that of the carriage 300*n* in FIG. 18. The same resistance source 494 is used for resistance at both the spooling force transmitter 102 and the 108, where the first end 478 of the flexible connector 476 (not visible here) is attached to the spooling force transmitter 102 and the second end 479 is attached to the 108 after it passes between the user pulleys 562.

FIGS. 19-21—Translating Force Transmitters

FIG. 19 shows a detail of a simple embodiment of the apparatus in which there is a translating force transmitter 101*a*. The carriage 300*p* supports the square fixed tube 454 within which the translating force transmitter 101*a* is able to translate relative to the fixed tube 454. In contrast to the force transmitters already shown (e.g., the spooling force transmitter 102 in FIG. 1), this translating force transmitter 101*a* is connected to the second end 479 of flexible connector 476 while the first end 478 is connected to the carriage attachment fixture 312, which is supported by the carriage 300*p*. When the user applies force to a rigid user handle 714*a*, the translating force transmitter 101*a* creates tension in the flexible connector 476 which is transmitted to the resistance source 494 (not shown in this Fig.). The height of the carriage 300*p* is adjustable in the same way as carriage 300 is in FIG. 1.

FIG. 20 shows an embodiment of the apparatus in which the translating force transmitter 101*b* which is in the shape of a rectangular tube instead of the solid square shape of the translating force transmitter 101*a* in FIG. 19. Here the carriage 300*q* has a frame adjacent section 310 and the pivotable on horizontal axis section 320*d*. The pivotable on horizontal axis section 320*d* has a carriage wall 302 on either of its sides and the walls are rotatably supported by the combined horizontal pivot and pulley shaft 341, in the same way the similar section the pivotable on horizontal axis section 320 in FIG. 1 is supported. The translating force transmitter 101*b* is supported by the walls 302 of the pivotable on horizontal axis section 320*d* and is able to slide along those walls, the translation being limited by a tube-retaining ring 468*b* at the end of the carriage walls 302 distal from the frame adjacent section 310. Is this embodiment, the translating force transmitter 101*b* is connected to a bar support rails 107 on either side, which themselves each support a bar support connector 109 The bar support connectors 109 have a series of holes in bar support connector 111 into which the rigid user handle 714*b* can be placed. The user then exerts force against the rigid user handle 714*b* to translate the translating force transmitter 101*b*.

FIG. 20 shows the pivotable on horizontal axis section 320*d* of the carriage 300 extending straight forward from the frame adjacent section 310 but the horizontal axis pivoting mechanism 330 enables the pivotable on horizontal axis section 320*d* to be adjusted to a number of angles relative to the frame adjacent section 310, as was the case for the pivotable on horizontal axis section 320 shown in FIG. 1. FIG. 21 shows the pivotable on horizontal axis section 320*d* inclined upward by 90 degrees relative to the pivotable on horizontal axis section 320 shown in FIG. 20. The carriage could also be tilted down by 90 degrees from the position shown in FIG. 20, the number of intervening positions being determined only by the nature of the angle locking mechanism chosen, such as the series of carriage wall holes 303*e* in the carriage walls 302*a* of the frame adjacent section 310. But a variety of other angle adjustment mechanisms could be used, such as the ones that will later be shown for adjusting tube angles. The ability to change carriage angles enable a user to push or pull upward, push or pull forward, push or pull downward and at a variety of intervening angles, to enjoy a wide exercise variety.

FIGS. 23 and 22—Spooling and Translating Force Transmitters Combined

FIG. 23 shows an apparatus similar to the one shown in FIG. 24 except that a carriage 300*u* supports a translating force transmitter 101*b* instead of a spooling force transmitter 102. Here the user can use the side of the apparatus supporting the spooling force transmitter 102 via the carriage 300*t* to perform exercises requiring rotational motion and the side of the apparatus supporting the translating force transmitter 101*b* on the second carriage 300*u* to perform exercises that require guided linear motions.

FIG. 22 shows a preferred version of the apparatus which employs a carriage 300*r* and a second carriage 300*s*, each of which supports both a spooling force transmitter 102 and a translating force transmitter 101*c*. With this version of the apparatus, either arm or leg of the user can perform rotational or guided linear resistance exercises. The ability to choose between rotational and translational motion on each carriage is created by a flexible connector and translator coupler 490 beneath an opening 721 in the translating force transmitter 101*c*.

A detail of the flexible connector and translator coupler 490 is shown in FIG. 28, where the fixed tube 454*n* is split into a top of fixed tube 454*nt* and a bottom of fixed tube 454*nb* and the translating force transmitter 101*c* is split into a top half of translating force transmitter 101*ct* and a bottom half of translating force transmitter 101*cb* to display the inside of the fixed tube 454*n*. Here it can be seen that the flexible connector 476 is divided into a front section 487 and a rear section 481, each having the first end 478 and the second end 479.

The first end 478 of the front section 487 is connected to the spooling force transmitter 102 (not visible here) and the second end 479 of the front connector section 487 is connected to a closed end loop 495. The first end 478 of the rear section 481 is connected to the closed end loop 495*a*. The second end 479 of the rear section 481 is connected to the resistance source 494 (not visible in FIG. 28). There is an opening 721 in the top translating force transmitter 101*ct* and the fixed tube 454*nt* through which the user can insert the locking pin 701*p* (shown in FIG. 22) into the fixed tube 454*nt* and through the closed end loop 495 and 495*a* when those loops are aligned. A pin fastener 732, such as a nut, lock washer or a clamp (here a round nut) can be added to the locking pin 701*p* to hold the closed end loops 495 and 495*a* on the locking pin 701*p*. This connects the front connector section 487 and the rear connector section 481 and permits a user applying force to the spooling force transmitter 102 to experience resistance from the resistance source 494.

Alternatively, the user can store the closed end loop 495 of the front section 487 on a front carriage pin 498 and insert the locking pin 701*p* from the top through the hole in tube 725*c* in the translating force transmitter 101*ct*, then through the closed end loop 495*a* of the rear section 481. With the apparatus so configured, the top of fixed tube 454*nt* has a slot in tube 459 which permits the locking pin 701*p* to slide along the carriage 300*r* and/or 300*s* when force is applied by the user to the translating force transmitters 101*c*. Consequently, the first end 478 of the rear section 481 is selectively connectable to the second end 479 of the front section 487, or to the translating force transmitter 101*c*, or to both the front section and to the force transmitter. Other versions of connection are easily employed, such as the one shown in FIG. 27, which will be discussed later in this description.

Figure 1B:
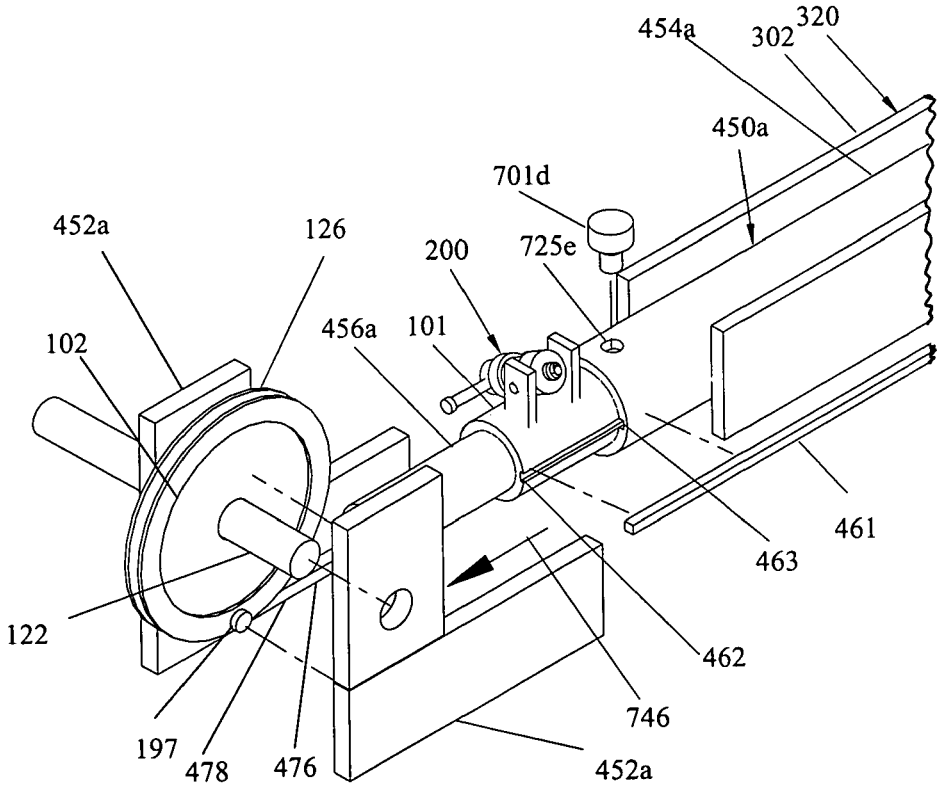
FIG. 1B shows an alternative version of the spool pivoting mechanism shown in FIG. 1 having three tubes connected to the carriage.

FIGS. 1B, 2 and 26—Alternative Spool Pivot Mechanisms and a Whiffletree The mechanism that permits the spooling force transmitter 102 to pivot about its positioning axis in FIG. 1 was shown in detail in FIG. 1 A. The ability to selectively fix the spooling force transmitter 102 about its positioning axis 739 (visible in FIG. 1A) and to turn the spooling force transmitter 102 via the rigid arm 390 about the spooling force transmitters 102 rotational axis 734 (visible in FIG. 1A) affords the user unprecedented exercise variety. But many other approaches to generate such pivoting around the positioning axis 739 are possible.

While FIG. 1 shows a combination of a square fixed tube 454 and the rotating tube 456 which permit the spooling force transmitter 102 to pivot, other tube shapes are possible. For instance, the square fixed tube 454 could easily be rectangular, triangular, octagonal or any number of shapes having flat sides. Alternatively, it could have a curved shape, such as that of an ellipse. Both the fixed tube 454 and the rotating tube 456 can also be round, as long as a mechanism for fixing the angle of the rotating tube relative to the fixed tube is employed.

For example, FIG. 1B shows a similar detail to FIG. 1A, except that here the fixed tube 454*a* of the tube set 450*a* is round, which eliminates the need for the solid end with hole 472 to connect the fixed tube 454 with the rotating tube 456 (as was the case with the pivoting mechanism already shown in FIG. 1A). In FIG. 1B, a structure is added to the tube set 450*a* that permits translation of the spooling force transmitter 102 relative to the fixed tube 454*a* as well as pivotability about its positioning axis 739, expanding the number and nature of exercises that can be performed with the same apparatus.

Here such a capacity as created by including in tube set 450*a* a round translating force transmitter 101 having a key channel in transmitter 462 and placing the transmitter between the fixed tube 454*a* and the rotating tube 456*a*. There is a key channel in fixed tube 463 in the fixed tube 454*a* and a key 461 (shown exploded out to the right in this illustration) is placed within the key channel in transmitter 462 and the key channel in fixed tube 463. This arrangement permits the spooling force transmitter 102 to translate relative to the fixed tube 454*a* when a translating force 746 is exerted against it.

Alternatively, the 701*d* could be inserted into the hole in tube 725*e* in the fixed tube 454*a* and similar hole in tube 725*d* in translating force transmitter 101 (not visible but below hole 725*e*) to lock to fixed tube and force transmitter in place relative to one another and permit pivoting of the rotating tube 456*a* relative to the fixed tube 454*a* and the translating force transmitter 101. The angle locking mechanism 200 is mounted on the translating force transmitter 101 to control the angle of the rotating tube 456*a* relative to the translating force transmitter 101 and the fixed tube 454*a*.

An alternative design for permitting spooling force transmitter 102 to pivot around its positioning axis and to translate relative to a fixed tube is shown in FIG. 61. Here the structure that permits the spooling force transmitter 102 to pivot on its positioning axis is the same as the one that was shown in FIGS. 1 and 1A except that here the fixed tube 454*f* is shorter and a translating force transmitter 101*d* that can slide within the fixed tube 454*f*, the tube supported by the carriage 300*z*. The translating force transmitter 101*d* supports the solid end with hole 472 instead of the fixed tube 454 (as was the case in FIG. 1A). The rigid user handle 714*a* attached to the spool shaft 122 through a rigid arm sleeve 192. When the user pushes against the rigid user handle 714*a*, the spooling force transmitter 102 is translated relative to the carriage 300*z*.

FIG. 2 shows another variation on the structure that enables the spooling force transmitter 102 to pivot around its positioning axis 739. Here the rotating tube 456*b* has a larger diameter than the fixed tube 454*b* and fits over the fixed tube 454, as compared with previously shown embodiments in which the opposite has been true. In addition, the spool support arms 452*b* which support the spool shaft 122 are mounted on the outside of the rotating tube 456*b* instead of on the inside. The rigid arm 390 can be connected to the 106 (through the rigid arm coupler 110, neither the rigid arm or the coupler are shown here) to apply force to the spool shaft 122 and turn the spooling force transmitter 102. The embodiment shown is particularly suited for simulating a wide variety of sports motions, such as a golf swing and a baseball swing when an appropriate implement is attached to the rigid arm 390, counterweighted or not, (such as is shown in FIGS. 63 and 64 which are explained more fully later in this description). Because such movements can generate considerable torque, the apparatus is stabilized by a carriage stabilization plate 306 at least one stabilizer arm (two are shown here). The stabilizer arms 331 are attached to the rotating tube 456*b* and movably connected to the carriage stabilization plate 306 so that the rotating tube 456*b* can assume various angles relative to fixed tube 454*b* and still be supported by the carriage stabilization plate 306. The carriage stabilization plate 306 is attached to the carriage 300*a* but could be attached to the fixed tube 454*b* instead, or in addition. A pair of rear stabilizer arms 331R support the carriage stabilization plate 306 from the side opposite the rotating tube 456*b*. The rear stabilizer arms 331R are attached to the carriage stabilization plate 306 and connected to the frame 430 via a set of the sliding tubes 726*a*. The sliding tubes 726*a* can move freely up and down on the frame 430. Here the connection of the front stabilizer arm 331 to the carriage stabilization plate 306 is accomplished through a slot in stabilizer arm 332 that fits over the carriage stabilization plate 306 snugly enough on the carriage stabilization plate 306 to support the rotating tube 456*b* but still permitting the rotating tube 456*b* to turn about the plate. But a number of other structures, such as a fork attached to the front stabilizer arm 331F and placed over the carriage stabilization plate 306, would work as well. A whiffletree 630 is also employed in this version of the apparatus to give the user a greater range of resistance choices.

FIG. 26 shows the detail of the whiffletree 630. Here the rotating tube 456*b* of FIG. 2 is removed and the fixed tube 454*b* rotatably supporting the fixed tube 454*b* is split into an top half of fixed tube 454*bt* and a bottom half of fixed tube 454*bb*. There is an opening 721 in the fixed tube 454*bt* to provide whiffletree 630 access to the user (as there is in the rotating tube 456, visible in FIG. 2). The whiffletree 630 divides the flexible connector 476 into the front section 487 and the rear section 481, each having the first end 478 and the second end 479. The first end 478 of the front section 487 is connected to the spooling force transmitter 102, in the same way that the first end 478 of the flexible connector 476 is connected to the spooling force transmitter 102 in FIG. 1 A (not visible here), while the second end 479 is pivotably connected to a center pivot 626 of an arm 628 through the closed end loop 495*b*. The first end 478 and the second end 479 of the rear section 481 are both connectable to the arm 628 via the closed end loops 495*c* that are pivotably attached to a side pivot 632 on either side of the arm 628. If only on one end of the rear connector section 481 is attached to the arm 628, only half of the actual resistance generated by resistance source 494 is transmitted to the user. If both ends of the rear connector section 481 are connected to the side pivots 632, the full amount of the resistance is transmitted to the user. When the first end 478 or rear connector section 481 is not connected to the arm 628, it is stored on a nearby rear carriage pin 499L and when the second end 479 is not connected to the arm 628 it is stored on a nearby rear carriage pin 499R.

FIGS. 65 and 27—Combining Spooling and Translating Force Transmitters with a Whiffletree FIG. 65 shows a version of the apparatus similar to the apparatus shown in FIG. 22 but with only one vertical rigid member 432 and only one carriage 300*r*, the carriage supporting a combination whiffletree and translating force transmitter coupler 640.

A detail of the combination whiffletree and translating force transmitter coupler 640 is shown in FIG. 27. It shows the fixed tube 454*n* divided into a top of fixed tube 454*nt* and a bottom of fixed tube 454*nb*, along with translating force transmitter 101*c* divided into top of translating force transmitter 101*ct* and bottom of translating force transmitter 101*cb*. This combination whiffletree and translating force transmitter coupler 640 combines the features of the whiffletree 630 shown in FIG. 26 and the flexible connector and translator coupler 490*a* (similar to the coupler 490 shown in FIG. 28). This is accomplished by adding a middle connector 477 between the whiffletree 630 and the flexible connector and translator coupler 490*a* and connecting the middle connector 477 to the center pivot 626 of the arm 628 via the closed end loop 495*d* and to the second end 479 of the front connector section 487, via the closed end loop 495*b*. A open end loop 496 is attached to the second end 479 of the front connector section 487 (the first end 478 is connected to the spooling force transmitter 102, not visible here). The open end loop 496 permits the user to connect the front connector section 487 to the middle connector 477 without a locking pin. When this connection between the 495*d* and the 496 is made, the spooling force transmitter 102 can be utilized.

When the user wishes to engage the translating force transmitter 101*c* instead of the spooling force transmitter 102, the locking pin 701*p* (not visible here) is inserted through hole in tube 725*c* as it was in FIG. 28 and placed through the closed end loop 495*d* of the middle connector section 477 after storing the open end loop 496 on the front carriage pin 498.

When only the first end 478 or the second end 479 of the rear connector section 481 is attached to the arm 628, half of the resistance generated by the resistance source 494 is conferred on the user by virtue of the earlier mentioned cable loop (when not in use the ends are stored on one of the rear carriage pins 499 which are attached to the bottom of fixed tube 454*nb*). When both the first end 478 and the second end 479 of the rear section 481 are connected to the arm 628, the full resistance generated by the resistance source 494 is conferred, so that resistance can easily be doubled or halved depending on the connections with the arm 628. This approach is applicable when both ends of the flexible connector 476 are available at the same carriage. It overcomes the main disadvantage of the cable loop, which is the tradeoff of convenience for resistance. So the apparatus detailed in FIG. 65 allows the user, via the combination whiffletree and translating force transmitter coupler 640, to make choices regarding the kind resistance that is desired (rotational or translational) as well its level (via the whiffletree).

FIGS. 3-7 and 9—Alternative Spool Pivoting Mechanisms

Figure 3:
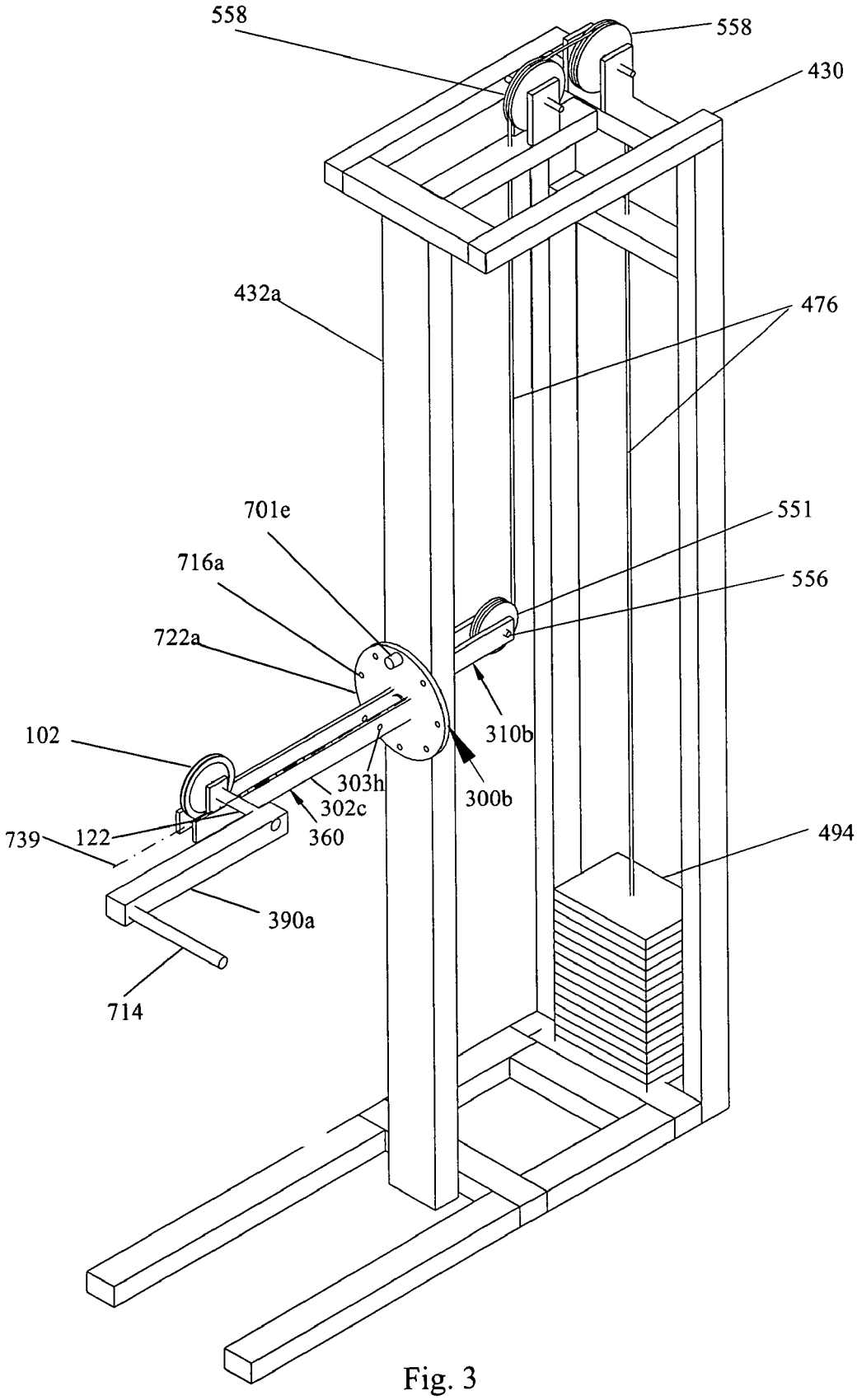
FIG. 3 shows a version of the apparatus with a two carriage sections, one frame adjacent section and one rotating section pivoting itself with the spool mounted on it.

Another embodiment of the pivot on positioning axis 739 feature is shown is FIG. 3. Here there are two carriage sections, the frame adjacent section 310*b* and a rotating section 360. The frame adjacent section 310*b* supports the pulley shaft 556 which supports the carriage pulley 551 and the section is fixed to the vertical rigid member 432 so cannot be adjusted with regard to height. The rotating section 360 rotates around the positioning axis 739, pivoting the spooling force transmitter 102 about the same axis. Here, since the height of the 300*b* cannot be adjusted, there is not need for a flexible connector 476 loop is was shown in FIG. 1, so the connector is attached directly to the resistance source 494.

Figure 7:
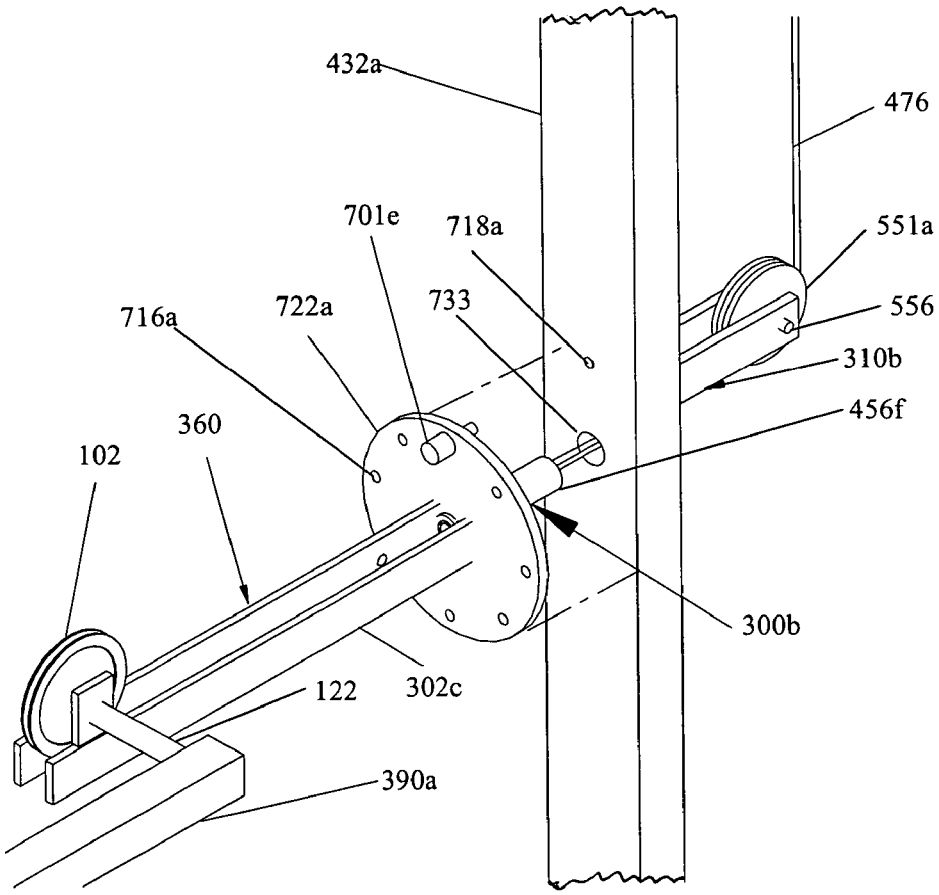
FIG. 7 shows an exploded detail of the pivoting carriage shown in FIG. 4.

FIG. 7 shows a detail of the carriage 300*b* from FIG. 3. Here it can be seen that the rotating section 360 rotates via the rotating tube 456*f* attached to the rotating section 360 and inserted in a rotating tube hole 733 in the vertical rigid member 432. A circular plate 722*a* is attached to and supports the carriage walls 302*c* of the rotating section 360, which themselves support the spool shaft 122 and spooling force transmitter 102. The angle of the rotating section 360 relative to the frame adjacent section 310*b* is controlled by aligning a hole in frame 718*a* in the vertical rigid member 432*a* with one of the holes in plate 716*a* in the circular plate 722 and inserting the locking pin 701*e* in the holes so aligned. Here a simple rigid arm 390*a*, instead of a rigid arm 390 as part of the counterweighted rigid arm 410 shown in FIG. 1, is attached to the spool shaft 122 and the rigid user handle 714 (not visible here).

FIG. 4 shows an embodiment of the apparatus that accomplishes rotation around the positioning axis without any tubes. The carriage 300*c* is adjustable in height via a screw clamp 700 instead of the pin and hole arrangement seen previously. The structure and operation of such a clamp is explained in the discussion of FIG. 29 later in this specification. In the embodiment of the apparatus in FIG. 4, a frame extension plate 305 is attached to the spool support arms 452. The circular plate 722*b* is attached to the carriage 300*c*. The frame extension plate 305 has the hole in plate 716*d* (not visible but aligned with locking pin 701*f*) and when the hole in place 716*d* is aligned with one of the holes in plate 716*a* in the circular plate 722*b* the locking pin 701*f* is inserted in the holes so aligned to lock the angle of the spooling force transmitter 102 on its positioning axis (the axis visible in FIG. 3).

Figure 5:
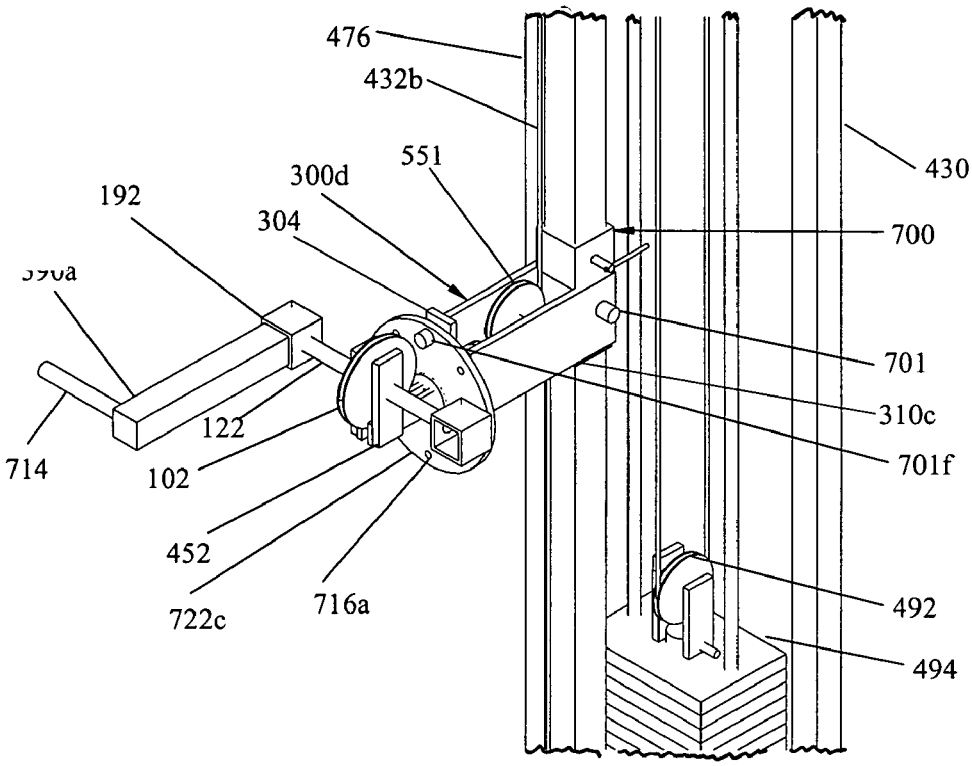
FIG. 5 shows a pivoting device similar to the one shown in FIG. 4 but with the circular plate mounted on the spool support arms and a clamp to adjust the carriage's height.

FIG. 5 shows a detail of a similar apparatus to the one shown in FIG. 4, except that a circular plate 722*c* is supported by the spool support arms 452 and a carriage extension plate 304 is attached to the carriage 300*d*. When the hole in plate 716*b* in the carriage extension plate 304 (visible in FIG. 6) is aligned with one of the holes in plate 716*b* in the circular plate 722*c*, the locking pin 701*f* is inserted to lock the angle of the spooling force transmitter 102 on its positioning axis.

Figure 6:
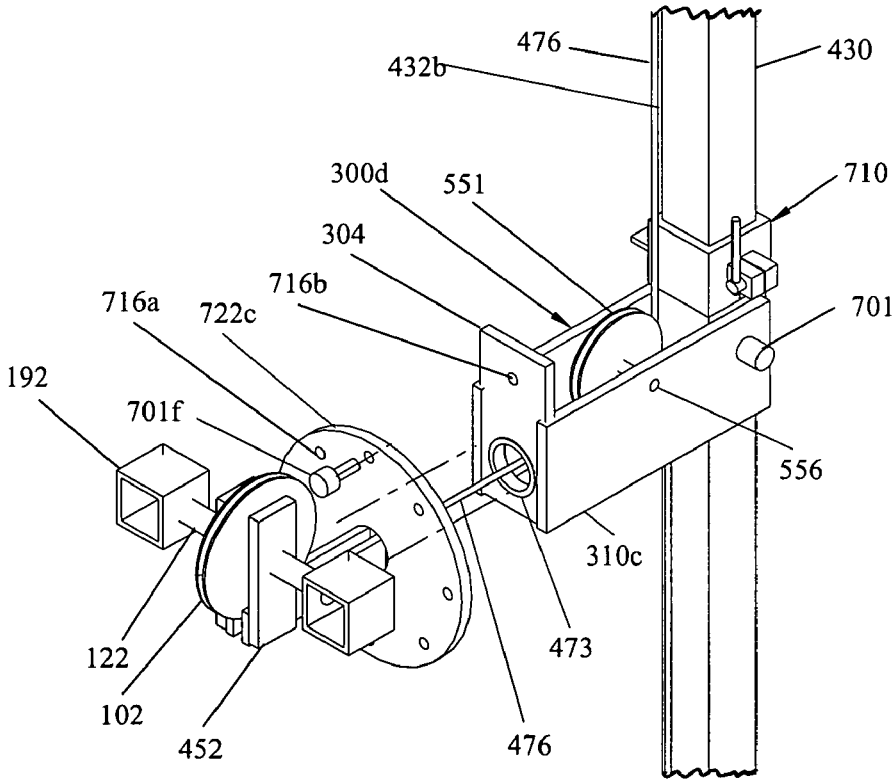
FIG. 6 shows and exploded detail of the kind of tube set used in FIGS. 5 and 6 to enable pivoting of the spool.

An exploded detail of the embodiment of the pivoting apparatus used in FIG. 5 (and similar to the one used in FIG. 4) is shown in FIG. 6. Here it can be seen that the carriage extension plate 304 of FIG. 5 rotatably supports a pivot ring 473 to which the spool support arms 452 are attached (in the embodiment shown in FIG. 4, the circular plate 722*b* rotatably supports the pivot ring 473). FIG. 6 also shows a hinged clamp 710 supporting the carriage 300 at various heights on the vertical rigid member 432*b* instead of the screw clamp 700 shown in FIGS. 4 and 5. The details of this kind of clamp are presented in the description of FIG. 32A-C later on in this specification.

FIG. 9 shows still another embodiment of the pivot on positioning axis feature. Here the frame adjacent section 310*b* is supported by a horizontal frame member 434 instead of the vertical rigid member 432 but it could of course be supported by a vertical rigid member. The frame adjacent section 310*b* can not be moved vertically. A rotating section 360*a*, which has a similar design to the rotating section 360 shown in FIG. 3 except that no tubes or rings are employed to facilitate pivoting on the positioning axis. Instead, the circular plate 722*a* supports the rotating section 360*a* but the circular plate 722*a* is itself supported by a flange 471. The flange 471 is attached to the horizontal frame member 434 and has a hole in flange 730. When one of the holes in plate 716*a* (visible in FIG. 9A) in the circular plate 722*a* is aligned with the hole in flange 730, the locking pin 701*e* is inserted to lock the angle of the rotating section 360*a* relative to the horizontal frame member 434. FIG. 9A shows a detail of the pivoting mechanism of FIG. 9 from the rear right side with the flange 471, the circular plate 722*a* and the locking pin 701*e* exploded forward from the horizontal frame member 434 to make the mechanism more visible.

FIG. 11-16—Alternative Carriage Positioning Approaches

Figure 11A:
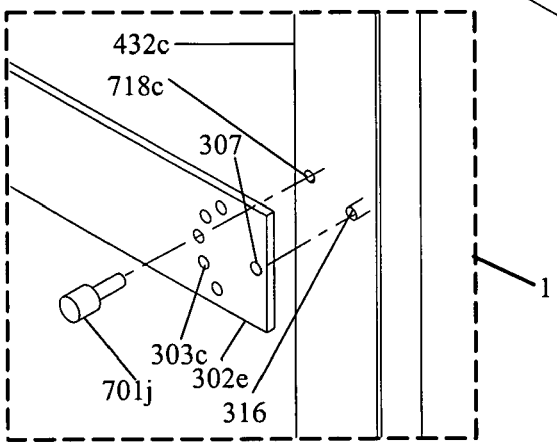

FIG. 11 shows the rear right perspective view of a simple alternative embodiment of the apparatus with the carriage 300*g* having one carriage wall 302*e*. Here the flexible connector 476 goes directly from the resistance pulley 492 of the resistance source 494 through a series of frame pulleys 558 to the carriage 300*g*, where the first end 478 of the flexible connector 476 connects directly to the spooling force transmitter 102 and the second end 479 of the flexible connector 476 is connected to the carriage wall 302*e*. The carriage 300*g* pivots on the horizontal axis pivoting mechanism 330*a*, placing the spooling force transmitter 102 at various heights. The carriage 300*g* can be locked at a particular angle (and the spooling force transmitter 102 at a particular height) by aligning the carriage wall hole 303*c* in the carriage wall 302*e* with the hole in frame 718*c* in the vertical rigid member 432*c* (visible in FIG. 11A) and inserting the locking pin 701*j*. The horizontal axis pivoting mechanism 330*a* comprises the pivot hole in carriage wall 307 in the carriage wall 302*e* and a horizontal pivot pin 316 mounted in the vertical rigid member 432*c*, the horizontal pivot pin 316 rotatably supporting the carriage 300*g* via this connection through the pivot hole in carriage wall 307.

FIG. 14 shows and exploded view of another embodiment of the apparatus with the one wall carriage design and spooling force transmitter 102 height adjustment via changes in the angle of the pivotable on horizontal axis section 320*a* relative to the frame adjacent section 310*e*. The frame adjacent section 310*e* has a carriage wall 302*a* that is attached to the vertical rigid member 432*b*, and the pivotable on horizontal axis section 320*a* has a carriage wall 302. The pivotable on horizontal axis section 320*a* is set at various angles relative to the frame adjacent section 310*e* by aligning the hole in carriage wall hole 303*n* in the carriage wall 302 of the pivotable on horizontal axis section 320*a* with one of the plurality of holes in carriage wall 303*e* in the carriage wall 302*a* of the frame adjacent section 310*e*. The mechanism for pivoting the spooling force transmitter 102 on its positioning axis is the same as the one shown in FIG. 1B, except that the fixed tube 454*e* is shorter and the angle of the rotating tube 456*e* relative to the fixed tube 454*e* is established by aligning one of a plurality of the holes in tube 725*i* in the rotating tube 456*e* (the holes in tube 725*i* not visible here but similar to the holes is tube 725*b* visible in FIG. 33A) with the hole in tube 725*a* in the fixed tube 454*e* and inserting the locking pin 701*m* in the holes so aligned.

FIG. 12 shows another alternative embodiment of the carriage 300*h* with spooling force transmitter 102 height adjustable through the carriage 300*h* angle relative to the horizontal frame member 434*a*. The carriage wall holes 303*d* in carriage wall 302*f* are used for angle adjustment. These carriage wall holes 303*d* are behind the combined horizontal pivot and pulley shaft 341 instead of in front of it (as they are in FIG. 11). There are two carriage walls 302*f* supporting the carriage pulley 551 through the combined horizontal pivot and pulley shaft 341, the pulley guiding the flexible connector 476 toward the spooling force transmitter 102. The carriage walls 302*f* are pivotably supported by horizontal pivot and pulley shaft 341, which also supports the carriage pulley 551. The angle of the carriage 300*h* relative to the horizontal frame member 434*a* is controlled by inserting a locking pin 701*k* through one of the series of holes in carriage wall 303*d* and into a hole in frame 718*d* (not visible here but aligned with locking pin 701*k* in the position shown).

FIG. 13 shows a detail of another embodiment of the apparatus having a carriage 300*i* in which it is shown that the rigid arm 390*b* can be connected to the spooling force transmitter 102 instead of the spool shaft 122 with a similar effect (the ability to turn the spooling force transmitter by applying force to the rigid arm). Here the rigid arm 390*b* is inserted into a sleeve-shaped rigid arm to spool connector 359. The rigid arm 390*b* has a hole in rigid arm 170 (not visible here but similar to the holes in rigid arm 170 visible in FIG. 1) and the rigid arm to spool connector 359 has two holes in sleeve 729 and 729*b*. Hole in sleeve 729 (not visible here) is proximal to the spool shaft 122 and large enough to permit the spool shaft 122 to pass through it, permitting the rigid arm to spool connector 359 to pivot about the spool shaft 122. The other hole in sleeve 729*b* (better seen in FIG. 13A) in the rigid arm to spool connector 359 is aligned with the hole in rigid arm 170 in the rigid arm 390*b* when the rigid arm 390*b* is inserted all the way into the rigid arm to spool connector 359. When these holes are aligned with one of a plurality of holes in spool 731 in the spooling force transmitter 102 the locking pin 701L can be inserted in the holes so aligned, locking the rigid arm 390*b* into place relative to the spooling force transmitter 102 at a selected angle and permitting the rigid arm 390*b* to apply force directly to the spooling force transmitter 102. This approach allows for the rigid arm 390*b* to be placed at various angles relative to the spooling force transmitter 102, but the rigid arm to spool connector 359 could simply have been attached to the spooling force transmitter 102, as is shown in FIG. 13A. Here the rigid arm 350*b* is inserted into a shorter spool connector 359*a* without a hole in sleeve 729 (having only a hole in sleeve 729*b*) that is attached directly to the spooling force transmitter 102. However, this simpler approach would not permit the angle of the 390*b* to be altered relative to the 102. The embodiment of the apparatus in FIG. 13 also shows the flexible connector 476 connected to the resistance source 494 through a standard winch 727. The winch serves the dual purpose of adjusting the length of the flexible connector 476 as the carriage 300*i* is raised and lowered, and assisting the user in raising and lowering the carriage.

FIG. 15 shows an embodiment of the apparatus similar to the one shown in FIG. 12 except that the carriage walls 302*h* are connected to a one piece frame adjacent section 310*f* instead of the horizontal frame member 434 and the carriage wall holes 303*f* in the carriage walls 302*h* are in front of the combined horizontal pivot and pulley shaft 341 instead of behind it.

FIG. 16 shows an embodiment of the apparatus similar to the one shown is FIG. 3. However, in the embodiment in FIG. 16 carriage walls 302 (of the type in FIG. 1) replace the carriage walls 302*c* in FIG. 3 and a set of added carriage walls 302*o* have a series of carriage wall holes 303*g*. When a carriage wall hole 303 (not visible here but visible in FIG. 1) in carriage wall 302 is aligned with one of the carriage wall holes 303*g* in the added carriage walls 302*o*, the locking pin 701*a* is inserted to lock the carriage walls 302 at a particular angle relative to the carriage walls 302*o*. This permits the spooling force transmitter 102 to be set at various heights.

FIGS. 29-32—Adjusting the Rigid Arm's Length

Figure 29:
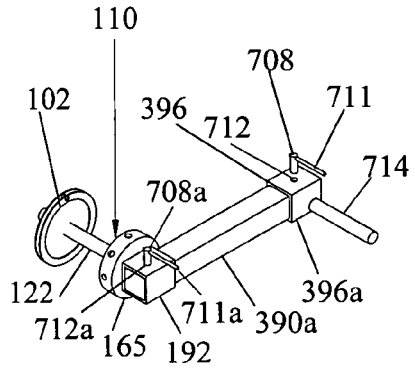

A variety of approaches can be used so that the effective length of the rigid arm 390 to which the user applies force can be adjusted. One method was already shown in FIG. 1, which depicts the handle sleeve 396 that can be placed at various points along the length of the rigid arm 390. A perspective view of a detail another embodiment of the apparatus is shown in FIG. 29. Here the detail of the rigid arm coupler 110, rigid arm 390*a*, spooling force transmitter 102 and spool shaft 122 are shown. A rigid arm sleeve 192 is placed between the rigid arm coupler 110 and the rigid arm 390*a*. The rigid arm sleeve 192 has the threaded hole 712 into which the bolt 708 is inserted and a turning force can be applied to a bolt handle 711 to tighten the bolt against the rigid arm 390*a*. When the bolt 708 is loose, the rigid arm 390*a* can then be moved within the rigid arm sleeve 192, varying the length of the rigid arm 390*a* on either side of the rigid arm sleeve 192. By tightening the bolt 708 against the rigid arm 390*a*, using the bolt handle 711, the position of the rigid arm 390*a* relative to the rigid arm sleeve 192 can be selected and fixed. The threaded hole 712, and the bolt 708 with the bolt handle 711 are also available in the handle sleeve 396*a* to permit the distance of the handle sleeve 396*a* from the spool shaft 122 to be adjusted by a simple tightening process.

Figure 30:
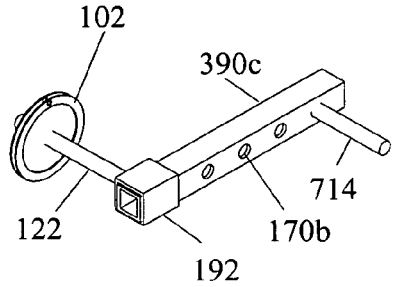

FIG. 30 shows an alternative structure which varies the effective length of a rigid arm 390*c*. Here the rigid user handle 714 can be placed at various points along the length of a rigid arm 390*c* by inserting it into one of a series of holes in rigid arm 170*b* that are placed a variety of points along the length of the rigid arm 390*c*.

Figure 31:
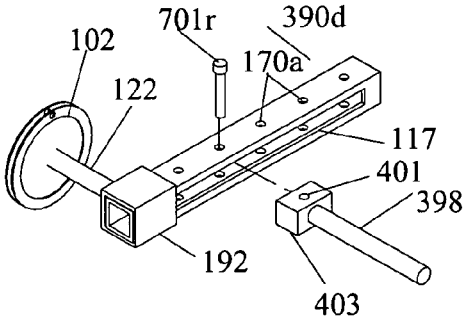

FIG. 31 shows another method for adjusting the effective length of a rigid arm 390*d*. Here an inside rigid arm handle 398 has a rectangular arm end 403 and a inside rigid arm hole 401. The rectangular arm end 403 is placed in a slot in rigid arm 189 of a rigid arm 390*d* and the inside rigid arm hole 401 is aligned with one of a series of holes in rigid arm 170*a*. The locking pin 701*r* is inserted into the holes so aligned to lock the inside rigid arm handle 398 in place.

Figure 32A:
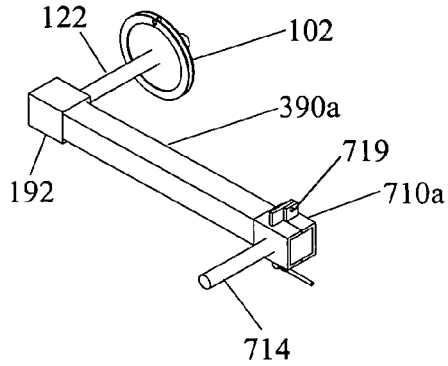
Figure 32B:
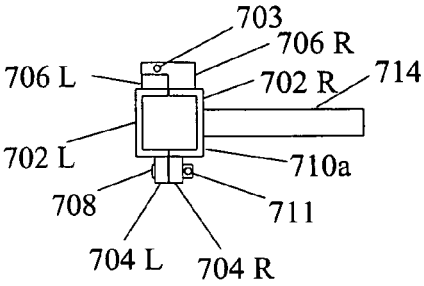
Figure 32C:
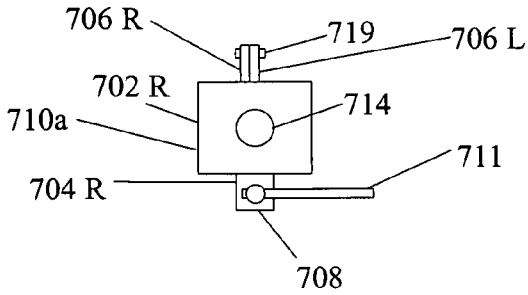

FIG. 32A shows a front left side view of another embodiment of the apparatus which permits the effective length of the rigid arm 390*a* to be selected by the user. Here the rigid user handle 714 is attached to the hinged clamp 710*a* having a pivot pin 719. The hinged clamp 710 can be clamped at various points along the rigid arm 390*a*. FIG. 32B shows a detailed front view of the hinged clamp 710*a* with the pivot pin 719 removed. FIG. 32C shows a detailed right side view of the hinged clamp 710*a* and the rigid user handle 714. The hinged clamp 710*a* has a left clamp side 702L and a right clamp side 702R. The left clamp side 702L has a left lower clamp extension 704L and a left upper clamp extension 706L, and the right clamp side 702R has a right lower clamp extension 704R and a right upper clamp extension 706R. The right upper clamp extension 706R and the left upper clamp extension 706L each have a hole in extension 703 through which through which the pivot pin 719 is inserted, enabling the right clamp side 702R and the left clamp side 702L to pivot on the pivot pin 719. The left lower clamp extension 704L and the right lower clamp extension 704R each have a threaded hole in extension 705 (not visible but through which bolt 708 has been threaded). The threaded holes in extension 705 are aligned so that the bolt 708 can be inserted and turned by applying force to the bolt handle 711. When the bolt 708 is tightened, the left clamp side 702L and the right clamp side 702R are tightened against the rigid arm 390*a*, locking the rigid user handle 714 into place at a chosen point along the arm.

FIGS. 34-36—Alternative Angle Locking Mechanisms

FIG. 33 shows an angle locking mechanism 200, for locking the angles of the fixed tube 454*g* and the rotating tube 456*g* into place relative to one another, but there are many other approaches to tube angle locking that can be used with various embodiments of the apparatus. For instance, FIG. 34 shows a detail of a pivoting angle-locking clamp 251. The pivoting angle-locking clamp 251 has a large clamp ring 252 affixed to the fixed tube 454*a*. When the bolt 708 on the pivoting angle-locking clamp 251 is tightened by applying force to the bolt handle 711, the clamp is tightened against the rotating tube 456*a* to lock that tube into place relative to the fixed tube 454*a*.

Figure 34A:
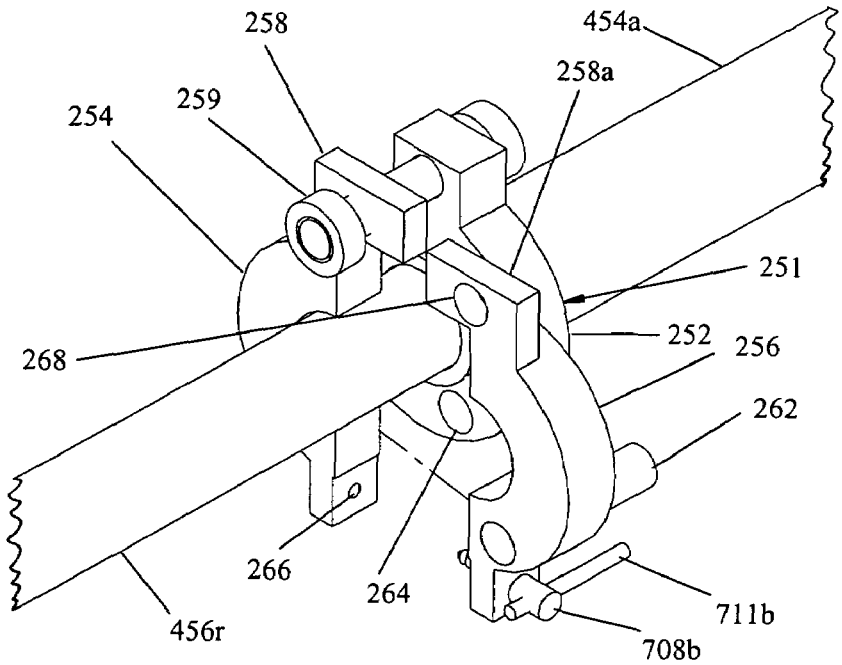

FIG. 34A shows an exploded detail of the pivoting angle-locking clamp 251 with a right clamp ring 256 exploded out to the right. Here it can be seen that connected to the large clamp ring 252 is a clamp ring pivot 259. There is a left clamp ring 254 having an upper clamp extension 258, along with the right clamp ring 256, having an upper clamp extension 258*a*, each having a clamp pivot hole 268 which enables the left clamp ring 254 and the right clamp ring 256 to be rotatably connected to clamp ring pivot 259. The upper clamp extensions 258 and 258*a* are offset relative to each other (i.e., upper clamp extension 258 is on the rear of the left clamp ring 254 and upper clamp extension 258*a* is on the front of the right clamp ring 256). This enables the left clamp ring 254 and the right clamp ring 256 to pivot around the clamp ring pivot 259 without the upper clamp extensions 258 and 258*a*, contacting each other. The right clamp ring 256 is attached to a ring constraint 262 that fits into a hole for constraint pin 264 in the large clamp ring 252, fixing its position of the ring constraint 262 relative to the large clamp ring 252. The left clamp ring 254 and the right clamp ring 256 each have a threaded bolt hole 266 (the threaded bolt hole 266 in the right clamp ring 256 not visible) into which the bolt 708 is placed. The bolt 708 can be turned by applying force to the bolt handle 711. When the bolt 708 is turned, it draws the left clamp ring 254 and the right clamp ring 256 toward each other, applying pressure to the rotating tube 456*a* to lock it in place relative to the fixed tube 454*a*.

FIG. 35 shows another of the many possible mechanisms for controlling the angle of tubes relative to one another, in this case a worm gear angle adjustor 250. FIG. 35A shows a detail of the worm gear angle adjustor 250. The worm gear angle adjustor 250 has a worm gear 246 which interlocks with a worm gear screw 244. The worm gear screw 244 is supported by a worm gear bracket 242 that is attached to the fixed tube 454*j*. A bracket extension 238 is attached to the worm gear bracket 242 and rotatably supports the worm gear screw 244. A pair of worm gear screw-rings 241 keep a worm gear screw head 249 of the worm gear screw 244 from translating while permitting the worm gear screw 244 to be turned freely when force is applied to a worm gear screw-handle 248.

FIG. 36 shows another method for locking the tubes at a given angle relative to one another. Here the fixed tube 454*k* has the threaded hole 712 into which the bolt 708 is inserted. By applying force the bolt handle 711, the bolt 708 can be turned to apply pressure to the rotating tube 456*k*, locking that tube into place relative to the fixed tube 454*k*.

FIGS. 37 and 37A—Alternative Counterweighting Mechanisms

FIG. 37 shows the exploded detail of an additional embodiment of the counterweight mechanism introduced in FIG. 1. Here the counterweighted rigid arm 410 has a sliding counterweight 408 whose position is controlled by the locking pin 701*s* being inserted through a counterweight hole 412 and into a 170 in the rigid arm 390*e*.

FIG. 37A shows another embodiment of the counterweighted rigid arm 410*b* in which an inside counterweight arm 404 slides within the rigid arm 390*f*. The inside counterweight arm 404 has a series of holes in rigid arm 170*c* and the rigid arm 390*f* has a corresponding series of holes in rigid arm 170. When a selected hole is rigid arm 170*c* in the inside counterweight arm 404 is aligned with a selected hole in rigid arm 170 in the rigid arm 390*f* and the locking pin 701*aa* is inserted through both holes, the inside counterweight arm 404 is locked into place in relation with the rigid arm 390*f* and the position of a counterweight on sliding arm 406 is similarly locked into place relative to the rigid arm 390*f*.

FIGS. 38-46—Detaching the Rigid Arm from the Spool Shaft

FIGS. 1 and 8 show one kind of mechanism (rigid arm coupler 110) for connecting the rigid arm 390 with the spool shaft 122 at various angles about the spooling force transmitter's 102 rotational axis. However, while that kind of connector permits the rigid arm 390 and spool shaft 122 to be disengaged from one another (i.e., if the locking pin 701*c* is removed from the rigid arm coupler 110 the rigid arm 390 can be turned without turning the spooling force transmitter 102 or spool shaft 122), the connection does not permit the complete detachment of the rigid arm 390 from the apparatus, such detachment being desirable for the performance of a number of exercises. FIGS. 38 through 44 and 46 show mechanisms which do permit detachment of the rigid arm 390 but provide control in setting the angle of the rigid arm 390*a* relative to the rotational axis 734 of the spooling force transmitter 102 when the rigid arm 390*a* is attached. FIG. 45 shows an example of a connector that permits detachment of the rigid arm 390*a* from the apparatus but does not afford selectability in terms of the angle of the rigid arm 390*a* relative to the rotational axis of the spooling force transmitter 102 when the rigid arm 390*a* is attached.

Figure 38:
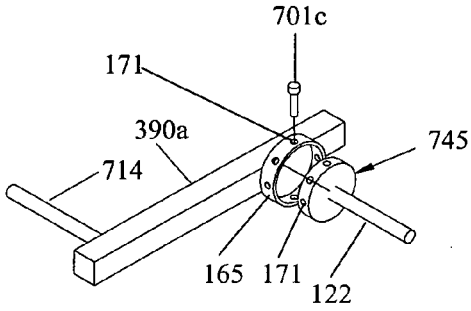

FIG. 38 shows a decoupling mechanism 745 similar in structure to the rigid arm coupler 110 that is shown in FIG. 8, but here the curved receptacle base 166 is removed from the curved receptacle 165 and the locking pin 701*c* is relied upon to both prevent the translation of the curved shaft end 106 relative to the curved receptacle 165 and to select the angle of the curved receptacle 165 relative to the curved shaft end 106 (when holes perpendicular to spool shaft 171 in the curved shaft end 106 and the curved receptacle 165 are aligned. With the locking pin 701*c* removed, the rigid arm 390*a* can be detached from the apparatus. Though not shown in a number of the embodiments that follow, a pin can be added to the attachments in a similar way to prevent their translation of the coupling elements relative to one another.

Figure 39:
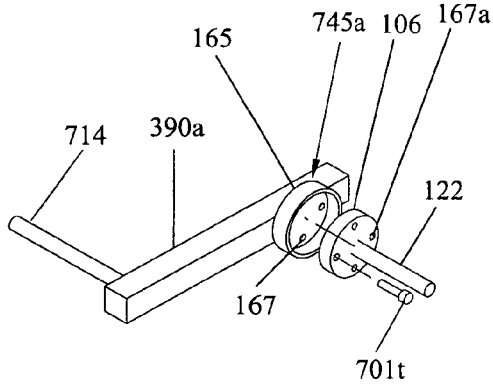

FIG. 39 shows a decoupling mechanism 745*a* with a structure similar to the one used in FIG. 38 but instead of the holes used to lock the curved shaft end 106 and curved receptacle 165 in place relative one another being perpendicular to the longitudinal axis of the spool shaft 122 (as the holes perpendicular to spool shaft 171 of FIG. 38 are), here the curved shaft end 106 and curved receptacle 165 are locked into place relative to one another by aligning one of a series of holes parallel to spool shaft 167 in the curved shaft end 106 with one of a series of holes parallel to spool shaft 167 in curved receptacle 165 and inserting the locking pin 701*t* in the holes so aligned.

Figure 40:
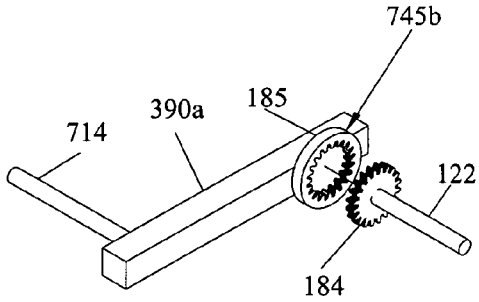

FIG. 40 shows a decoupling mechanism 745*b* in which there is a gear receptacle 185 attached to the rigid arm 390*a* and a connection gear 184 attached to the spool shaft 122. The shape of the connection gear 184 and the gear receptacle 185 permit the rigid arm 390*a* to be placed at various angles around the rotational axis of the spool shaft 122 (an hence the rotational axis of the spooling force transmitter 102).

Figure 41:
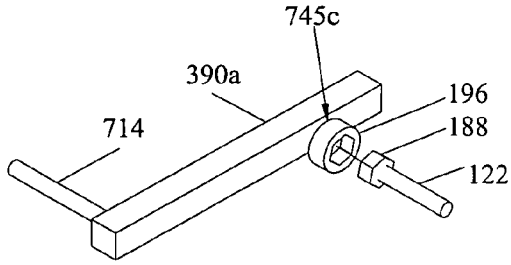

FIG. 41 shows decoupling mechanism 745*c* in which a flat inner side receptacle 196 is attached to the rigid arm 390*a* and a flat sided shaft end 188 is attached to the spool shaft 122. The relative shapes of the flat inner side receptacle 196 and flat sided shaft end 188 permit the flat sided shaft end 188 to be inserted into the flat inner side receptacle 196 at various angles.

Figure 42A:
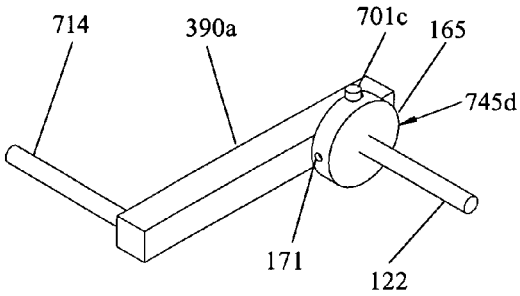
Figure 42B:
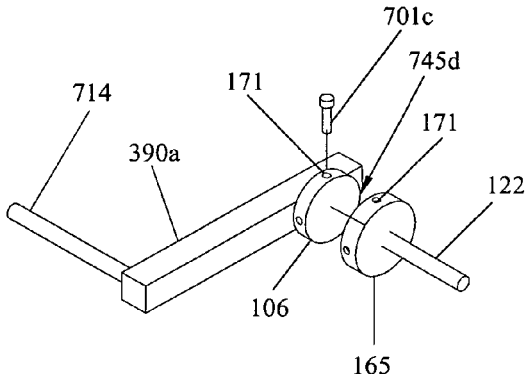

FIGS. 42A and 42B show a decoupling mechanism 745*d*. Here the curved receptacle 165 is mounted on the spool shaft 122 and the curved shaft end 106 is mounted on the rigid arm 390*a*. They are engaged in the same way as the apparatus in FIG. 38 using locking pin 701*c*.

Figure 43:
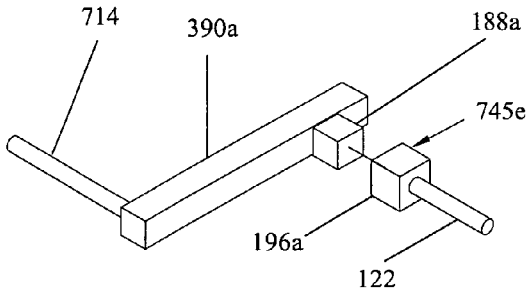

In FIG. 43, decoupling mechanism 745*e* is shown. Here the flat sided end 188*a* is mounted on the rigid arm 390*a* and the flat inner side receptacle 196*a* on the spool shaft 122 for interlocking when the flat inner side receptacle 196*a* is placed over the flat sided end 188*a*.

Figure 44:
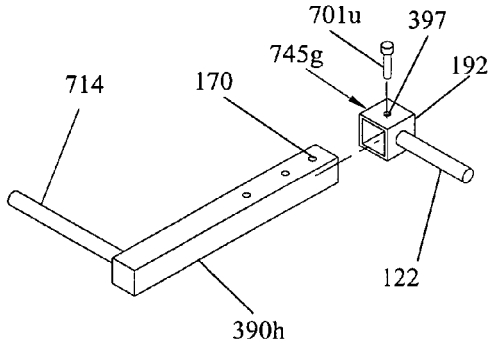
Figure 45:
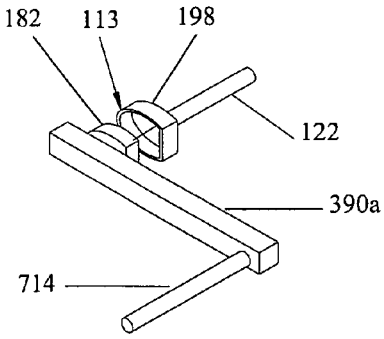

In FIG. 44, decoupling mechanism 745*g* is shown. Here the rigid arm sleeve 192 with the hole in sleeve handle 397 fits over the rigid arm 390*h* and can be placed at various positions along its length, the rigid arm sleeve 192 connected to the spool shaft 122 (not visible here) for turning the spooling force transmitter 102. When the hole in tube 397 is aligned with one of the holes in rigid arm 170 in the rigid arm 390*h* the locking pin 701*u* is inserted in the holes so aligned to lock the rigid arm sleeve 192 in place at a selected point on the rigid arm 390*h*.

Figure 46:
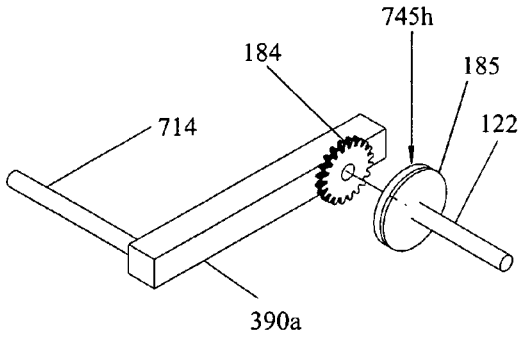

In FIG. 46, decoupling mechanism 745*h* is shown. Here the gear receptacle 185 is attached to the spool shaft 122 and the connection gear 184 is attached to the rigid arm 390*a*. They interlock in the same way as in decoupling mechanism 745*b* in FIG. 40.

In FIG. 45 a curved and flat end 182 is attached to the rigid arm 390*a* and a curved and flat receptacle 198 is attached to the spool shaft 122. The shape of the curved and flat end 182 and curved and flat receptacle 198 permit the attachment to occur at only one angle of the rigid arm 390*a* relative to the spool shaft 122 but the 390*a* can be disconnected from the 122 using this mechanism.

FIGS. 50 and 57-60—Converting the Spool to a Pulley

It is possible to convert the apparatus as shown so far from one which supports a spooling or a translating force transmitter to one which supports a spooling force transmitter that can be used as a pulley as well, using a version of the spooling force transmitter 102 to which a flexible connector coupler 120 has been added. An overview of this is shown is FIG. 50, where a user handle 108 is attached to the flexible connector 476 and the flexible connector is pulled around the spool rim 126 instead of being attached to the spooling force transmitter 102. However, to make this approach convenient for the user, a simple method for disconnecting the flexible connector 476 from the spooling force transmitter 102 must be offered (the rigid arm 390 also needs to be disconnected from the spooling force transmitter 102 but several methods for doing that have already been shown).

Figure 57:
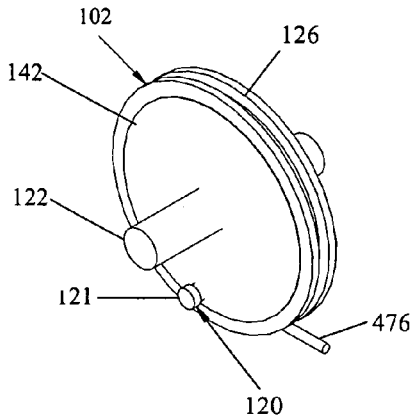
Figure 58:
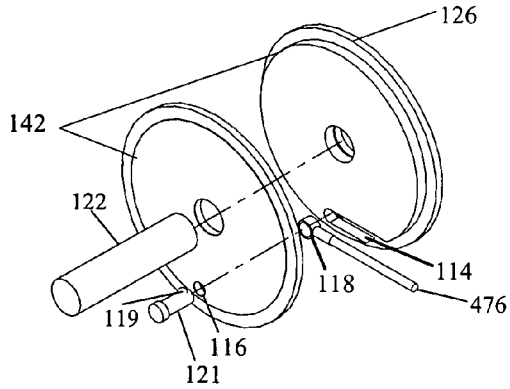
Figure 59:
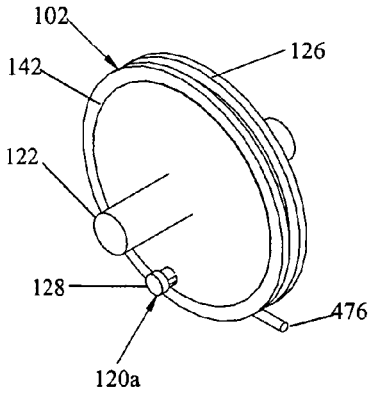
Figure 60:
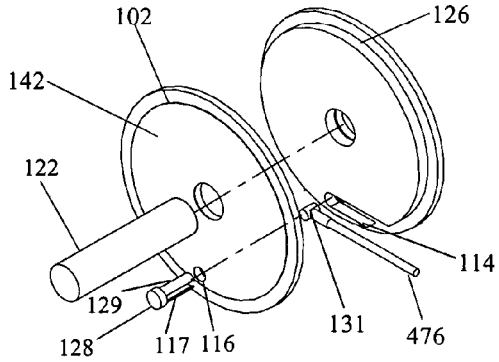

The detail of one approach for easy attachment and detachment of the flexible connector 476 from the spooling force transmitter 102 is shown in FIG. 57 and FIG. 58 (which is an exploded view of the mechanism in FIG. 57). Here the flexible connector 476 is attached to the spooling force transmitter 102 using a flexible connector coupler 120 comprising an end ring locking pin 121 that is inserted through a spool wall hole 116 in a spool wall 142 of the spooling force transmitter 102 and through an end ring 118 (FIG. 58), which is attached to the flexible connector 476. The end ring 118 is inserted into a deep recess 114 in the spool wall 142 until it is aligned with a spool wall hole 116. Once the end ring 118 and spool wall hole 116 are so aligned, the end ring locking pin 121 is inserted through both the holes locking the flexible connector 476 into place within spooling force transmitter 102. The end ring locking pin 121 has a standard spring loaded ball 119. The spring loaded ball 119 can be depressed until it is pushed all the way through spool wall 142. Once the spring loaded ball 119 extends beyond the spool wall 142 it is released, helping to hold the end ring locking pin 121 within the spool wall 142. The process is reversed when the user wants to remove the attachment and use the apparatus as a pulley, attaching the flexible connector 476 to the user handle 108 instead of the spooling force transmitter 102.

There are a variety of other ways to permit the connector to be conveniently attached to, and detached from, the spooling force transmitter 102. For example, FIGS. 59 and 60 (which is an exploded view of the mechanism in FIG. 59) show a flexible connector coupler 120*a* comprising a retaining sleeve head 128 and a retaining sleeve 129 with a slot in sleeve 117. The flexible connector coupler 120*a* inserts into the spool wall hole 116, across an end cylinder 131, which is attached to the flexible connector 476 and then travels through the rest of spool wall hole 116, locking the connector into place within the spool wall. The end cylinder 131 includes a pivot so that the cylinder can rotate relative to the flexible connector 476. Other attachments to the flexible connector 476 could serve a similar purpose, such as an attachment mechanism with a spherical shape, so that changing the position of the spooling force transmitter 102 around its positioning axis won't twist the flexible connector 476.

FIGS. 61-64—Improving Exercise Variety Using Additional Elements

The number and nature of the exercises that can be performed with various embodiments of the apparatus can be increased when the apparatus is selectively used with a bench. There are many varieties of bench currently in use, and many to be developed in the future, which can be used in conjunction with the apparatus. Just two examples are presented here. In FIG. 61, the user represented by a tubular figure 666 sits on an upright bench 668 and presses against the rigid user handle 714*a* attached to the rigid arm sleeve 192. This causes the translating force transmitter 101*d* to translate (the operation of this mechanism was discussed earlier). The user is shown is performing a seated bench press exercise.

FIG. 62 shows a user tubular figure 666 sitting on a more conventional bench 652 with the rigid user handle 714 placed in front of his/her lower legs 656. Here the user applies force to the rigid user handle 714 to perform the standard leg extension exercise. Locking pin 701*y* has been inserted into hole in carriage wall hole 303*m* (not visible here but visible in FIG. 64) and holes in fixed tube 454*f* and translating force transmitter 101*d* (not visible here but aligned with hole in carriage wall 303*m*) to prevent the translation of the translating force transmitter 101*d* while spooling force transmitter 102 is turned by the force being applied to rigid user handle 714.

Various embodiments of the apparatus can be used to duplicate many motions that are employed in sports events. FIG. 63 shows a stick figure user 664 grasping a baseball bat implement 662 attached to the rigid user handle 714 to simulate a bat swing. FIG. 64 shows the stick figure user 664 grasping a golf implement 654 rotatably attached to the rigid user handle 714 to simulate a golf swing.

The rigid user handle 714 can of course assume a vast number of other positions relative to the user and many other kinds of implements can be attached to the rigid user handle 714 to duplicate many other forms of sports, such as a dummy to simulate throws in wrestling and judo.

Advantages

From the description above, a number of advantages of my apparatus become evident:

(a) One machine can be used for a wide variety of rotational exercises.

(b) One machine can closely fit the needs of users of almost any physical size.

(c) One machine can be used for both linear and rotational exercises, instead of requiring separate machines to perform these functions.

(d) In addition to saving the time and expense of purchasing and maintaining multiple machines, the user saves space, which is often even more important (e) A sheave designed in the manner described permits a rotational motion of as much as 360 degrees or even multiples of 360 degrees. This allows the user a much wider choice in terms of range of motion than is normally available.

(f) When employing this apparatus for a rotational motion, the resistance experienced is essentially the same (disregarding any inertia at the start) throughout the range of motion selected, instead of changing over time, as is the case when the angle of the resistance changes relative to the angle of the lever arm being rotated (as is the case for many existing exercise devices).

(g) The inclusion of a mechanism which permits the positioning of the spool at any angle about flexible connector's longitudinal axis immediately contacts the spool permits the user to select from an previously unavailable range of exercise angles and the to fix the chosen angle for the duration of the exercise bout.

(h) The angle maintenance mechanism permits the user to maintain the angle of the pulley spool regardless of the way in which the carriage moves around the vertical axis and is particularly useful when the user wishes to employ two carriages simultaneously, one for each arm or leg.

(i) The combination of available translating elements, rotating spools and pulleys permits guided linear or rotational motion for exercises in which that is preferred but freer pulley resistance where that is preferred.

CONCLUSION, RAMIFICATIONS, AND SCOPE

Accordingly, the reader will see that the ability to adjust resistance height and angle, the arc size and plane of rotational motions, counterweight positioning, and even, through certain embodiments, to use the spool as a pulley which can be set at any angle, and to employ guided linear motion can afford the user a much wider range of choices and applications than existing exercise machines and it can do so through essentially one exercise station instead of multiple stations. Convenience, as well as time, money and space saved can all be enjoyed by the user, but any of these advantages or others would make such an apparatus of significant value.

Although the above description contains many specificities, these should not be construed as limiting the scope of the invention but as merely providing illustrations of some of the presently preferred embodiments of this invention. For example, While the sheave spooling force transmitter 102 shown thus far has been approximately the same diameter as the pulleys shown, it can easily be significantly larger or smaller in diameter. It can also be wider and/or have deeper to walls, to permit multiple turns of the flexible connector 138 around it and have a variety of shapes such as that of a cam or an ellipse.

Also, the flexible connector can be attached directly to the resistance source and a winch placed between the user and resistance could be used to adjust the length of the available flexible connector and raise the carriage, eliminating the need for many of the redirecting pulleys of the embodiments already discussed and helping to lift the carriage to an appropriate height. Similarly, implements that are added to the flexible connector end or crank handle could include padded dummies (e.g., to simulate the human body or any part of it) to permit the user to practice judo and wrestling throws. Accordingly, the spirit and scope of the appended claims should not be limited to the descriptions of the preferred embodiments contained but should be determined by the appended claims and their legal equivalents.

Accordingly, the spirit and scope of the appended claims should not be limited to the descriptions of the preferred embodiments contained but should be determined by the appended claims and their legal equivalents.

The reader's attention is directed to all papers and documents which are filed concurrently with this specification and which are open to public inspection with this specification, and the contents of all such papers and documents are incorporated herein by reference. All the features disclosed in this specification (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means for performing" a specified function, or "step for" performing a specific function, is not to be interpreted as a "means" or "step" clause is specified in 35 U.S.C. § 112 ¶6. In particular, the use of "step of" in the claims herein is not intended to invoke the provisions of 35 U.S.C. § 112 ¶6.

What is claimed is:

1. An exercise apparatus, comprising:

(a) at least one frame;

(b) at least one translating force transmitter movably connected to the frame;

(c) at least one spooling force transmitter having a spool rim and rotational axis, the spooling force transmitter movably connected to the frame;

(d) at least one resistance source;

(e) a flexible connector, the flexible connector connected to the resistance source and to both the spooling force transmitter, and, the translating force transmitter;

(f) at least one carriage mounted on the frame and supporting the spooling force transmitter such that the spooling force transmitter can pivot on its rotational axis, the carriage further supporting the spooling force transmitter to revolve around a positioning axis that is substantially coincident with the flexible connector's longitudinal axis as it passes through the carriage, the rotational axis being offset from the positioning axis such that the axes do not intersect; and (g) at least one rigid arm connected to at least one of the following elements of the apparatus: 1) the spooling force transmitter, and, 2) the translating force transmitter, the arm adapted to receive an exercise force generated by a user, the resistance force and the exercise force placing opposing forces on the force transmitter to which it is connected.

2. The apparatus in claim 1, wherein the rotational axis is offset from the positioning axis by a distance approximately equal to a radius of the spooling force transmitter.

3. An exercise apparatus, comprising:

(a) at least one frame;

(b) at least one spooling force transmitter having a spool rim and a rotational axis;

(c) at least one flexible connector having a longitudinal axis, a first end and a second end, the first end of the connector attached to the spooling force transmitter such that the connector contacts the spool rim;

(d) at least one carriage mounted on the frame and supporting the spooling force transmitter such that the spooling force transmitter can pivot on its rotational axis, the carriage further supporting the spooling force transmitter to revolve around a positioning axis that is substantially coincident with the flexible connector's longitudinal axis as it passes through the carriage, the rotational axis being offset from the positioning axis such that the axes do not intersect;

(e) at least one resistance source applying tension to the flexible connector, whereby a resistance force is transmitted by the flexible connector to the spooling force transmitter;

(f) at least one rigid arm connected to the spooling force transmitter and adapted to receive an exercise force generated by a user, the resistance force and the exercise force placing opposing torques on the spooling force transmitter; and (g) at least one rigid arm coupler connecting the rigid arm to the spooling force transmitter which permits the user to select a starting angle of the rigid arm about the rotational axis of the spooling force transmitter.

4. The apparatus in claim 3, wherein the rotational axis is offset from the positioning axis by a distance approximately equal to a radius of the spooling force transmitter.

5. An exercise apparatus, comprising:

(a) at least one frame;

(b) at least one spooling force transmitter having a spool rim and a rotational axis;

(c) at least one flexible connector having a longitudinal axis, a first end and a second end, the first end of the connector attached to the spooling force transmitter such that the connector contacts the spool rim;

(d) at least one carriage mounted on the frame and supporting the spooling force transmitter such that the spooling force transmitter can pivot on its rotational axis, the carriage further supporting the spooling force transmitter to revolve around a positioning axis that is substantially coincident with the flexible connector's longitudinal axis as it passes through the carriage, the rotational axis being offset from the positioning axis such that the axes do not intersect;

(e) at least one resistance source applying tension to the flexible connector, whereby a resistance force is transmitted by the flexible connector to the spooling force transmitter;

(f) at least one rigid arm connected to the spooling force transmitter and adapted to receive an exercise force generated by a user, the resistance force and the exercise force placing opposing torques on the spooling force transmitter;

(g) at least one angle locking mechanism for locking the spooling force transmitter at a selected angle around its positioning axis; and (h) at least one rigid arm coupler which permits the user to select a starting angle of the rigid arm about the rotational axis of the spooling force transmitter.

6. An exercise apparatus, comprising:

(a) at least one spooling force transmitter having a spool rim and a rotational axis;

(b) at least one first flexible connector having a longitudinal axis, a first end and a second end, the first end of the connector attached to the spooling force transmitter such that the connector contacts the spool rim;

(c) at least one frame;

(d) at least one carriage mounted on the frame and supporting the spooling force transmitter such that the spooling force transmitter can pivot on its rotational axis, the carriage further supporting the spooling force transmitter to revolve around a positioning axis that is substantially coincident with the flexible connector's longitudinal axis as it passes through the carriage, the rotational axis being offset from the positioning axis such that the axes do not intersect;

(e) at least one resistance source applying tension to the flexible connector, whereby a resistance force is transmitted by the flexible connector to the spooling force transmitter;

(f) at least one angle locking mechanism for locking the spooling force transmitter at a selected angle around its positioning axis; and (g) at least one rigid arm connected to the spooling force transmitter and adapted to receive an exercise force generated by a user, the resistance force and the exercise force placing opposing torques on the spooling force transmitter.

7. An exercise apparatus, comprising:

(a) at least one spooling force transmitter having a spool rim and a rotational axis;

(b) at least one flexible connector having a longitudinal axis, a first end and a second end, the first end of the connector attached to the spooling force transmitter such that the connector contacts the spool rim;

(c) at least one frame;

(d) at least one carriage movably mounted on the frame for positioning the spooling force transmitter at a plurality of heights, the carriage supporting the spooling force transmitter such that the spooling force transmitter can pivot on its rotational axis, the carriage further supporting the spooling force transmitter to revolve around a positioning axis that is substantially coincident with the flexible connector's longitudinal axis as it passes through the carriage, the rotational axis being offset from the positioning axis such that the axes do not intersect;

(e) at least one resistance source applying tension to the flexible connector, whereby a resistance force is transmitted by the flexible connector to the spooling force transmitter;

(f) at least one angle locking mechanism for locking the spooling force transmitter at a selected angle around its positioning axis; and (g) at least one rigid arm connected to the spooling force transmitter and adapted to receive an exercise force generated by a user, the resistance force and the exercise force placing opposing torques on the spooling force transmitter.

8. An exercise apparatus comprising:

(a) at least one spooling force transmitter having a spool rim and a rotational axis;

(b) at least one flexible connector having a longitudinal axis, a first end and a second end, the first end of the connector attached to the spooling force transmitter such that the connector contacts the spool rim;

(c) at least one frame comprising at least one substantially vertical rigid member;

(d) at least one carriage lockable on the vertical rigid member of the frame at a plurality of heights, the carriage supporting the spooling force transmitter such that the spooling force transmitter can pivot on its rotational axis, the carriage further supporting the spooling force transmitter to revolve around a positioning axis that is substantially coincident with the flexible connector's longitudinal axis as it passes through the carriage, the rotational axis being offset from the positioning axis such that the axes do not intersect;

(e) at least one resistance source applying tension to the flexible connector, whereby a resistance force is transmitted by the flexible connector to the spooling force transmitter;

(f) at least one angle locking mechanism for locking the spooling force transmitter at a selected angle around its positioning axis; and (g) at least one rigid arm connected to the spooling force transmitter and adapted to receive an exercise force generated by a user, the resistance force and the exercise force placing opposing torques on the spooling force transmitter.

9. The apparatus in claim 8, further comprising at least one carriage stabilization plate, at least one rotating tube and at least one stabilizer arm, the stabilizer arm connected to the rotating tube and to the carriage stabilization plate.

10. The apparatus in claim 8, further comprising at least one vertical axis pivot mechanism which creates within the carriage a section that pivots about a vertical axis that can be positioned at a plurality of angles relative to the frame adjacent carriage section around a vertical axis.

11. The apparatus in claim 10, wherein the carriage further comprises a redirection assembly added to the carriage, the redirection assembly comprising:

(a) at least one redirecting pulley having a pulley rim, and a pulley shaft;

(b) at least one redirecting pulley support pivotably supported by the carriage, said redirecting pulley support rotatably supporting the redirecting pulley, (c) at least one tube support pivotably supported by the pulley shaft and supporting the spooling force transmitter;

(d) at least one redirecting tube set comprising a fixed tube having a longitudinal axis and supported by the carriage, and, a rotating tube having a longitudinal axis shared with the longitudinal axis of the fixed tube, the rotating tube mounted to the fixed tube for rotation relative to the fixed tube about their shared longitudinal axis, the rotating tube supporting the redirecting pulley support, the flexible connector passing through the redirecting tube set around a section of the pulley rim of the redirecting pulley to be tangentially received by the spooling force transmitter; and (e) at least one angle locking mechanism for locking the rotating tube in a plurality of positions relative to the fixed tube.

12. The apparatus in claim 11, further comprising a frame adjacent section having at least one carriage wall and a constraint mechanism that constrains the movement of the spooling force transmitter's positioning axis such that the axis remains parallel to the carriage wall of the frame adjacent section as the section that pivots about a vertical axis pivots through a plurality of angles about the vertical axis through the vertical axis pivot mechanism.

13. An exercise apparatus, comprising:

(a) at least one frame having an essentially vertical member;

(b) at least one translating force transmitter;

(c) at least one flexible connector having a longitudinal axis, a first and a second end, at least the first end of which is connected to the translating force transmitter such that when a force is applied to the force transmitter the transmitter applies tension to the flexible connector;

(d) at least one resistance source applying tension to the flexible connector, whereby a resistance force is transmitted by the flexible connector to the translating force transmitter;

(e) at least one carriage having a longitudinal axis and adapted to translatably support the translating force transmitter such that the transmitter translates in a direction parallel to the longitudinal axis of the carriage, the carriage having a frame adjacent section and a section that pivots about a horizontal axis, the frame adjacent section lockable along the vertical rigid member at a plurality of heights and the pivotable section movable on a horizontal axis pivot mechanism and lockable at a plurality of angles relative to the frame adjacent section; and (f) at least one rigid arm connected to the translating force transmitter and adapted to receive an exercise force generated by a user, the resistance force and the exercise force placing opposing forces on the force transmitter.

14. The apparatus in claim 13, wherein the carriage further comprises at least one carriage section supporting a spooling force transmitter and adapted to be positioned at a plurality of angles relative to the frame.

15. An exercise apparatus comprising:

(a) at least one spooling force transmitter having a spool rim and a rotational axis;

(b) at least one flexible connector having a longitudinal axis, a first end and a second end, the first end of the connector attached to the spooling force transmitter such that the connector contacts the spool rim;

(c) at least one frame comprising at least one substantially vertical rigid member;

(d) at least one carriage having a longitudinal axis, a frame adjacent section and a section that pivots about a horizontal axis, the frame adjacent section lockable along the vertical rigid member at a plurality of heights and the pivotable section movable on a horizontal axis pivot mechanism and lockable at a plurality of angles relative to the frame adjacent section, the carriage supporting the spooling force transmitter such that the spooling force transmitter can pivot on its rotational axis, the carriage adapted to enable the spooling force transmitter to revolve around a positioning axis that is substantially coincident with the flexible connector's longitudinal axis as it passes through the pivotable section of the carriage, the rotational axis being offset from the positioning axis such that the axes do not intersect;

(e) at least one resistance source applying tension to the flexible connector, whereby a resistance force is transmitted by the flexible connector to the spooling force transmitter; and (f) at least one rigid arm connected to the spooling force transmitter and adapted to receive an exercise force generated by a user, the resistance force and the exercise force placing opposing torques on the spooling force transmitter.

16. An exercise apparatus comprising:

(a) at least one spooling force transmitter having a spool rim and a rotational axis;

(b) at least one flexible connector having a longitudinal axis, a first end and a second end, the first end of the connector attached to the spooling force transmitter such that the connector contacts the spool rim;

(c) at least one frame comprising at least one substantially vertical rigid member;

(d) at least one carriage having a longitudinal axis, a frame adjacent section having a section that pivots about a horizontal axis, the frame adjacent section lockable along the vertical rigid member at a plurality of heights and the pivotable section movable on a horizontal pivot mechanism and lockable at a plurality of angles relative to the frame adjacent section, the carriage supporting the spooling force transmitter such that the spooling force transmitter can pivot on its rotational axis and revolve around a positioning axis that is coincident with the flexible connector's longitudinal axis as it passes through the pivotable section of the carriage, the rotational axis being offset from the positioning axis such that the axes do not intersect;

(e) at least one resistance source applying tension to the flexible connector, whereby a resistance force is transmitted by the flexible connector to the spooling force transmitter, (f) at least one angle locking mechanism for locking the spooling force transmitter at a selected angle around its positioning axis;

(g) at least one rigid arm connected to the spooling force transmitter and having a rigid user handle for receiving an exercise force, the handle being positionable at a plurality of perpendicular distances from the spooling force transmitter's rotational axis, the resistance force and exercise force placing opposing torques on the spooling force transmitter; and (h) at least one rigid arm coupler which permits the user to select a starting angle of the rigid arm about the rotational axis of the spooling force transmitter.

17. The apparatus in claim 16, further comprising at least one user pulley rotatably supported by the carriage, the user pulley having a pulley rim, and the second end of the flexible connector contacts, and is guided by, the user pulley's rim toward a user handle to which the second end of the flexible connector is attached.

18. The apparatus in claim 16, further comprising at least one locational indicator to indicate the user's position relative to the rest of the apparatus.

19. The apparatus in claim 16 further comprising at least one rigid arm coupler having a decoupling mechanism which enables the user to connect and disconnect the rigid arm from the spooling force transmitter.

20. The apparatus in claim 19, further comprising at least one flexible connector coupler which enables the user to attach and detach the flexible connector from the spooling force transmitter, so that the spooling force transmitter can be used as a pulley.

21. The apparatus is claim 16 further comprising at least one angle measurement mechanism for measuring the angle of the spooling force transmitter about its positioning axis.

22. The apparatus in claim 16, further comprising at least one angle measurement mechanism for measuring the angle of the rigid arm about the rotational axis of the spooling force transmitter.

23. The apparatus in claim 22, further comprising at least one locational indicator to indicate the user's position relative to the apparatus.

24. The apparatus in claim 23, further comprising at least one speed measurement device which measures a speed with which the flexible connector moves when an exercise force is generated by the user.

25. The apparatus in claim 24, further comprising at least one whiffletree which divides the flexible connector into a front section and a rear section, each section having a first end and a second end, the first end and the second end of the of the rear connector section connectable to the whiffletree, the whiffletree also connected to the second end of the front connector section, the first end of the front connector section attached to the spooling force transmitter.

26. The apparatus in claim 16, further comprising at least one whiffletree which divides the flexible connector into a front section and a rear section, each section having a first end and a second end, the first end and the second end of the of the rear connector section connectable to the whiffletree, the whiffletree connected to second end of the front connector section, the first end of the front connector section attached to the spooling force transmitter.

27. The apparatus in claim 16, further comprising at least one vertical axis pivot mechanism which creates within the carriage a section that pivots about a vertical axis enabling the positioning of the section that pivots about a vertical axis at a plurality of angles relative to the frame adjacent section about a vertical axis.

28. The apparatus in claim 16, further comprising at least one vertical axis pivot mechanism added to the carriage which creates a combined vertically and horizontally pivotable carriage section that can be positioned at a plurality angles relative to the frame adjacent section around both a vertical axis and the horizontal axis.

29. The apparatus in claim 16, further comprising at least one translating force transmitter, the transmitter and carriage adapted such that the transmitter can translate along the longitudinal axis of the carriage.

30. The apparatus in claim 29, wherein the flexible connector is divided into a front section and a rear section, each section having a first end and a second end, the first end of the rear section selectively connectable to the translating force transmitter and to the second end of the front section, the first end of the front section attached to the spooling force transmitter.

31. The apparatus in claim 30, further comprising at least one whiffletree, and a middle connector section having a first end and a second end, the whiffletree connectable to the first and second ends of the rear flexible connector and to the second end of the middle connector section, the first end of the middle connector section connectable to the second end of the front connector section.

32. The apparatus in claim 31, further comprising at least one angle measurement mechanism for measuring the angle of at least one of the following elements of the apparatus: a) the rigid arm about the rotational axis of the spooling force transmitter, and, b) the spooling force transmitter about its positioning axis.

33. The apparatus in claim 32, further comprising at least one vertical axis pivot mechanism which creates within the carriage a section that pivots about a vertical axis enabling the positioning of the section that pivots about a vertical axis at a plurality of angles relative to the frame adjacent carriage section around a vertical axis.

34. The apparatus in claim 16, further comprising at least one whiffletree that divides the flexible connector into a front section and a rear section, each section having a first end and a second end, the first end and the second end of the of the rear section connectable to the whiffletree, the whiffletree connected to the second end of the front section, the first end of the front section attached to the spooling force transmitter.

35. The apparatus in claim 16, further comprising at least a second vertical rigid member, a second carriage and a width adjustment mechanism the permits the user to adjust the distance between the carriages.

36. The apparatus in claim 16, further comprising at least one additional element, such element having at least one of the following characteristics:

(a) at least one user pulley rotatably supported by the carriage, the user pulley having a pulley rim, and the second end of the flexible connector contacts, and is guided by, the rim of the second carriage pulley toward a user handle to which the second end of the flexible connector is attached;

(b) at least one locational indicator to indicate the user's position relative to the rest of the apparatus;

(c) at least rigid arm coupler having a decoupling mechanism which enables the user to attach and detach the rigid arm from the spooling force transmitter, and a flexible connector coupler which enables the user to attach and detach the flexible connector from the spooling force transmitter, so that the spooling force transmitter can be used as a pulley when the rigid arm and flexible connector are so detached;

(d) at least one vertical axis pivot mechanism which creates within the carriage a section that pivots about a vertical axis enabling the positioning of the section that pivots about a vertical axis at a plurality of angles relative to the frame adjacent carriage section about a vertical axis;

(e) at least one mechanism for measuring the angle of at least one of the following elements of the apparatus: a) the rigid arm about the rotational axis of the spooling force transmitter, and, b) the spooling force transmitter about its positioning axis;

(f) at least one whiffletree which divides the flexible connector into a front section and a rear section, each section having a first end and a second end, the first end and the second end of the of the rear connector section connectable to the whiffletree, the whiffletree also connected to second end of the front connector section, the first end of the front connector section attached to the spooling force transmitter;

(g) at least one speed measurement device which measures the speed with which the flexible connector moves when an exercise force is generated by the user;

(h) at least one translating force transmitter, the transmitter and carriage adapted such that the transmitter can translate along the longitudinal axis of the carriage;

(i) rigid arm coupler having a decoupling mechanism which enables the user to connect and disconnect the rigid arm from the spooling force transmitter;

(j) a flexible connector coupler which enables the user to attach and detach the flexible connector from the spooling force transmitter, so that the spooling force transmitter can be used as a pulley;

(k) at least one flexible connector and translator coupler that divides the flexible connector into a front section and a rear section, each section having a first end and a second end, the first end of the rear connector section selectively connectable to the translating force transmitter and to the second end of the front connector section, the first end of the front connector section attached to the spooling force transmitter and the second end selectively connectable to the translating force transmitter and to the first end of the second connector section; and (l) at least one whiffletree, and a middle connector section having a first end and a second end, the whiffletree connectable to the first and second ends of the rear flexible connector and to the second end of the middle connector section, the first end of the middle connector section connectable to the second end of the front connector section.

37. The apparatus in claim 16, further comprising at least one speed measurement device which measures the speed with which the flexible connector moves when an exercise force is generated by the user.

38. The apparatus in claim 16, wherein the rotational axis is offset from the positioning axis by a distance approximately equal to a radius of the spooling force transmitter.

* * * * *